US009842545B2

(12) United States Patent
Kishi

(10) Patent No.: US 9,842,545 B2
(45) Date of Patent: Dec. 12, 2017

(54) DISPLAY DEVICE AND METHOD FOR DRIVING SAME

(71) Applicant: Sharp Kabushiki Kaisha, Osaka-shi, Osaka (JP)

(72) Inventor: Noritaka Kishi, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 42 days.

(21) Appl. No.: 15/037,712

(22) PCT Filed: Aug. 20, 2014

(86) PCT No.: PCT/JP2014/071721
§ 371 (c)(1),
(2) Date: May 19, 2016

(87) PCT Pub. No.: WO2015/093097
PCT Pub. Date: Jun. 25, 2015

(65) Prior Publication Data

US 2016/0300534 A1 Oct. 13, 2016

(30) Foreign Application Priority Data

Dec. 20, 2013 (JP) ..... 2013-264466

(51) Int. Cl.
*G09G 3/3283* (2016.01)
*G09G 3/3233* (2016.01)
*G09G 3/325* (2016.01)

(52) U.S. Cl.
CPC ..... *G09G 3/3283* (2013.01); *G09G 3/325* (2013.01); *G09G 3/3233* (2013.01);
(Continued)

(58) Field of Classification Search
None
See application file for complete search history.

(56) References Cited

U.S. PATENT DOCUMENTS

2004/0113873 A1* 6/2004 Shirasaki ..... G09G 3/325 345/76
2005/0017934 A1* 1/2005 Chung ..... G09G 3/3233 345/82

(Continued)

FOREIGN PATENT DOCUMENTS

JP 2003-195810 A 7/2003
JP 2005-031630 A 2/2005

(Continued)

*Primary Examiner* — Kenneth B Lee, Jr.
(74) *Attorney, Agent, or Firm* — Keating & Bennett, LLP

(57) ABSTRACT

A display device that can compensate for degradation of circuit elements while suppressing an increase in circuit size is implemented.
A data signal line (S(j)) is not only used as a signal line that transfers a signal for allowing an organic EL element (OLED) in each pixel circuit (11) to emit light at a desired luminance, but also used as a signal line for characteristic detection. In addition, a switch (334) is provided between the data signal line (S(j)) and an internal data line (Sin(j)). In such a configuration, during an AD conversion period during which analog data obtained for characteristic detection is converted into digital data, the switch (334) is brought into an off state and a potential of the data signal line (S(j)) obtained immediately before the AD conversion period is supplied from through a predetermined control line (CL) to the data signal line (S(j)).

20 Claims, 31 Drawing Sheets

(52) U.S. Cl.
CPC ..... *G09G 2300/0426* (2013.01); *G09G 2300/0819* (2013.01); *G09G 2300/0842* (2013.01); *G09G 2310/0262* (2013.01); *G09G 2320/0295* (2013.01); *G09G 2320/043* (2013.01); *G09G 2320/045* (2013.01); *G09G 2320/046* (2013.01); *G09G 2320/0633* (2013.01); *G09G 2330/028* (2013.01)

(56) References Cited

U.S. PATENT DOCUMENTS

| | | | | |
|---|---|---|---|---|
| 2006/0158402 | A1* | 7/2006 | Nathan | G09G 3/3233 345/82 |
| 2007/0200804 | A1* | 8/2007 | Kwon | G09G 3/2014 345/76 |
| 2012/0138922 | A1* | 6/2012 | Yamazaki | H01L 29/7869 257/43 |

FOREIGN PATENT DOCUMENTS

| | | | |
|---|---|---|---|
| JP | 2007-128103 | A | 5/2007 |
| JP | 2007-233326 | A | 9/2007 |
| JP | 2008-523448 | A | 7/2008 |
| JP | 2012-134475 | A | 7/2012 |

* cited by examiner

Fig.9

| | CHARACTERISTIC DETECTION OPERATION | NORMAL OPERATION |
|---|---|---|
| (k+1)TH FRAME | FIRST ROW | SECOND TO nTH ROWS |
| (k+2)TH FRAME | SECOND ROW | FIRST ROW AND THIRD TO nTH ROWS |
| (k+3)TH FRAME | THIRD ROW | FIRST TO SECOND ROWS AND FOURTH TO nTH ROWS |
| ⋮ | ⋮ | ⋮ |
| (k+n)TH FRAME | nTH ROWS | FIRST TO (n-1)TH ROW |

DISPLAY DEVICE AND METHOD FOR DRIVING SAME

TECHNICAL FIELD

The present invention relates to a display device and a method for driving the same, and more specifically to a display device provided with a pixel circuit including an electrooptical element such as an organic EL (Electro Luminescence) element, and a method for driving the same.

BACKGROUND ART

As a display element provided in a display device, there have hitherto been an electrooptical element whose luminance is controlled by an applied voltage, and an electrooptical element whose luminance is controlled by a flowing current. Examples of the electrooptical element whose luminance is controlled by an applied voltage include a liquid crystal display element. Meanwhile, examples of the electrooptical element whose luminance is controlled by a flowing current include an organic EL element. The organic EL element is also called an OLED (Organic Light-Emitting Diode). An organic EL display device that uses the organic EL element being a spontaneous electrooptical element can be easily reduced in thickness and power consumption and increased in luminance as compared to the liquid crystal display device that requires a backlight, a color filter and the like. Hence in recent years, development of the organic EL display device has been actively advanced.

As drive systems for the organic EL display device, a passive matrix system (also called simple matrix system) and an active matrix system are known. As for an organic EL display device employing the passive matrix system, its structure is simple, but a large size and high definition are difficult to achieve. In contrast, as for an organic EL display device employing the active matrix system (hereinafter referred to as an "active matrix-type organic EL display device"), a large size and high definition can be easily realized as compared to the organic EL display device employing the passive matrix system.

In the active matrix-type organic EL display device, a plurality of pixel circuits are formed in a matrix form. The pixel circuit of the active matrix-type organic EL display device typically includes an input transistor for selecting a pixel and a drive transistor for controlling supply of a current to the organic EL element. It is to be noted that in the following, a current that flows from the drive transistor to the organic EL element may be referred to as a "drive current".

FIG. 32 is a circuit diagram showing a configuration of a conventional general pixel circuit 91. This pixel circuit 91 is provided corresponding to each of intersections of a plurality of data lines S and a plurality of scanning lines G which are disposed in a display portion. As shown in FIG. 32, this pixel circuit 91 is provided with two transistors T1 and T2, one capacitor Cst, and one organic EL element OLED. The transistor T1 is an input transistor, and the transistor T2 is a drive transistor.

The transistor T1 is provided between the data signal line S and a gate terminal of the transistor T2. As for the transistor T1, agate terminal is connected to the scanning line G, and a source terminal is connected to the data signal line S. The transistor T2 is provided in series with the organic EL element OLED. As for the transistor T2, a drain terminal is connected to a power supply line that supplies a high-level power supply voltage ELVDD, and a source terminal is connected to an anode terminal of the organic EL element OLED. It should be noted that, the power supply line that supplies the high-level power supply voltage ELVDD is referred to as a "high-level power supply line" in the following, and the high-level power supply line is added with the same symbol ELVDD as that of the high-level power supply voltage. As for the capacitor Cst, one end is connected to the gate terminal of the transistor T2, and the other end is connected to the source terminal of the transistor T2. A cathode terminal of the organic EL element OLED is connected to a power supply line that supplies a low-level power supply voltage ELVSS. It should be noted that, the power supply line that supplies the low-level power supply voltage ELVSS is referred to as a "low-level power supply line" in the following, and the low-level power supply line is added with the same symbol ELVSS as that of the low-level power supply voltage. Further, here, a contact point of the gate terminal of the transistor T2, the one end of the capacitor Cst, and the drain terminal of the transistor T1 is referred to as a "gate node VG" for the sake of convenience. It is to be noted that, although one having a higher potential between a drain and a source is generally called a drain, in descriptions of the present specification, one is defined as a drain and the other is defined as a source, and hence a source potential may become higher than a drain potential.

FIG. 33 is a timing chart for explaining an operation of the pixel circuit 91 shown in FIG. 32. Before time t1, the scanning line G is in a non-selected state. Therefore, before the time t1, the transistor T1 is in an off state, and a potential of the gate node VG is held at an initialization level (e.g., a level in accordance with writing in the last frame). At the time t1, the scanning line G comes into a selected state and the transistor T1 is turned on. Thereby, a data voltage Vdata corresponding to a luminance of a pixel (sub-pixel) formed by this pixel circuit 91 is supplied to the gate node VG via the data signal line S and the transistor T1. Thereafter, in a period till time t2, the potential of the gate node VG changes in accordance with the data voltage Vdata. At this time, the capacitor Cst is charged with a gate-source voltage Vgs which is a difference between the potential of the gate node VG and a source potential of the transistor T2. At the time t2, the scanning line G comes into the non-selected state. Thereby, the transistor T1 is turned off and the gate-source voltage Vgs held by the capacitor Cst is determined. The transistor T2 supplies a drive current to the organic EL element OLED in accordance with the gate-source voltage Vgs held by the capacitor Cst. As a result, the organic EL element OLED emits light with a luminance in accordance with the drive current.

Incidentally, in the organic EL display device, a thin film transistor (TFT) is typically employed as the drive transistor. However, regarding the thin film transistor, variations in threshold voltage tend to occur. When variations in threshold voltage occur in the drive transistor provided in the display portion, variations in luminance occur, and the display quality thus deteriorates. Accordingly, a technique of suppressing deterioration in display quality in the organic EL display device has hitherto been proposed. For example, Japanese Patent Application Laid-Open No. 2005-31630 discloses a technique of compensating for variations in threshold voltage of a drive transistor. Further, Japanese Patent Application Laid-Open No. 2003-195810 and Japanese Patent Application Laid-Open No. 2007-128103 each discloses a technique of making constant a current flowing from a pixel circuit to an organic EL element OLED. Moreover, Japanese Patent Application Laid-Open No.

2007-233326 discloses a technique of displaying an image with a uniform luminance regardless of electron mobility and a threshold voltage of a drive transistor.

According to the foregoing prior arts, even when variations in threshold voltage occur in the drive transistor provided in the display portion, it is possible to supply a constant current to the organic EL element (light-emitting element) in accordance with a desired luminance (target luminance). However, as for the organic EL element, current efficiency decreases with the lapse of time. That is, even when a constant current is supplied to the organic EL element, the luminance gradually decreases with the lapse of time. This results in occurrence of burning.

Thus, unless compensation is performed on degradation of the drive transistor and degradation of the organic EL element, current decrease due to the degradation of the drive transistor occurs and luminance decrease due to the degradation of the organic EL element occurs as shown in FIG. 34. Further, even when compensation is performed on the degradation of the drive transistor, luminance decrease due to the degradation of the organic EL element occurs with the lapse of time as shown in FIG. 35. Accordingly, Japanese Translation of PCT International Application Publication No. 2008-523448 discloses a technique of correcting data based on a characteristic of the organic EL element OLED in addition to the technique of correcting data based on a characteristic of the drive transistor.

PRIOR ART DOCUMENTS

Patent Documents

[Patent Document 1] Japanese Patent Application Laid-Open No. 2005-31630

[Patent Document 2] Japanese Patent Application Laid-Open No. 2003-195810

[Patent Document 3] Japanese Patent Application Laid-Open No. 2007-128103

[Patent Document 4] Japanese Patent Application Laid-Open No. 2007-233326

[Patent Document 5] Japanese Translation of PCT International Application Publication No. 2008-523448

SUMMARY OF THE INVENTION

Problems to be Solved by the Invention

However, according to the techniques disclosed in Japanese Translation of PCT International Application Publication No. 2008-523448, during a selection period, a characteristic of only either one of a drive transistor and an organic EL element can be detected. Hence, simultaneous compensation for both of degradation of the drive transistor and degradation of the organic EL element cannot be performed.

In addition, when a display device is configured to enable detection of a characteristic of a drive transistor and detection of a characteristic of an organic EL element, it is desired to minimize an increase in circuit size. This is because if the circuit size increases, it is disadvantageous in terms of, for example, achievement of low power consumption and achievement of miniaturization. Regarding this point, in the techniques disclosed in Japanese Translation of PCT International Application Publication No. 2008-523448, as shown in FIG. 36, a current detection monitoring line MONITOR for characteristic detection is provided in addition to a data signal line VDATA for supplying a data signal to a pixel circuit. Hence, the degree of an increase in circuit size is large.

An object of the present invention is therefore to implement a display device capable of compensating for degradation of circuit elements while suppressing an increase in circuit size (particularly, a display device capable of simultaneously compensating for both of degradation of drive transistors and degradation of organic EL elements).

Means for Solving the Problems

A first aspect of the present invention is directed to an active matrix-type display device including:

a display unit having: a pixel matrix of n rows×m columns including n×m pixel circuits (n and m are integers greater than or equal to 2), each pixel circuit including an electrooptical element whose luminance is controlled by a current and a drive transistor for controlling a current to be supplied to the electrooptical element; scanning lines provided for the respective rows of the pixel matrix; monitoring control lines provided for the respective rows of the pixel matrix; and data signal lines provided for the respective columns of the pixel matrix;

a pixel circuit driving unit configured to drive the scanning lines, the monitoring control lines, and the data signal lines such that a characteristic detection process is performed during a frame period and that each electrooptical element emits light according to a target luminance, the characteristic detection process detecting a characteristic of a characteristic detection target circuit element including at least one of the electrooptical element and the drive transistor;

a correction data storage unit configured to store characteristic data obtained based on results of the characteristic detection process, as correction data for correcting video signals; and a video signal correcting unit configured to generate data signals to be supplied to the n×m pixel circuits by correcting the video signals based on the correction data stored in the correction data storage unit, wherein each of the pixel circuits includes:

the electrooptical element;

an input transistor having a control terminal connected to the scanning line, a first conduction terminal connected to a control terminal of the drive transistor, and a second conduction terminal connected to the data signal line;

the drive transistor having a first conduction terminal to which a drive power supply potential is provided;

a monitoring control transistor having a control terminal connected to the monitoring control line, a first conduction terminal connected to a second conduction terminal of the drive transistor and an anode of the electrooptical element, and a second conduction terminal connected to the data signal line; and a first capacitor having one end connected to the control terminal of the drive transistor to hold a potential of the control terminal of the drive transistor, the pixel circuit driving unit includes:

an output and current-monitoring circuit having a function of applying the data signal to the data signal line and a function of obtaining, as monitored data, data according to a magnitude of a current flowing through the data signal line, the monitored data being base data for the characteristic data; and an AD conversion circuit configured to convert the monitored data from an analog value to a digital value, the output and current-monitoring circuit includes:

an internal data line connected to the data signal line;

an operational amplifier having a non-inverting input terminal to which the data signal is provided, and an inverting input terminal connected to the internal data line;

a second capacitor having one end connected to the internal data line, and an other end connected to an output terminal of the operational amplifier;

a first control switch having one end connected to the internal data line, and an other end connected to the output terminal of the operational amplifier; and a second control switch having one end connected to the data signal line, and an other end connected to the internal data line, the AD conversion circuit is provided per plurality of the output and current-monitoring circuits, when a row for which the characteristic detection process is performed during a frame period is defined as a monitored row, and a row other than the monitored row is defined as a non-monitored row, the frame period includes a characteristic detection processing period including: a detection preparation period during which preparation for detecting a characteristic of the characteristic detection target circuit element is performed in the monitored row; a current measurement period during which a characteristic of the characteristic detection target circuit element is detected by measuring a current flowing through the data signal line; and a light emission preparation period during which preparation for allowing the electrooptical element to emit light is performed in the monitored row, the current measurement period includes: a data signal line charging period during which the data signal line is charged such that a current of a magnitude according to the characteristic of the characteristic detection target circuit element flows through the data signal line; a monitoring period during which the monitored data is obtained by accumulating a time-integrated value of the current flowing through the data signal line in the second capacitor; and an AD conversion period during which the AD conversion circuit converts the monitored data from the analog value to the digital value, and during the AD conversion period, the data signal line and the internal data line are electrically disconnected from each other by bringing the second control switch into an off state, and the AD conversion circuit sequentially converts the plurality of pieces of monitored data from analog values to digital values, the plurality of pieces of monitored data being obtained by a plurality of corresponding output and current-monitoring circuits.

According to a second aspect of the present invention, in the first aspect of the present invention, the current measurement period includes: a drive transistor characteristic detection period during which current measurement for detecting a characteristic of the drive transistor is performed; and an electrooptical element characteristic detection period during which current measurement for detecting a characteristic of the electrooptical element is performed.

According to a third aspect of the present invention, in the second aspect of the present invention, the output and current-monitoring circuit further includes a third control switch having one end connected to the data signal line, and an other end connected to a predetermined control line, and in the drive transistor characteristic detection period included in the current measurement period, during the AD conversion period, the data signal line and the control line are electrically connected to each other by bringing the third control switch into an on state, and a potential of a magnitude is provided to the control line, the magnitude being equal to a magnitude of a potential provided to the data signal line during the data signal line charging period.

According to a fourth aspect of the present invention, in the third aspect of the present invention, in the electrooptical element characteristic detection period included in the current measurement period, during the AD conversion period, the third control switch is brought into an off state and the monitoring control transistor is brought into an off state, so that the data signal line goes into a high-impedance state.

According to a fifth aspect of the present invention, in the third aspect of the present invention, in the electrooptical element characteristic detection period included in the current measurement period, during the AD conversion period, the data signal line and the control line are electrically connected to each other by bringing the third control switch into an on state, and a potential of a magnitude is provided to the control line, the magnitude being substantially equal to a magnitude of a potential provided to the data signal line during the data signal line charging period.

According to a sixth aspect of the present invention, in the third aspect of the present invention, in the electrooptical element characteristic detection period included in the current measurement period, during the AD conversion period, the data signal line and the control line are electrically connected to each other by bringing the third control switch into an on state, and a potential of certain magnitude is provided to the control line, the potential of certain magnitude being close to a potential to be provided to the data signal line during the data signal line charging period.

According to a seventh aspect of the present invention, in the second aspect of the present invention, when a potential provided to the data signal line during the detection preparation period is Vmg, a potential provided to the data signal line during the drive transistor characteristic detection period is Vm_TFT, and a potential provided to the data signal line during the electrooptical element characteristic detection period is Vm_oled, values of Vmg, Vm_TFT, and Vm_oled are set so as to satisfy following relationships:

$$Vm_TFT<Vmg-Vth(T2)$$

$$Vm_TFT<ELVSS+Vth(oled)$$

$$Vm_oled>Vmg-Vth(T2)$$

$$Vm_oled>ELVSS+Vth(oled)$$

where Vth(T2) is a threshold voltage of the drive transistor, Vth(oled) is a light emission threshold voltage of the electrooptical element, and ELVSS is a cathode potential of the electrooptical element.

According to an eighth aspect of the present invention, in the first aspect of the present invention, the characteristic detection processing period is provided in a vertical retrace period.

According to a ninth aspect of the present invention, in the eighth aspect of the present invention, with any electrooptical element defined as a focused electrooptical element, when the focused electrooptical element is included in the monitored row, the pixel circuit driving unit provides to the data signal line a potential of a data signal corresponding to a larger grayscale voltage than a grayscale voltage provided when the focused electrooptical element is included in the non-monitored row, upon performing writing of the data signal to a pixel circuit included in the monitored row during a vertical scanning period.

According to a tenth aspect of the present invention, in the first aspect of the present invention, the characteristic detection processing period is provided in a vertical scanning period.

According to an eleventh aspect of the present invention, in the first aspect of the present invention, a cycle is repeated a plurality of times during a current measurement period for detecting a characteristic of one characteristic detection target circuit element, the cycle including the data signal line charging period, the monitoring period, and the AD conversion period.

According to a twelfth aspect of the present invention, in the first aspect of the present invention, the characteristic detection process for only either one of the electrooptical element and the drive transistor is performed per frame period.

A thirteenth aspect of the present invention is directed to a method for driving a display device including: a pixel matrix of n rows×m columns including n×m pixel circuits (n and m are integers greater than or equal to 2), each pixel circuit including an electrooptical element whose luminance is controlled by a current and a drive transistor for controlling a current to be supplied to the electrooptical element; scanning lines provided for the respective rows of the pixel matrix; monitoring control lines provided for the respective rows of the pixel matrix; data signal lines provided for the respective columns of the pixel matrix; and a pixel circuit driving unit configured to drive the scanning lines, the monitoring control lines, and the data signal lines, the method including:

a characteristic detecting step of detecting, during a frame period, a characteristic of a characteristic detection target circuit element including at least one of the electrooptical element and the drive transistor;

a correction data storing step of allowing a correction data storage unit to store characteristic data obtained based on results of the detection in the characteristic detecting step, as correction data for correcting video signals, the correction data storage unit being prepared in advance; and a video signal correcting step of generating data signals to be supplied to the n×m pixel circuits by correcting the video signals based on the correction data stored in the correction data storage unit, wherein each of the pixel circuits includes:

the electrooptical element;

an input transistor having a control terminal connected to the scanning line, a first conduction terminal connected to a control terminal of the drive transistor, and a second conduction terminal connected to the data signal line;

the drive transistor having a first conduction terminal to which a drive power supply potential is provided;

a monitoring control transistor having a control terminal connected to the monitoring control line, a first conduction terminal connected to a second conduction terminal of the drive transistor and an anode of the electrooptical element, and a second conduction terminal connected to the data signal line; and a first capacitor having one end connected to the control terminal of the drive transistor to hold a potential of the control terminal of the drive transistor, the pixel circuit driving unit includes:

an output and current-monitoring circuit having a function of applying the data signal to the data signal line and a function of obtaining, as monitored data, data according to a magnitude of a current flowing through the data signal line, the monitored data being base data for the characteristic data; and an AD conversion circuit configured to convert the monitored data from an analog value to a digital value, the output and current-monitoring circuit includes:

an internal data line connected to the data signal line;

an operational amplifier having a non-inverting input terminal to which the data signal is provided, and an inverting input terminal connected to the internal data line;

a second capacitor having one end connected to the internal data line, and an other end connected to an output terminal of the operational amplifier;

a first control switch having one end connected to the internal data line, and an other end connected to the output terminal of the operational amplifier; and a second control switch having one end connected to the data signal line, and an other end connected to the internal data line, the AD conversion circuit is provided per plurality of the output and current-monitoring circuits, when a row for which the characteristic detection process is performed during a frame period is defined as a monitored row, and a row other than the monitored row is defined as a non-monitored row, the characteristic detecting step includes:

a detection preparing step of preparing for detecting a characteristic of the characteristic detection target circuit element in the monitored row;

a current measuring step of detecting a characteristic of the characteristic detection target circuit element by measuring a current flowing through the data signal line; and a light emission preparing step of preparing for allowing the electrooptical element to emit light in the monitored row, the current measuring step includes:

a data signal line charging step of charging the data signal line such that a current of a magnitude according to the characteristic of the characteristic detection target circuit element flows through the data signal line;

a monitoring step of obtaining monitored data by accumulating a time-integrated value of the current flowing through the data signal line in the second capacitor; and an AD converting step of converting, by the AD conversion circuit, the monitored data from the analog value to the digital value, and in the AD converting step, the data signal line and the internal data line are electrically disconnected from each other by bringing the second control switch into an off state, and the AD conversion circuit sequentially converts the plurality of pieces of monitored data from analog values to digital values, the plurality of pieces of monitored data being obtained by a plurality of corresponding output and current-monitoring circuits.

Effects of the Invention

According to the first aspect of the present invention, in a display device having pixel circuits, each including an electrooptical element (e.g., an organic EL element) whose luminance is controlled by a current, and a drive transistor for controlling a current to be supplied to the electrooptical element, detection of a characteristic of a circuit element (at least one of the electrooptical element and the drive transistor) is performed during a frame period. Then, a video signal is corrected using correction data which is obtained taking into account a result of the detection. Since a data signal generated based on the thus corrected video signal is supplied to the pixel circuit, a drive current of a magnitude that compensates for degradation of the circuit element is supplied to the electrooptical element. Here, the characteristic of the circuit element is detected by measuring a current flowing through a data signal line. That is, the data signal line is not only used as a signal line that transfers a signal for allowing an electrooptical element in each pixel circuit to emit light at a desired luminance, but also used as a signal line for characteristic detection. Hence, new signal lines do not need to be provided in the display unit to detect characteristics of circuit elements. Accordingly, it becomes possible to compensate for degradation of the circuit elements while an increase in circuit size is suppressed.

In addition, during an AD conversion period, by a second switch going into an off state, analog data obtained during a monitoring period is held in an output and current-monitoring circuit. Using this function of holding analog data (sample and hold function), an AD conversion circuit is shared between a plurality of columns. This effectively suppresses an increase in circuit size associated with implementation of a configuration capable of detecting characteristics of the circuit elements.

According to the second aspect of the present invention, detection of characteristics of an electrooptical element and a drive transistor is performed during a frame period. Hence, it becomes possible to compensate for both of degradation of the electrooptical element and degradation of the drive transistor while an increase in circuit size is effectively suppressed.

According to the third aspect of the present invention, during an AD conversion period included in a drive transistor characteristic detection period, a data signal line and an internal data line are electrically disconnected from each other, and a potential of a magnitude equal to a potential of the data signal line that is obtained immediately before the AD conversion period is provided to the data signal line from a control line. Hence, the potential of the data signal line is prevented from being changed during AD conversion due to sharing of an AD conversion circuit. In addition, since recharging of the data signal line is performed in a very short period of time, it becomes possible to repeatedly perform current measurement for characteristic detection. By this, it becomes possible to ensure a sufficient S/N ratio upon current measurement for detecting a characteristic of a drive transistor.

According to the fourth aspect of the present invention, during an AD conversion period included in an electrooptical element characteristic detection period, a data signal line is brought into a high-impedance state. Hence, the potential of the data signal line is prevented from being changed during AD conversion due to sharing of an AD conversion circuit. In addition, since recharging of the data signal line is performed in a very short period of time, it becomes possible to repeatedly perform current measurement for characteristic detection. By this, it becomes possible to ensure a sufficient S/N ratio upon current measurement for detecting a characteristic of an electrooptical element.

According to the fifth aspect of the present invention, during an AD conversion period included in an electrooptical element characteristic detection period, a data signal line and an internal data line are electrically disconnected from each other, and a potential of a magnitude equal to a potential of the data signal line that is obtained immediately before the AD conversion period is provided to the data signal line from a control line. Hence, the potential of the data signal line is prevented from being changed during AD conversion due to sharing of an AD conversion circuit. In addition, since recharging of the data signal line is performed in a very short period of time, it becomes possible to repeatedly perform current measurement for characteristic detection. By this, it becomes possible to ensure a sufficient S/N ratio upon current measurement for detecting a characteristic of an electrooptical element.

According to the sixth aspect of the present invention, as with the fifth aspect of the present invention, it becomes possible to ensure a sufficient S/N ratio upon current measurement for detecting a characteristic of an electrooptical element.

According to the seventh aspect of the present invention, during a drive transistor characteristic detection period, a drive transistor securely goes into an on state and an electrooptical element securely goes into an off state. In addition, during an electrooptical element characteristic detection period, the drive transistor securely goes into an off state and the electrooptical element securely goes into an on state.

According to the eighth aspect of the present invention, for a monitored row, after performing writing during a vertical scanning period, writing is performed again during a light emission preparation period included in a vertical retrace period. In this regard, in order to enable writing during the light emission preparation period, corresponding data needs to be held after performing writing during the vertical scanning period. Regarding this point, since the data to be held is merely data for one line, an increase in memory capacity is a little. On the other hand, in a configuration in which a characteristic detection processing period is provided in a vertical scanning period, a line memory for several tens of lines may be required. By the above, required memory capacity is reduced compared to the configuration in which a characteristic detection processing period is provided in a vertical scanning period.

According to the ninth aspect of the present invention, a potential of a data signal is adjusted taking into account the fact that in a monitored row an electrooptical element is temporarily turned off during a vertical retrace period. Hence, a degradation in display quality is suppressed.

According to the tenth aspect of the present invention, unlike a configuration in which a characteristic detection processing period is provided in a vertical retrace period, writing according to a target luminance in a monitored row needs to be performed only once in one frame period.

According to the eleventh aspect of the present invention, current measurement is repeated a plurality of times during each current measurement period for detecting a characteristic of a characteristic detection target circuit element. Hence, a sufficient S/N ratio can be ensured.

According to the twelfth aspect of the present invention, by performing a characteristic detection process for only either one of an electrooptical element and a drive transistor per frame period, sufficient time for transferring data obtained by AD conversion is ensured after the AD conversion.

According to the thirteenth aspect of the present invention, the same effects as those of the first aspect of the present invention can be provided by an invention of a method for driving a display device.

BRIEF DESCRIPTION OF THE DRAWINGS

FIG. 9 is a diagram for describing a transition of operation for each row in the embodiment.

MODE FOR CARRYING OUT THE INVENTION

One embodiment of the present invention will be described below with reference to the accompanying drawings. Note that in the following it is assumed that m and n are integers greater than or equal to 2, i is an integer between 1 and n, inclusive, and j is an integer between 1 and m, inclusive. Note also that in the following a characteristic of a drive transistor provided in a pixel circuit is referred to as "TFT characteristic" and a characteristic of an organic EL element provided in the pixel circuit is referred to as "OLED characteristic".

<1. Overall Configuration>

Figure 2:
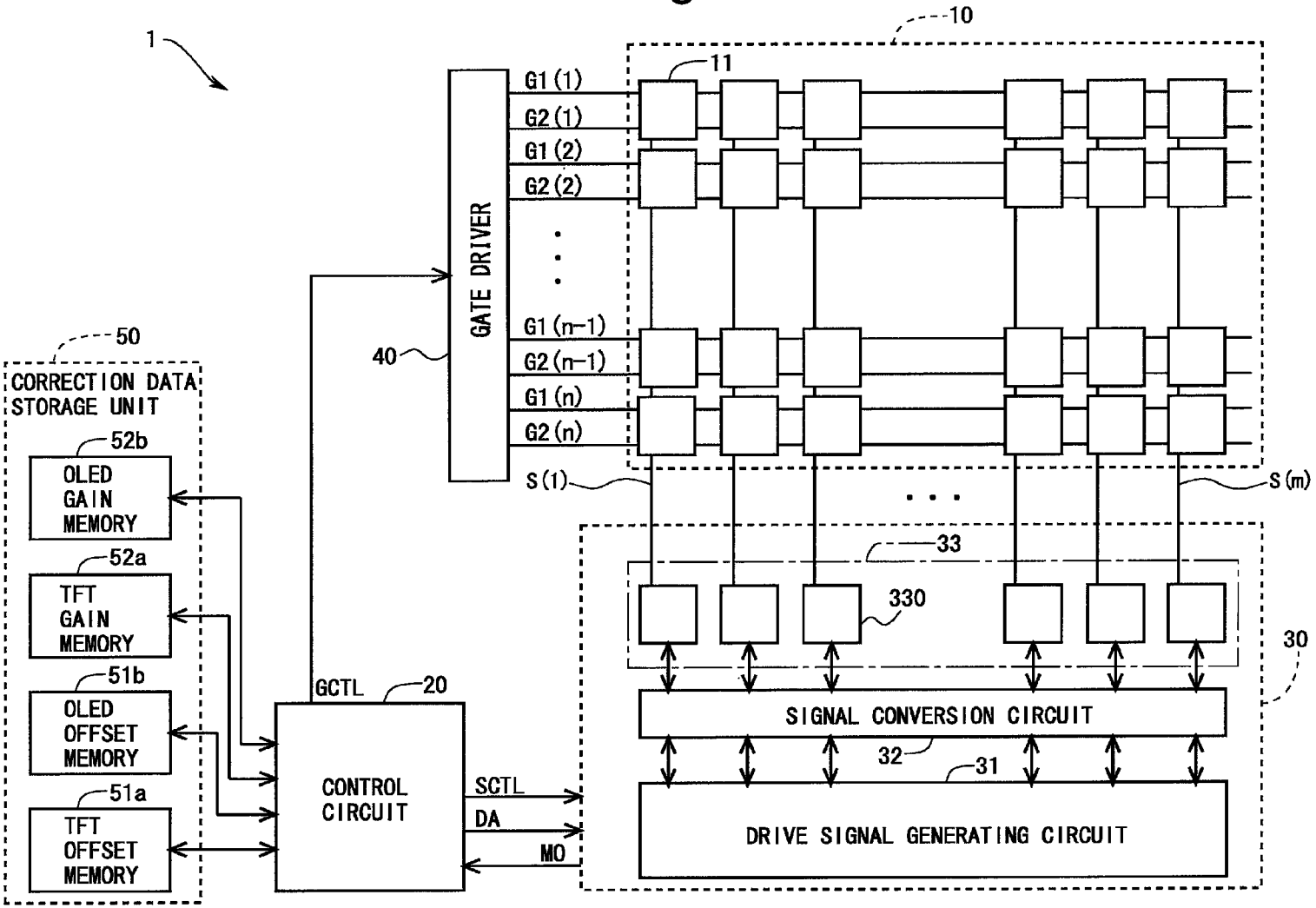
FIG. 2 is a block diagram showing an overall configuration of an active matrix-type organic EL display device according to the embodiment.

FIG. 2 is a block diagram showing an overall configuration of an active matrix-type organic EL display device 1 according to one embodiment of the present invention. The organic EL display device 1 includes a display unit 10, a control circuit 20, a source driver (data signal line drive circuit) 30, a gate driver (scanning line drive circuit) 40, and a correction data storage unit 50. In the present embodiment, a pixel circuit driving unit is implemented by the source driver 30 and the gate driver 40. Note that the configuration may be such that one or both of the source driver 30 and the gate driver 40 are integrally formed with the display unit 10.

In the display unit 10 there are disposed m data signal lines S(1) to S(m) and n scanning lines G1(1) to G1(*n*) which intersect the m data signal lines S(1) to S(m). In the following, an extension direction of the data signal lines is a Y-direction and an extension direction of the scanning lines is an X-direction. Components lying along the Y-direction may be referred to as "column" and components lying along the X-direction may be referred to as "row". In addition, in the display unit 10, n monitoring control lines G2(1) to G2(*n*) are disposed so as to have a one-to-one correspondence with the n scanning lines G1(1) to G1(*n*). The scanning lines G1(1) to G1(*n*) and the monitoring control lines G2(1) to G2(*n*) are parallel to each other. Furthermore, in the display unit 10, n×m pixel circuits 11 are provided at the respective intersections of the n scanning lines G1(1) to G1(*n*) and the m data signal lines S(1) to S(m). By thus providing the n×m pixel circuits 11, a pixel matrix of n rows×m columns is formed in the display unit 10. In addition, there are disposed high-level power supply lines that supply a high-level power supply voltage and low-level power supply lines that supply a low-level power supply voltage in the display unit 10.

Note that in the following, when the m data signal lines S(1) to S(m) do not need to be distinguished from each other, the data signal line is simply represented by reference character S. Likewise, when the n scanning lines G1(1) to G1 (*n*) do not need to be distinguished from each other, the scanning line is simply represented by reference character G1, and when the n monitoring control lines G2(1) to G2(*n*) do not need to be distinguished from each other, the monitoring control line is simply represented by reference character G2.

The data signal line S in the present embodiment is not only used as a signal line that transfers a luminance signal for allowing an organic EL element in a pixel circuit 11 to emit light at a desired luminance, but also used as a signal line for providing control potentials for detecting a TFT characteristic and an OLED characteristic to the pixel circuit 11, and as a signal line serving as a path for currents that represent a TFT characteristic and an OLED characteristic and that are measurable by an output and current-monitoring circuit 330 which will be described later.

The control circuit 20 controls the operation of the source driver 30 by providing data signals DA and a source control signal SCTL to the source driver 30, and controls the operation of the gate driver 40 by providing a gate control signal GCTL to the gate driver 40. The source control signal SCTL includes, control clock signals CLK1, CLK2, and CLK2B for controlling the operation of the output and current-monitoring circuits 330, in addition to a source start pulse, a source clock, and a latch strobe signal which are used conventionally, for example. The gate control signal GCTL includes, for example, a gate start pulse, a gate clock, and an output enable signal. In addition, the control circuit 20 receives monitored data MO which is provided from the source driver 30, and performs an update to correction data stored in the correction data storage unit 50. Note that the monitored data MO is data measured to obtain a TFT characteristic and an OLED characteristic.

The gate driver 40 is connected to the n scanning lines G1(1) to G1(*n*) and the n monitoring control lines G2(1) to G2(*n*). The gate driver 40 is composed of a shift register, a logic circuit, and the like. Meanwhile, in the organic EL display device 1 according to the present embodiment, a video signal (base data for the above-described data signal DA) which is transmitted from an external source is corrected based on a TFT characteristic and an OLED characteristic. In this regard, in the present embodiment, in each frame, detection of a TFT characteristic and an OLED characteristic for one row is performed. Specifically, when detection of a TFT characteristic and an OLED characteristic for the first row is performed in a given frame, detection of a TFT characteristic and an OLED characteristic for the second row is performed in the next frame, and detection of a TFT characteristic and an OLED characteristic for the third row is performed in the frame after the next frame. In this manner, detection of a TFT characteristic and an OLED characteristic for n rows is performed over n frame periods. Note that in this specification a row for which detection of a TFT characteristic and an OLED characteristic is performed when focusing on any frame is referred to as "monitored row", and a row other than the monitored row is referred to as "non-monitored row".

Figure 3:
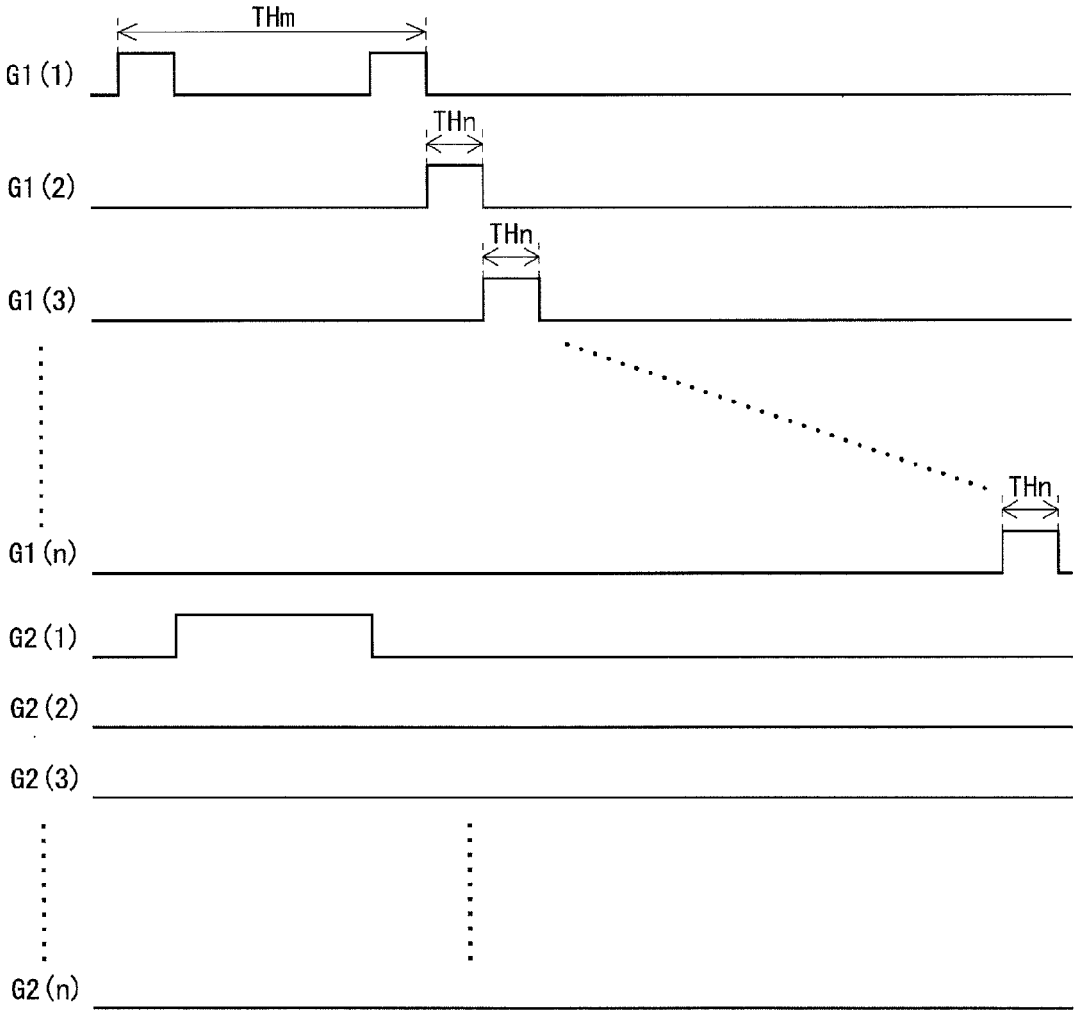
FIG. 3 is a timing chart for describing the operation of a gate driver in the embodiment.
Figure 4:
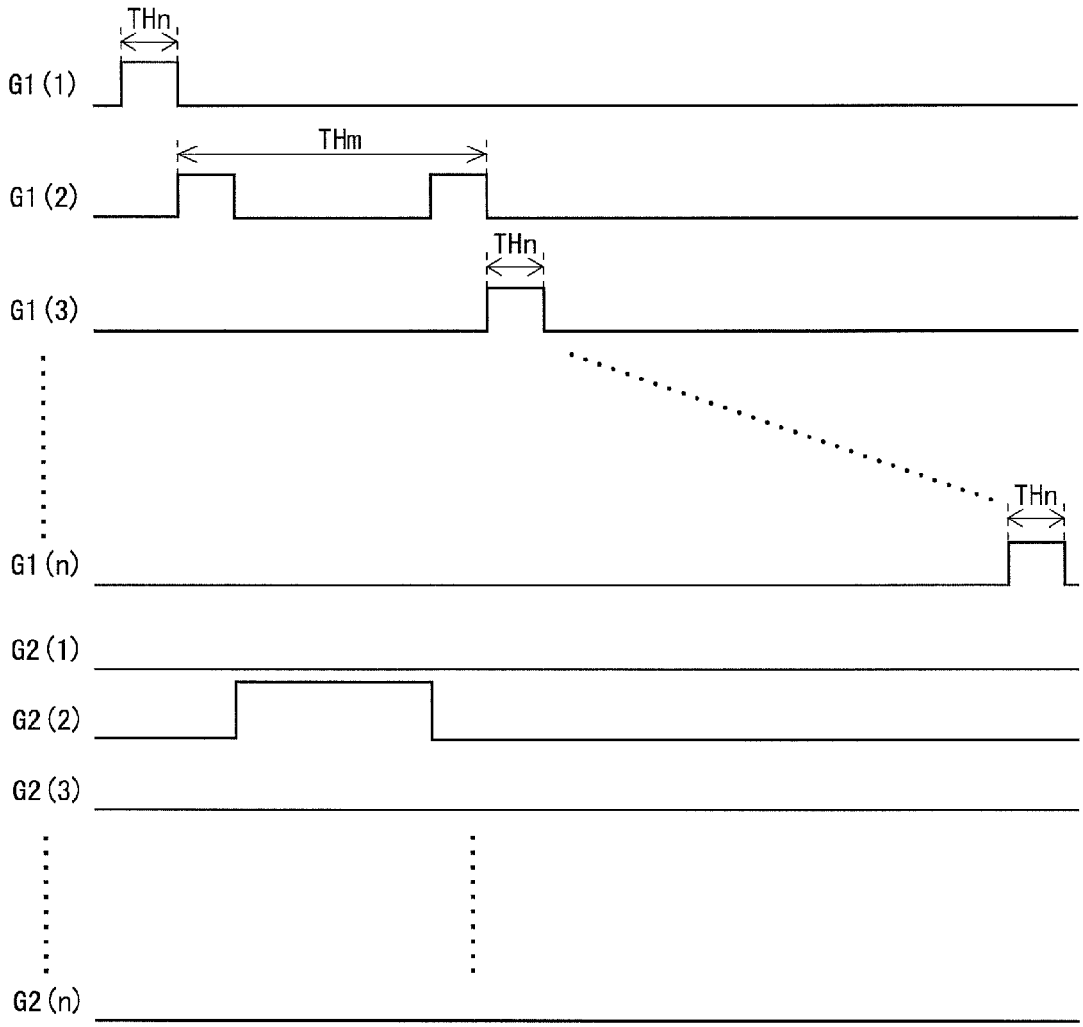
FIG. 4 is a timing chart for describing the operation of the gate driver in the embodiment.
Figure 5:
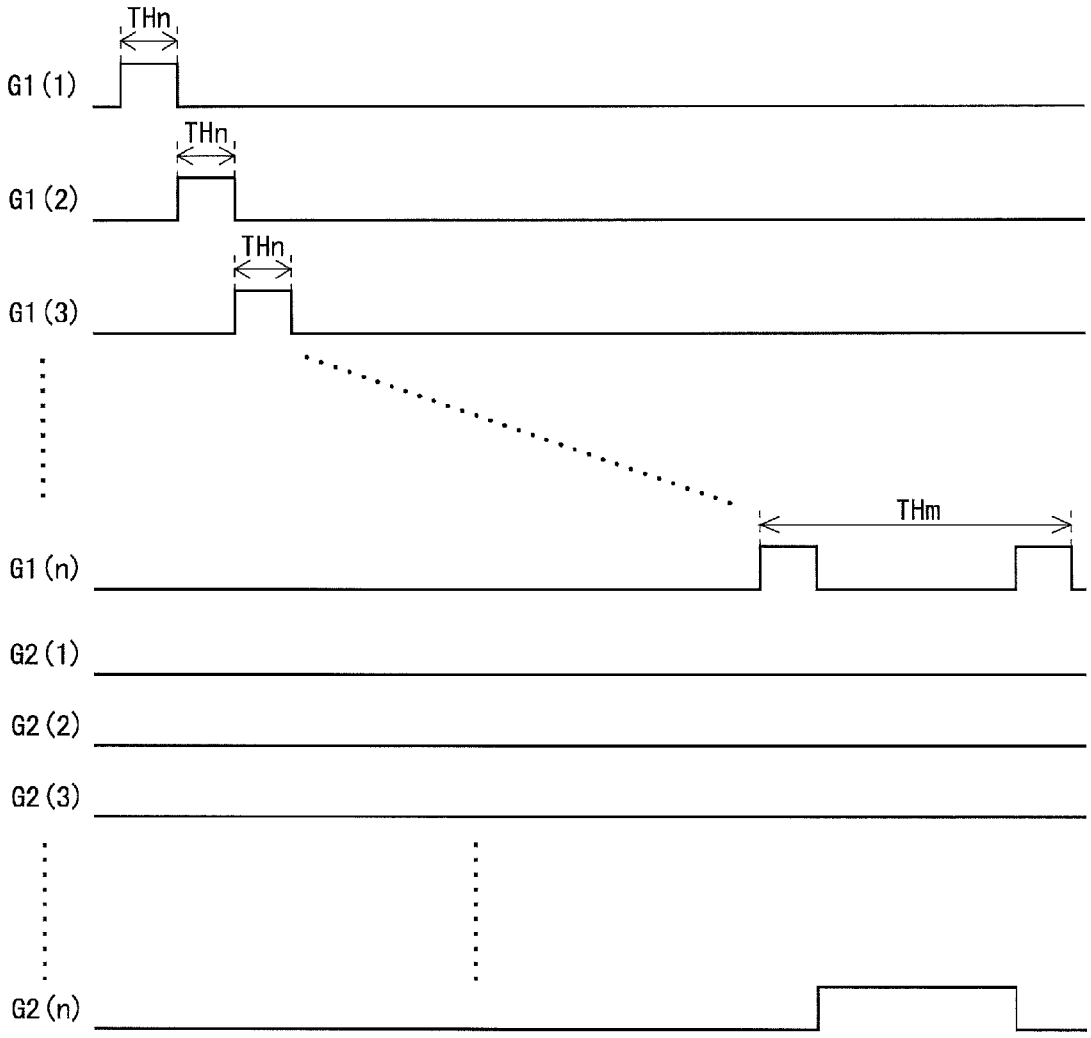
FIG. 5 is a timing chart for describing the operation of the gate driver in the embodiment.

Here, when a frame in which detection of a TFT characteristic and an OLED characteristic for the first row is performed is defined as a (k+1)th frame, in the (k+1)th frame the n scanning lines G1(1) to G1(*n*) and the n monitoring control lines G2(1) to G2(*n*) are driven in a manner shown in FIG. 3, in a (k+2)th frame the n scanning lines G1(1) to G1 (*n*) and the n monitoring control lines G2(1) to G2(*n*) are driven in a manner shown in FIG. 4, and in a (k+n)th frame the n scanning lines G1(1) to G1(*n*) and the n monitoring control lines G2(1) to G2(*n*) are driven in a manner shown in FIG. 5. Note that for FIGS. 3 to 5 a high-level state is an active state. Note also that in FIGS. 3 to 5 one horizontal scanning period for a monitored row is represented by reference character THm, and one horizontal scanning period for a non-monitored row is represented by reference character THn.

As can be grasped from FIGS. 3 to 5, the length of one horizontal scanning period is different between the monitored row and the non-monitored row. Specifically, the length of one horizontal scanning period for the monitored row is longer than that of one horizontal scanning period for the non-monitored row. For the non-monitored row, one frame period includes one selection period as with a common organic EL display device. For the monitored row, unlike a common organic EL display device, one frame period includes two selection periods. Note that a more detailed description of one horizontal scanning period THm for the monitored row will be made later.

As shown in FIGS. 3 to 5, in each frame, monitoring control lines G2 corresponding to a non-monitored row are maintained in a non-active state. A monitoring control line G2 corresponding to a monitored row is maintained in an active state during a period other than selection periods in one horizontal scanning period THm (a period during which a scanning line G1 is in a non-active state). In the present embodiment, the gate driver 40 is configured such that the n scanning lines G1(1) to G1(*n*) and the n monitoring control lines G2(1) to G2(*n*) are driven in the above-described manner. Note that to generate two pulses on a scanning line G1 during one frame period in a monitored row, the waveform of an output enable signal which is transmitted to the gate driver 40 from the control circuit 20 may be controlled using publicly known techniques.

The source driver 30 is connected to the m data signal lines S(1) to S(m). The source driver 30 is composed of a drive signal generating circuit 31, a signal conversion circuit 32, and an output unit 33 including m output and current-monitoring circuits 330 (see FIG. 2). Each of the m output and current-monitoring circuits 330 in the output unit 33 is connected to their corresponding data signal line S among the m data signal lines S(1) to S(m).

The drive signal generating circuit 31 includes a shift register, a sampling circuit, and a latch circuit. In the drive signal generating circuit 31, the shift register sequentially transfers a source start pulse from an input terminal to an output terminal in synchronization with a source clock. According to the transfer of the source start pulse, sampling pulses for the respective data signal lines S are outputted from the shift register. The sampling circuit sequentially stores data signals DA for one row, according to timing of the sampling pulses. The latch circuit catches the data signals DA for one row which are stored in the sampling circuit, according to a latch strobe signal, and holds the data signals DA.

Note that in the present embodiment data signal DA includes a luminance signal for allowing an organic EL element in each pixel to emit light at a desired luminance, and a monitoring control signal for controlling the operation of the pixel circuit 11 when detecting a TFT characteristic and an OLED characteristic.

The signal conversion circuit 32 includes a D/A converter and an A/D converter. The data signals DA for one row which are held in the latch circuit in the drive signal generating circuit 31 in the above-described manner are converted into analog voltages by the D/A converter in the signal conversion circuit 32. The converted analog voltages are provided to the output and current-monitoring circuits 330 in the output unit 33. In addition, monitored data MO is provided to the signal conversion circuit 32 from the output and current-monitoring circuits 330 in the output unit 33. The monitored data MO is converted from an analog voltage into a digital signal by the A/D converter in the signal conversion circuit 32. Then, the monitored data MO converted into the digital signal is provided to the control circuit 20 through the drive signal generating circuit 31.

Figure 6:
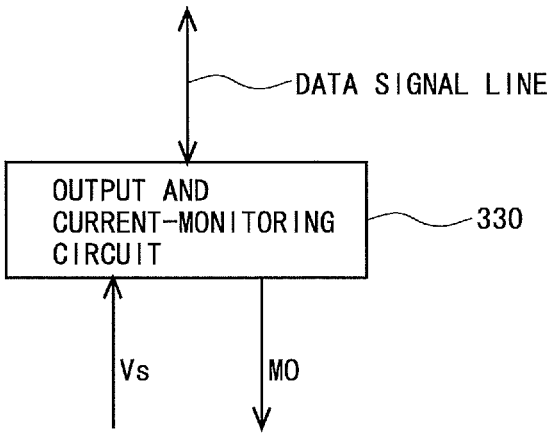
FIG. 6 is a diagram for describing input and output signals of an output and current-monitoring circuit in an output unit in the embodiment.

FIG. 6 is a diagram for describing input and output signals of an output and current-monitoring circuit 330 in the output unit 33. An analog voltage Vs serving as a data signal DA is provided to the output and current-monitoring circuit 330 from the signal conversion circuit 32. The analog voltage Vs is applied to a data signal line S through a buffer in the output and current-monitoring circuit 330. In addition, the output and current-monitoring circuit 330 has a function of obtaining a magnitude of a current flowing through the data signal line S, as analog data (analog voltage), and a function of holding the value of analog data obtained at given timing, throughout a period during which AD conversion is performed (i.e., a sample and hold function). The data obtained by the output and current-monitoring circuit 330 is provided as monitored data MO to the signal conversion circuit 32. Note that a detailed configuration of the output and current-monitoring circuit 330 will be described later (see FIG. 1).

The correction data storage unit 50 includes a TFT offset memory 51*a*, an OLED offset memory 51*b*, a TFT gain memory 52*a*, and an OLED gain memory 52*b* (see FIG. 2). Note that these four memories may be physically one memory or may be physically different memories. The correction data storage unit 50 stores therein correction data which is used to correct video signals transmitted from an external source. Specifically, the TFT offset memory 51*a* stores, as correction data, an offset value obtained based on a result of detection of a TFT characteristic. The OLED offset memory 51*b* stores, as correction data, an offset value obtained based on a result of detection of an OLED characteristic. The TFT gain memory 52*a* stores, as correction data, a gain value obtained based on the result of detection of a TFT characteristic. The OLED gain memory 52*b* stores, as correction data, a degradation correction factor obtained based on the result of detection of an OLED characteristic. Note that typically offset values and gain values whose numbers are equal to the number of pixels in the display unit 10 are stored in the TFT offset memory 51*a* and the TFT gain memory 52*a*, respectively, as correction data based on results of detection of a TFT characteristic. Note also that typically offset values and degradation correction factors whose numbers are equal to the number of pixels in the display unit 10 are stored in the OLED offset memory 51*b* and the OLED gain memory 52*b*, respectively, as correction data based on results of detection of an OLED characteristic. Note, however, that the configuration may be such that each memory stores one value for every plurality of pixels.

The control circuit 20 updates the offset values in the TFT offset memory 51*a*, the offset values in the OLED offset memory 51*b*, the gain values in the TFT gain memory 52*a*, and the degradation correction factors in the OLED gain memory 52*b*, based on monitored data MO provided from the source driver 30. In addition, the control circuit 20 reads the offset values in the TFT offset memory 51*a*, the offset values in the OLED offset memory 51*b*, the gain values in the TFT gain memory 52*a*, and the degradation correction factors in the OLED gain memory 52*b* to correct video signals. Data obtained by the correction is transmitted as data signals DA to the source driver 30.

<2. Detailed Configuration of a Main Part>

Figure 1:
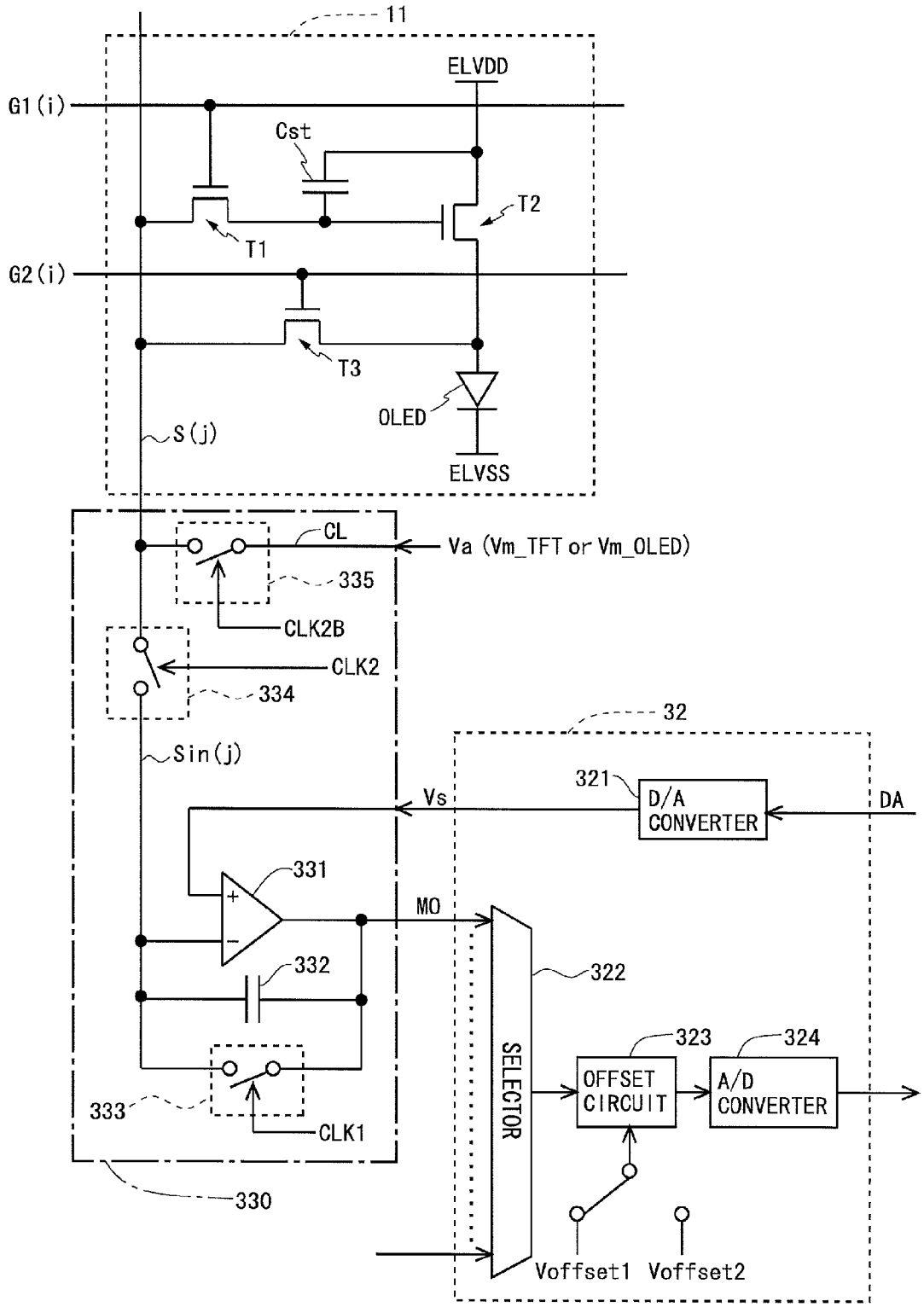
FIG. 1 is a circuit diagram showing detailed configurations of a pixel circuit, an output and current-monitoring circuit, and a signal conversion circuit in one embodiment of the present invention.

Next, a detailed configuration of a main part of the present embodiment will be described. FIG. 1 is a circuit diagram showing detailed configurations of a pixel circuit 11, an output and current-monitoring circuit 330, and a signal conversion circuit 32. The configurations and operation of these circuits will be described in detail below.

<2.1 Pixel Circuit>

The pixel circuit 11 shown in FIG. 1 is a pixel circuit 11 at an ith row and a jth column. The pixel circuit 11 includes one organic EL element OLED, three transistors T1 to T3, and one capacitor Cst. The transistor T1 functions as an input transistor that selects a pixel, the transistor T2 functions as a drive transistor that controls the supply of a current to the organic EL element OLED, and the transistor T3 functions as a monitoring control transistor that controls whether to detect a TFT characteristic and an OLED characteristic. Note that in the present embodiment the transistor T2 and the organic EL element OLED correspond to a characteristic detection target circuit element. Note also that for each transistor, a gate terminal corresponds to a control terminal, a drain terminal corresponds to a first conduction terminal, and a source terminal corresponds to a second conduction terminal.

The transistor T1 is provided between a data signal line S(j) and the gate terminal of the transistor T2. For the transistor T1, the gate terminal is connected to a scanning line G1(*i*) and the source terminal is connected to the data signal line S(j). The transistor T2 is provided in series with the organic EL element OLED. For the transistor T2, the gate terminal is connected to the drain terminal of the transistor T1, the drain terminal is connected to a high-level power supply line ELVDD, and the source terminal is connected to an anode terminal of the organic EL element OLED. For the transistor T3, the gate terminal is connected to a monitoring control line G2(*i*), the drain terminal is connected to the anode terminal of the organic EL element OLED, and the source terminal is connected to the data signal line S(j). For the capacitor Cst, one end is connected to the gate terminal of the transistor T2 and the other end is connected to the drain terminal of the transistor T2. Note that a first capacitor is implemented by the capacitor Cst. A cathode terminal of the organic EL element OLED is connected to a low-level power supply line ELVSS.

Figure 32:
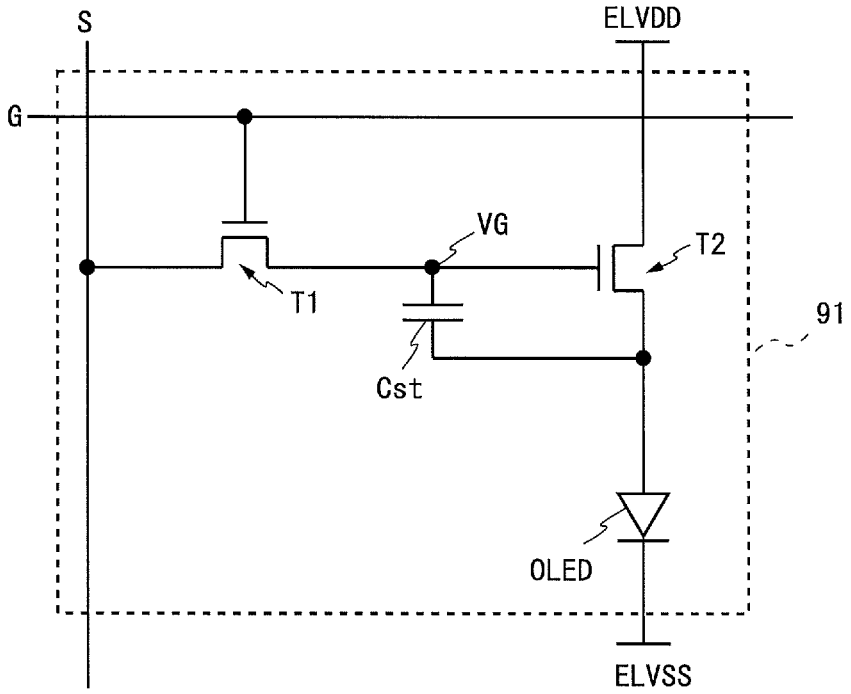
FIG. 32 is a circuit diagram showing a configuration of a conventional common pixel circuit.
Figure 33:
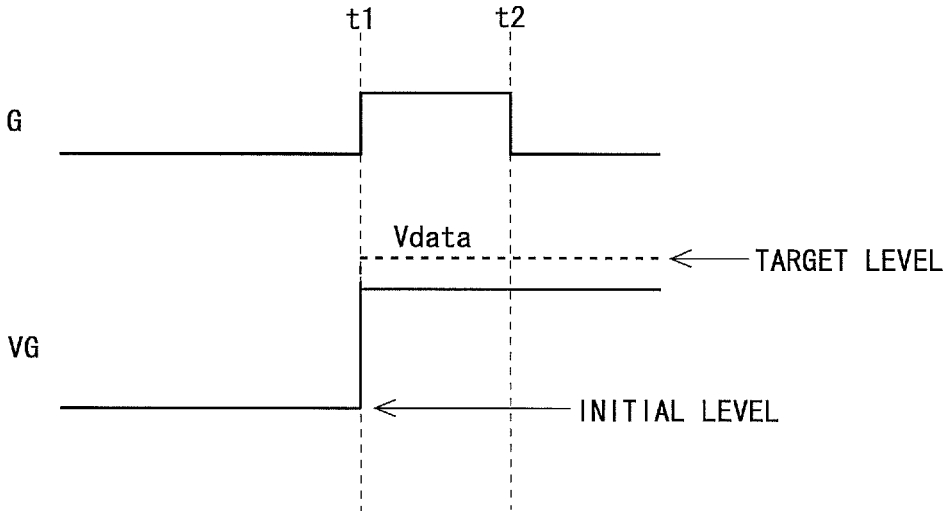
FIG. 33 is a timing chart for describing the operation of the pixel circuit shown in FIG. 32.
Figure 34:
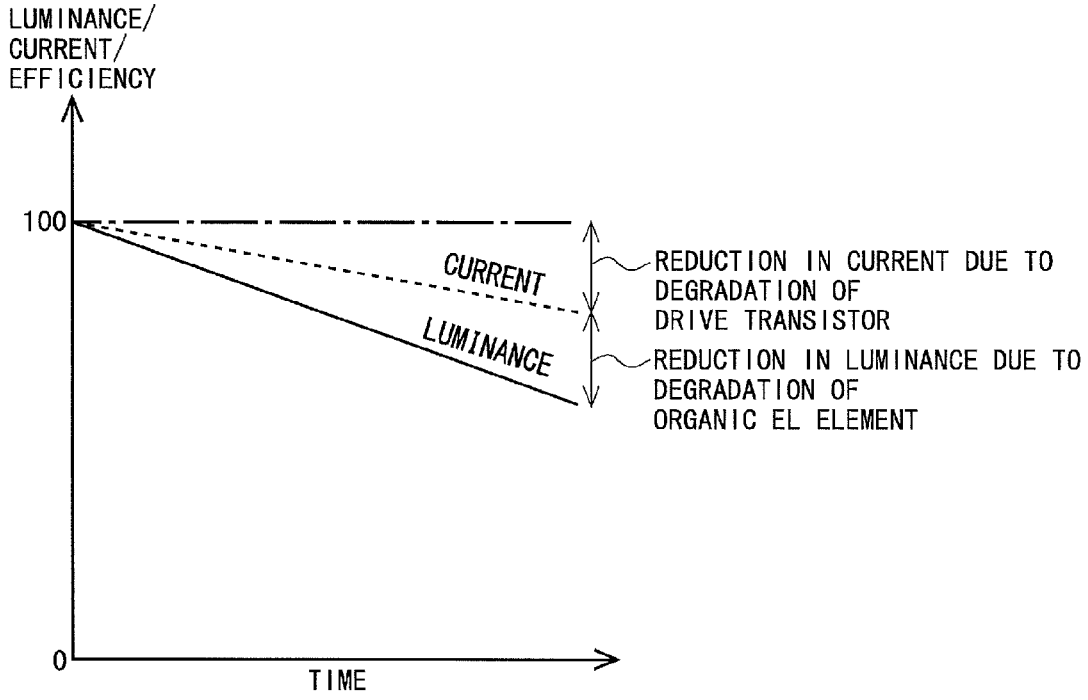
FIG. 34 is a diagram for describing a case in which no compensation is performed for degradation of a drive transistor and degradation of an organic EL element.
Figure 35:
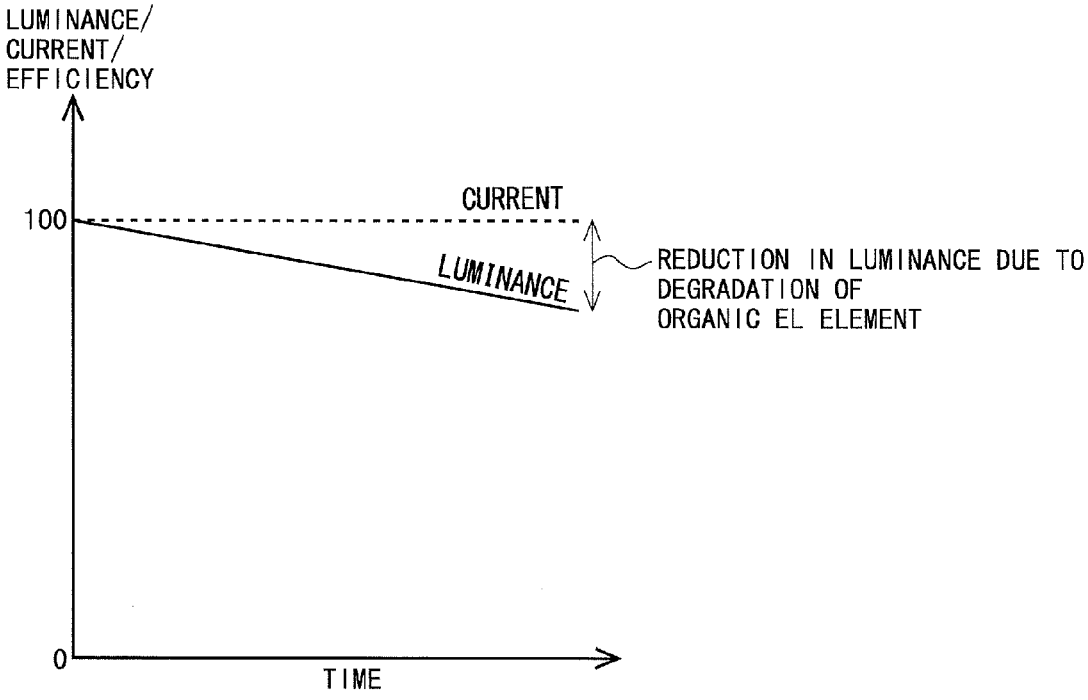
FIG. 35 is a diagram for describing a case in which compensation is performed only for degradation of a drive transistor.
Figure 36:
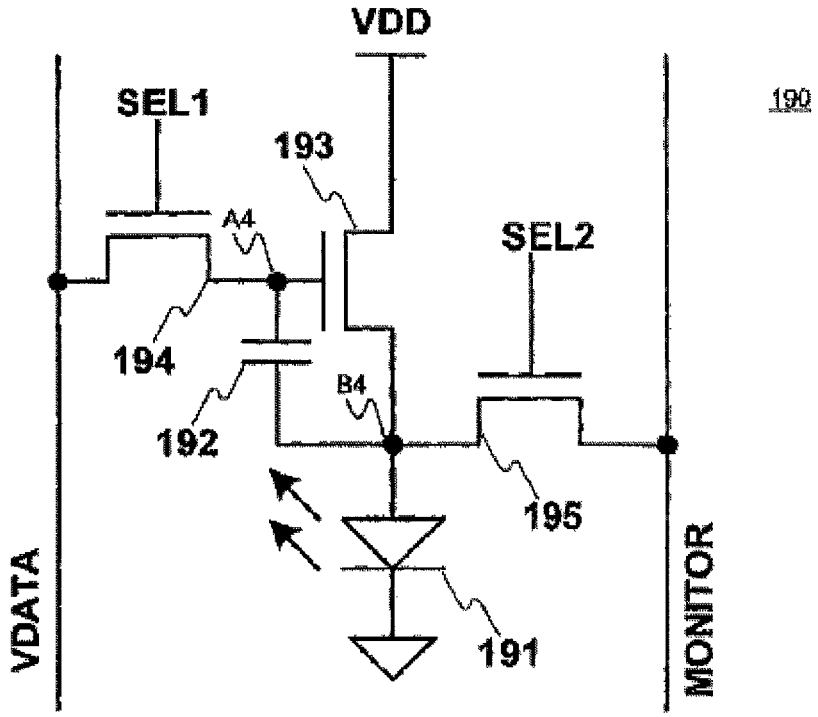
FIG. 36 is FIG. 14 of Published Japanese Translation of PCT Application No. 2008-523448.

Meanwhile, in the configuration shown in FIG. 32, the capacitor Cst is provided between the gate and source of the transistor T2. On the other hand, in the present embodiment, the capacitor Cst is provided between the gate and drain of the transistor T2. The reason therefor is as follows. Specifically, in the present embodiment, during one frame period, control is performed to change the potential of the data signal line S(j), with the transistor T3 being in an on state. If the capacitor Cst is provided between the gate and source of the transistor T2, the gate potential of the transistor T2 also changes according to the change in the potential of the data signal line S(j). This may result in the on/off state of the transistor T2 not going into a desired state. Hence, in the present embodiment, in order that the gate potential of the transistor T2 does not change according to the change in the potential of the data signal line S(j), the capacitor Cst is provided between the gate and drain of the transistor T2 as shown in FIG. 1.

<2.2 Regarding Transistors in Pixel Circuit>

In the present embodiment, all of the transistors T1 to T3 in the pixel circuit 11 are of the n-channel type. Moreover, in the present embodiment, for the transistors T1 to T3, oxide TFTs (thin film transistors using an oxide semiconductor for channel layers) are adopted.

A description is made below of an oxide semiconductor layer included in each of the oxide TFTs. The oxide semiconductor layer is, for example, an In—Ga—Zn—O-based semiconductor layer. The oxide semiconductor layer contains, for example, an In—Ga—Zn—O-based semiconductor. The In—Ga—Zn—O-based semiconductor is a ternary oxide of In (indium), Ga (gallium) and Zn (zinc). A ratio (composition ratio) of In, Ga and Zn is not particularly limited. For example, the composition ratio may be In:Ga:Zn=2:2:1, In:Ga:Zn=1:1:1, In:Ga:Zn=1:1:2, and the like.

Such a TFT including the In—Ga—Zn—O-based semiconductor layer has high mobility (mobility exceeding 20 times that of an amorphous silicon TFT) and a low leak current (leak current of less than 1/100 of that of the amorphous silicon TFT. Accordingly, this TFT is suitably used as a drive TFT (the above-described transistor T2) in the pixel circuit and a switching TFT (the above-described transistor T1) therein. When the TFT including the In—Ga—Zn—O-based semiconductor layer is used, electric power consumption of the display device can be reduced to a great extent.

The In—Ga—Zn—O-based semiconductor may be amorphous, or may include a crystalline portion and have crystallinity. As the crystalline In—Ga—Zn—O-based semiconductor, a crystalline In—Ga—Zn—O-based semiconductor, in which a c-axis is oriented substantially perpendicularly to a layer surface, is preferable. A crystal structure of the In—Ga—Zn—O-based semiconductor as described above is disclosed, for example, in Japanese Patent Application Laid-Open No. 2012-134475.

The oxide semiconductor layer may contain other oxide semiconductors in place of the In—Ga—Zn—O-based semiconductor. For example, the oxide semiconductor layer may contain a Zn—O-based semiconductor (ZnO), an In—Zn—O-based semiconductor (IZO (registered trademark)), a Zn—Ti—O-based oxide semiconductor (ZTO), a Cd—Ge—O-based semiconductor, a Cd—Pb—O-based semiconductor, a CdO (cadmium oxide), a Mg—Zn—O-based semiconductor, an In—Sn—O-based semiconductor (for example, $In_2O_3$—$SnO_2$—ZnO), an In—Ga—Sn—O-based semiconductor and the like.

<2.3 Output and Current-monitoring Circuit>

With reference to FIG. 1, the configuration and operation of the output and current-monitoring circuit 330 of the present embodiment will be described in detail. The output and current-monitoring circuit 330 includes an operational amplifier 331, a capacitor 332, and three switches (switches 333, 334, and 335).

As shown in FIG. 1, an internal data line Sin(j) of the output and current-monitoring circuit 330 is connected to the data signal line S(j) through the switch 334. The operational amplifier 331 has an inverting input terminal connected to the internal data line Sin(j), and a non-inverting input terminal to which an analog voltage Vs serving as a data signal DA is provided. The capacitor 332 and the switch 333 are provided between an output terminal of the operational amplifier 331 and the internal data line Sin(j). A control clock signal CLK1 is provided to the switch 333. An integrating circuit is configured by the operational amplifier 331, the capacitor 332, and the switch 333. Now, the operation of the integrating circuit will be described. When the switch 333 is switched from an off state to an on state by the control clock signal CLK1, charge accumulated in the capacitor 332 is discharged. When the switch 333 is switched from the on state to the off state thereafter, charging of the capacitor 332 is performed based on a current flowing through the internal data line Sin(j). That is, a time-integrated value of the current flowing through the internal data line Sin(j) is accumulated in the capacitor 332. By this, the potential of the output terminal of the operational amplifier 331 changes according to the magnitude of the current flowing through the internal data line Sin(j). An output from the operational amplifier 331 is transmitted as monitored data MO to the signal conversion circuit 32. Note that when the switch 333 is brought into an on state by the control clock signal CLK1, a short-circuit state occurs between the output terminal and inverting input terminal of the operational amplifier 331. By this, the potentials of the output terminal of the operational amplifier 331 and the internal data line Sin(j) become equal to the potential of the analog voltage Vs.

The switch 334 is provided between the data signal line S(j) and the internal data line Sin(j). A control clock signal CLK2 is provided to the switch 334. By switching the state of the switch 334 based on the control clock signal CLK2, an electrical connection state between the data signal line S(j) and the internal data line Sin(j) is controlled. In the present embodiment, when the control clock signal CLK2 is at a high level, the data signal line S(j) and the internal data line Sin(j) go into an electrically connected state, and when the control clock signal CLK2 is at a low level, the data signal line S(j) and the internal data line Sin(j) go into an electrically disconnected state.

The switch 335 is provided between the data signal line S(j) and a predetermined control line CL. A control clock signal CLK2B is provided to the switch 335. By switching the state of the switch 335 based on the control clock signal CLK2B, an electrical connection state between the data signal line S(j) and the control line CL is controlled. In the present embodiment, when the control clock signal CLK2B is at a high level, the data signal line S(j) and the control line CL go into an electrically connected state, and when the control clock signal CLK2B is at a low level, the data signal line S(j) and the control line CL go into an electrically disconnected state.

As described above, when the switch 334 goes into an off state, the data signal line S(j) and the internal data line Sin(j) go into an electrically disconnected state. At this time, if the switch 333 is in an off state, then the potential of the internal data line Sin(j) is maintained. In the present embodiment, with the potential of the internal data line Sin(j) maintained in this manner, AD conversion by the A/D converter 324 in the signal conversion circuit 32 is performed.

Note that in the present embodiment a first control switch is implemented by the switch 333, a second control switch is implemented by the switch 334, and a third control switch is implemented by the switch 335. Note also that a second capacitor is implemented by the capacitor 332.

<2.4 Signal Conversion Circuit>

With reference to FIG. 1, the configuration and operation of the signal conversion circuit 32 in the present embodiment will be described in detail. The signal conversion circuit 32 includes a D/A converter 321, a selector 322, an offset circuit 323, and the A/D converter 324. The D/A converter 321 converts a data signal DA which is a digital signal outputted from the drive signal generating circuit 31, into an analog voltage Vs. In the present embodiment, the A/D converter 324 is shared between a plurality of columns. To implement this, the selector 322 is provided in the signal conversion circuit 32. To the selector 322 is provided monitored data MO from a plurality of output and current-monitoring circuits 330. The selector 322 sequentially outputs the provided plurality of pieces of monitored data MO in a time-division manner. The offset circuit 323 has a function of setting the same input level to the A/D converter 324 between when a TFT characteristic is detected and when an OLED characteristic is detected (offset adjustment function). The reason that the offset circuit 323 is provided is that Vm_TFT which is a reference potential for when a TFT characteristic is detected and Vm_oled which is a reference potential for when an OLED characteristic is detected are different potentials. The A/D converter 324 converts an analog voltage outputted from the offset circuit 323 into a digital signal. Note that an offset value used for offset adjustment may be allowed to depend on the value of Vm_TFT and the value of Vm_oled. By the above, for the components in the signal conversion circuit 32, one D/A converter 321 is provided for each column, and one selector 322, one offset circuit 323, and one A/D converter 324 are provided for a plurality of columns.

Figure 7:
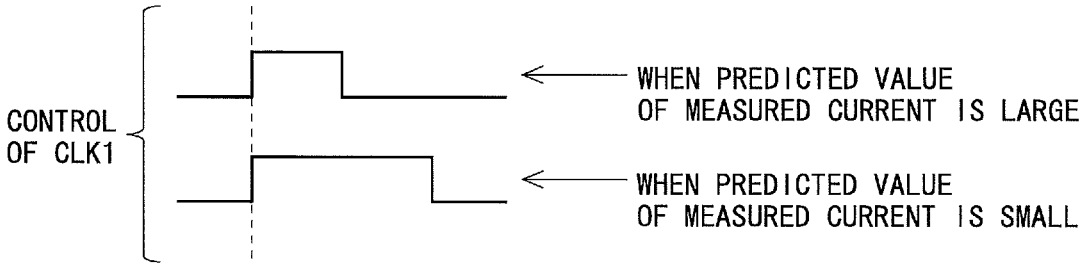
FIG. 7 is a diagram for describing adjustment of the length of integral time by control of a control clock signal CLK1 in the embodiment.

Now, a more detailed description will be made of an influence exerted on AD conversion due to the fact that Vm_TFT and Vm_oled have different magnitudes, and how to deal with the influence. Since Vm_TFT and Vm_oled are potentials of different magnitudes, if the offset circuit 323 is not provided, then an input DC level to the A/D converter 324 changes between when a TFT characteristic is detected and when an OLED characteristic is detected. Due to this, the resolution of AD conversion by the A/D converter 324 is wasted (not effectively used). Hence, in the present embodiment, the above-described offset circuit 323 is provided. The offset circuit 323 adjusts the input DC level to the A/D converter 324 by Voffset1 when a TFT characteristic is detected and by Voffset2 when an OLED characteristic is detected. By this, it becomes possible to make the DC level for AD conversion performed by the A/D converter 324 substantially constant, and thus, the resolution of AD conversion is effectively used. Note that although here a description is made of an example case in which there are two types of offset levels, the present invention is not limited thereto. For example, when the value of Vm_oled is different between R, G, and B, the configuration may be such that three types of offset levels are prepared for when an OLED characteristic is detected, and the offset levels are used in a switching manner. In addition, depending on a current measurement condition, a predicted value of a measured current may be large at one time and small at another time. In this regard, by controlling the control clock signal CLK1 provided to the switch 333 in a manner shown in, for example, FIG. 7 to change the length of integral time (the off time of the control clock signal CLK1), too, it becomes possible to effectively use the resolution of AD conversion by the A/D converter 324. By this, even when a measured current is small, it becomes possible to ensure a sufficient S/N ratio.

<2.5 Sharing of the A/D Converter>

Figure 8:
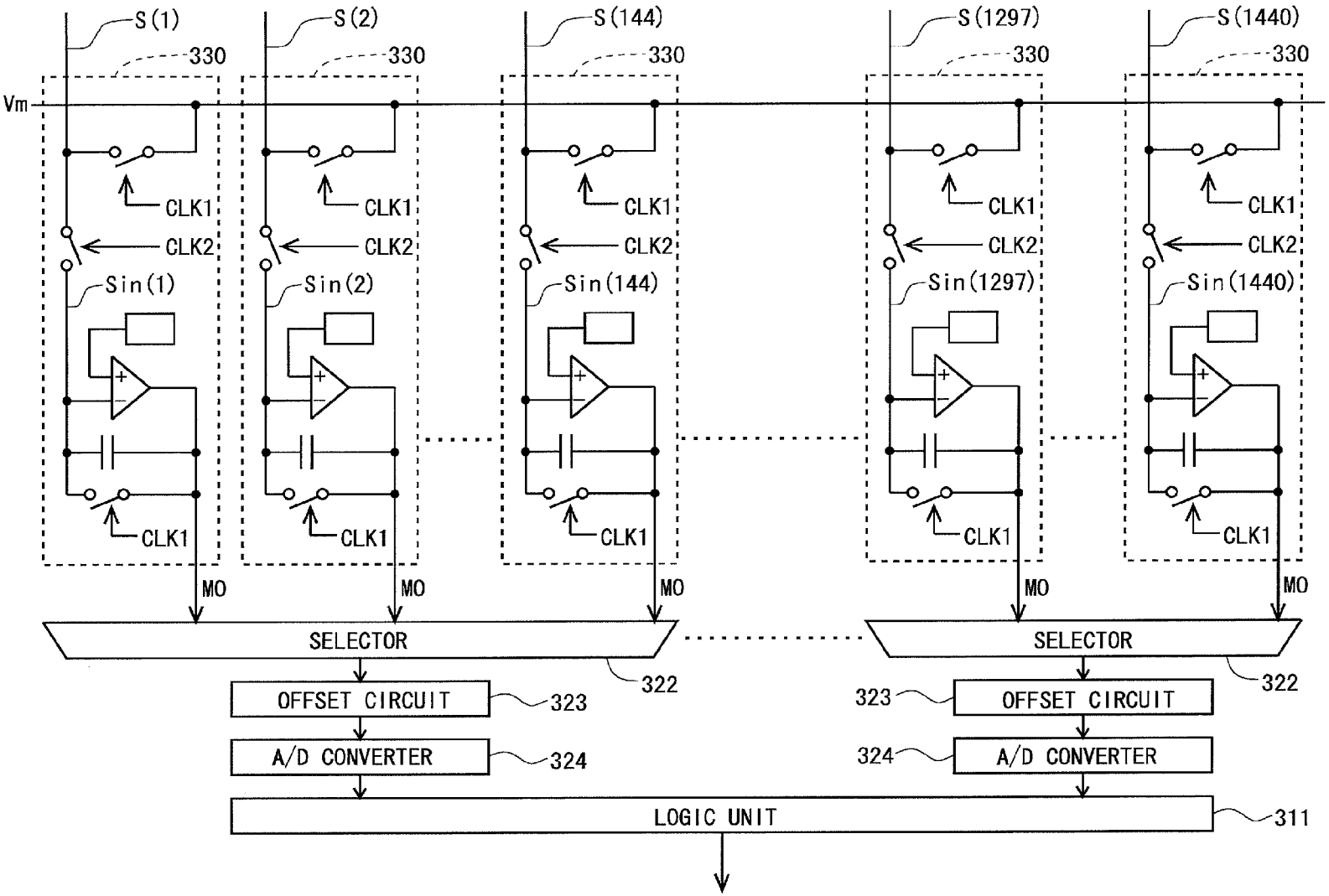
FIG. 8 is a diagram for describing sharing of A/D converts in the embodiment.

As described above, in the present embodiment, the A/D converter 324 is shared between a plurality of columns. This will be described in detail with reference to FIG. 8. Note that FIG. 8 shows an example of a case in which the source driver 30 has an output unit 33 with 1440 channels (i.e., a case in which 1440 data signal lines S are provided). In the example shown in FIG. 8, one A/D converter 324 is shared between 144 columns. Therefore, one selector 322 is provided for every 144 columns. To each selector 322 is provided monitored data MO from 144 output and current-monitoring circuits 330. Then, each selector 322 sequentially provides the 144 pieces of monitored data MO to an offset circuit 323 in a time-division manner. The pieces of monitored data MO provided to the offset circuit 323 are adjusted for their input levels and then provided to the A/D converter 324. Meanwhile, as described above, by the above-described sample and hold function, the output and current-monitoring circuit 330 holds the value of analog data throughout a period during which AD conversion is performed. By this, the values of analog data obtained at the same timing for all columns are sequentially provided to the A/D converter 324. Note that the AD-converted monitored data MO is transmitted to the control circuit 20 through a logic unit 311 in the drive signal generating circuit 31.

Although in the above-described example one A/D converter 324 is shared between 144 columns, the present invention is not limited thereto. The number of columns sharing one A/D converter 324 may be determined according to the ability of the A/D converter 324, i.e., the sampling frequency of the A/D converter 324. The number of columns sharing one A/D converter 324 can be increased as the sampling frequency of the A/D converter 324 increases.

<3. Drive Method>

<3.1 Summary>

Next, a drive method of the present embodiment will be described. As described above, in the present embodiment, detection of a TFT characteristic and an OLED characteristic for one row is performed in each frame. In each frame, operation (hereinafter, referred to as "characteristic detection operation") is performed to detect a TFT characteristic and an OLED characteristic for a monitored row, and normal operation is performed for a non-monitored row. Specifically, when a frame in which detection of a TFT characteristic and an OLED characteristic for the first row is performed is defined as a (k+1)th frame, operation for each row transitions as shown in FIG. 9. In addition, when detection of a TFT characteristic and an OLED characteristic is performed, an update to correction data in the correction data storage unit 50 is performed using results of the detection. Then, correction of the video signal is performed using the correction data stored in the correction data storage unit 50.

Figure 10:
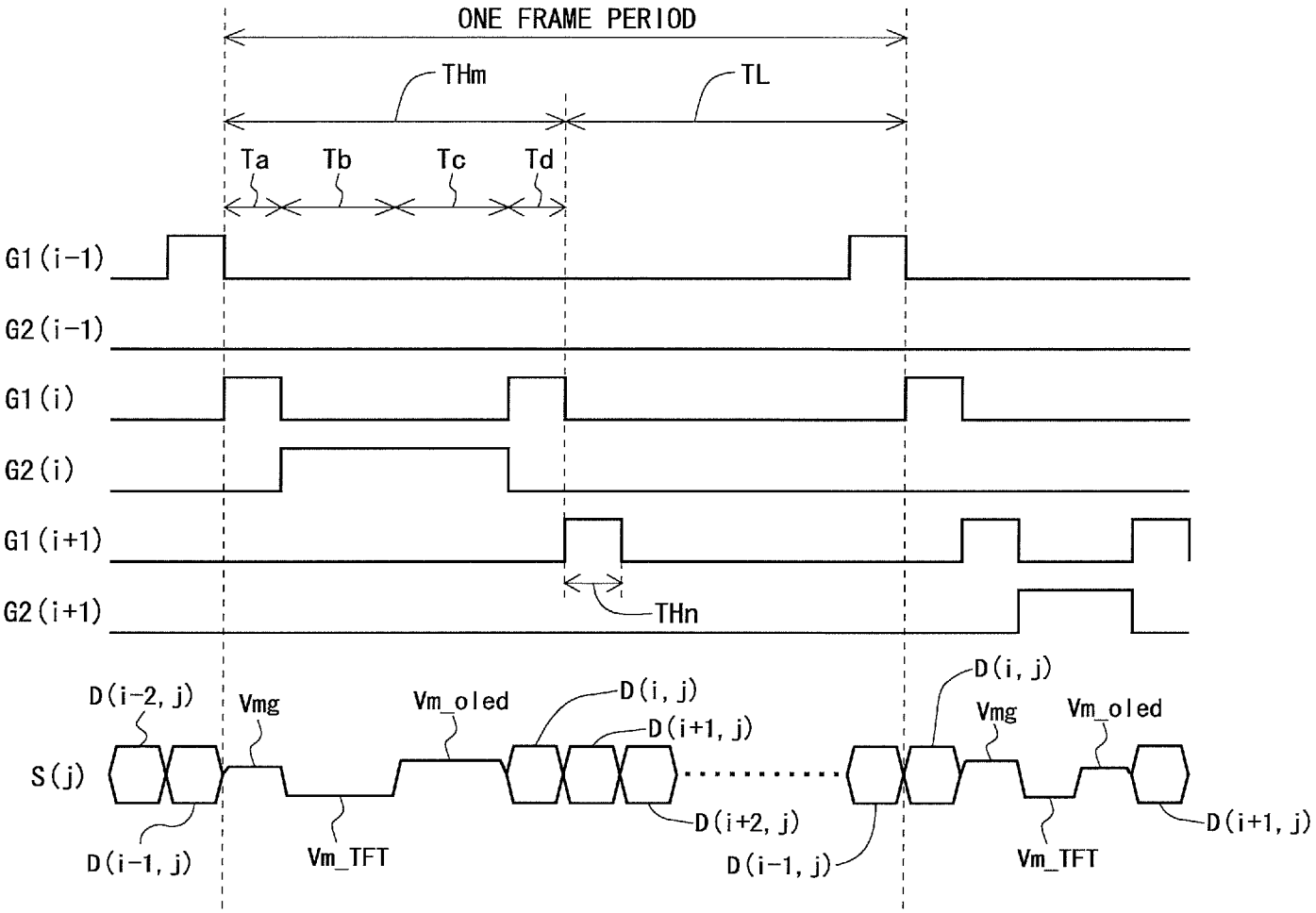
FIG. 10 is a timing chart for describing the operation of a pixel circuit (a pixel circuit at an ith row and a jth column) included in a monitored row in the embodiment.

FIG. 10 is a timing chart for describing the operation of a pixel circuit 11 (assumed to be a pixel circuit 11 at an ith row and a jth column) included in a monitored row. Note that in FIG. 10 "one frame period" is represented with reference to the first selection period start time point of the ith row in a frame in which the ith row is a monitored row. Note also that here a period included in one frame period other than one horizontal scanning period THm for a monitored row is referred to as "light emission period". The light emission period is denoted by reference character TL. As shown in FIG. 10, one horizontal scanning period THm for the monitored row includes a period Ta during which preparation for detecting a TFT characteristic and an OLED characteristic is performed in the monitored row (hereinafter, referred to as "detection preparation period"); a period Tb during which current measurement for detecting a TFT characteristic is performed (hereinafter, referred to as "TFT characteristic detection period"); a period Tc during which current measurement for detecting an OLED characteristic is performed (hereinafter, referred to as "OLED characteristic detection period"); and a period Td during which preparation for allowing an organic EL element OLED to emit light is performed in the monitored row (hereinafter, referred to as "light emission preparation period"). Note that in the present embodiment a current measurement period is implemented by the TFT characteristic detection period Tb and the OLED characteristic detection period Tc.

During the detection preparation period Ta, the scanning line G1(*i*) is brought into an active state, the monitoring control line G2(*i*) is brought into a non-active state, and a potential Vmg is provided to the data signal line S(j). During the TFT characteristic detection period Tb, the scanning line G1(*i*) is brought into a non-active state, the monitoring control line G2(*i*) is brought into an active state, and a potential Vm_TFT is provided to the data signal line S(j). During the OLED characteristic detection period Tc, the scanning line G1(*i*) is brought into a non-active state, the monitoring control line G2(*i*) is brought into an active state, and a potential Vm_oled is provided to the data signal line S(j). During the light emission preparation period Td, the scanning line G1(*i*) is brought into an active state, the monitoring control line G2(*i*) is brought into a non-active state, and a data potential D(i,j) according to a target luminance of the organic EL element OLED included in the monitored row is provided to the data signal line S(j). During the light emission period TL, the scanning line G1(*i*) and the monitoring control line G2(*i*) are brought into a non-active state. In addition, during the TFT characteristic detection period Tb, the potential Vm_TFT is provided to the control line CL, for example, from a power supply circuit, and during the OLED characteristic detection period Tc, the potential Vm_oled is provided to the control line CL, for example, from the power supply circuit. Note that a detailed description of the potential Vmg, the potential Vm_TFT, and the potential Vm_oled will be made later.

<3.2 Operation of the Pixel Circuit>

<3.2.1 Normal Operation>

Figure 11:
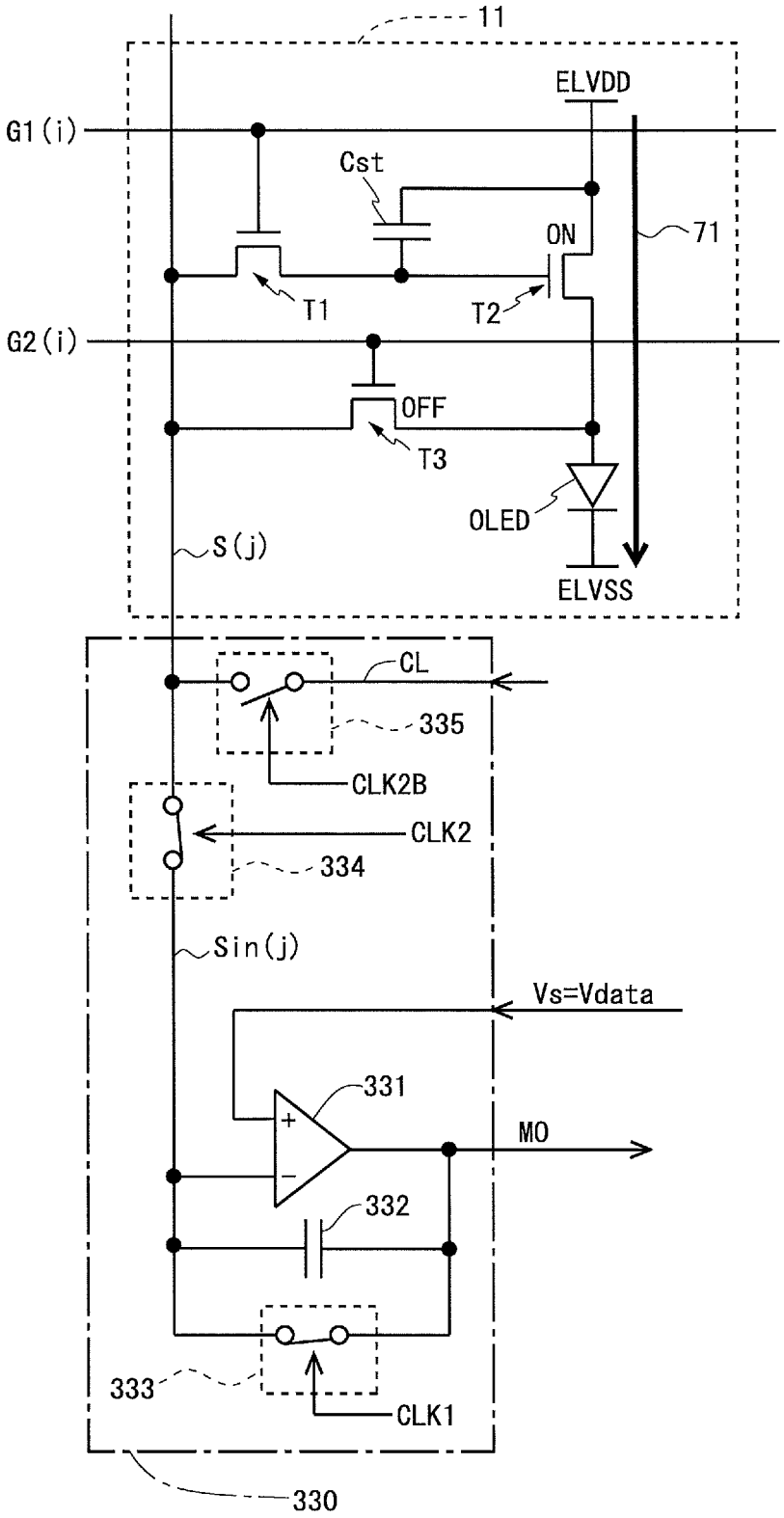
FIG. 11 is a diagram for describing the flow of a current for when normal operation is performed in the embodiment.

In each frame, for a non-monitored row, normal operation is performed. In the pixel circuit 11 included in the non-monitored row, writing based on a data potential Vdata corresponding to a target luminance is performed during a selection period, and then the transistor T1 is maintained in an off state. By the writing based on the data potential Vdata, the transistor T2 goes into an on state. The transistor T3 is maintained in an off state. By the above, a drive current is supplied to the organic EL element OLED through the transistor T2, as indicated by an arrow denoted by reference character 71 in FIG. 11. By this, the organic EL element OLED emits light at a luminance according to the drive current.

<3.2.2 Characteristic Detection Operation>

Figure 12:
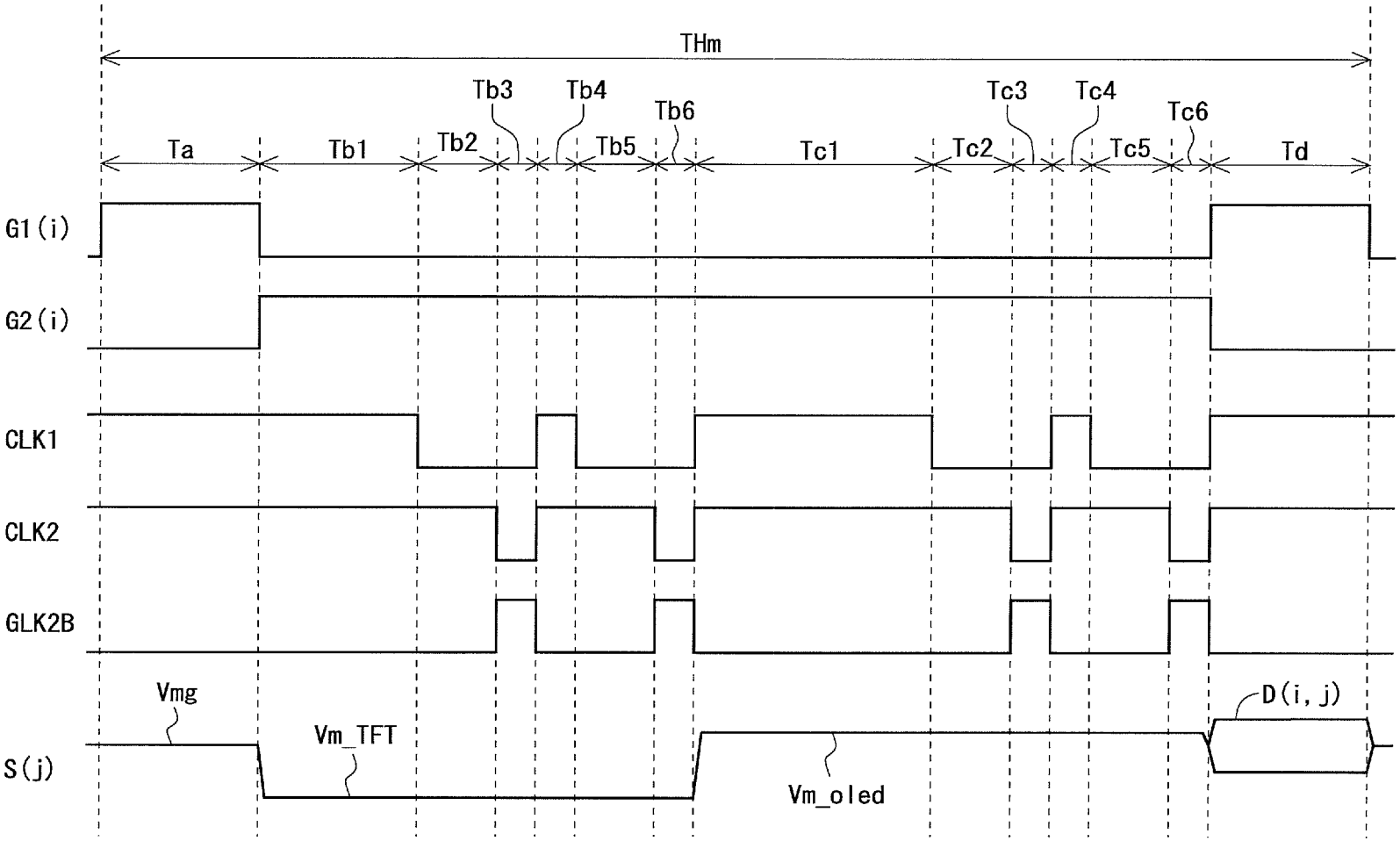
FIG. 12 is a timing chart for describing details of one horizontal scanning period for a monitored row in the embodiment.

In each frame, for a monitored row, characteristic detection operation is performed. FIG. 12 is a timing chart for describing details of one horizontal scanning period THm for a monitored row. Note that a characteristic detection processing period is implemented by the one horizontal scanning period THm. As shown in FIG. 12, in the present embodiment, a TFT characteristic detection period Tb is composed of periods Tb1 to Tb6, and an OLED characteristic detection period Tc is composed of periods Tc1 to Tc6. Note that in the present embodiment a data signal line charging period is implemented by the periods Tb1, Tb4, Tc1, and Tc4, a monitoring period is implemented by the periods Tb2, Tb5, Tc2, and Tc5, and an AD conversion period is implemented by the periods Tb3, Tb6, Tc3, and Tc6.

Figure 13:
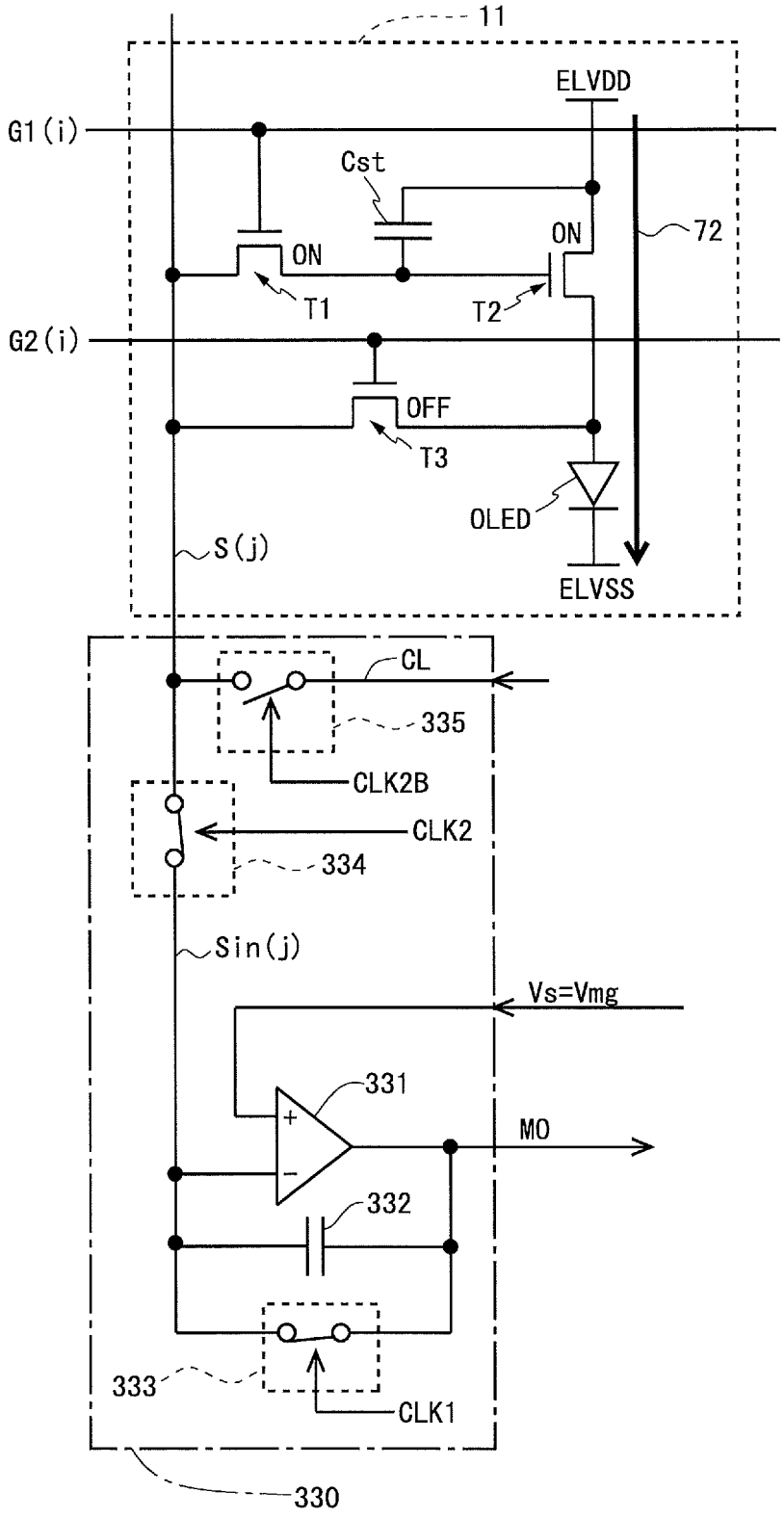
FIG. 13 is a diagram for describing the flow of a current during a detection preparation period in the embodiment.

During the detection preparation period Ta, the scanning line G1(*i*) is brought into an active state and the monitoring control line G2(*i*) is maintained in a non-active state. By this, the transistor T1 goes into an on state and the transistor T3 is maintained in an off state. In addition, during this period Ta, the control clock signals CLK1, CLK2, and CLK2B go to a high level, a high level, and a low level, respectively. Hence, the switches 333, 334, and 335 go into an on state, an on state, and an off state, respectively. In addition, during this period Ta, a potential Vmg is provided to the data signal line S(j) through the operational amplifier 331. By performing writing based on the potential Vmg, the capacitor Cst is charged and the transistor T2 goes into an on state. By the above, during the detection preparation period Ta, a drive current is supplied to the organic EL element OLED through the transistor T2, as indicated by an arrow denoted by reference character 72 in FIG. 13. By this, the organic EL element OLED emits light at a luminance according to the drive current. Note, however, that the organic EL element OLED emits light for only a very short period of time.

When the period turns to the period Tb1 (data signal line charging period), the scanning line G1(*i*) is brought into a non-active state and the monitoring control line G2(*i*) is brought into an active state. By this, the transistor T1 goes into an off state and the transistor T3 goes into an on state. Note that throughout the TFT characteristic detection period Tb, the transistor T1 is maintained in the off state and the transistor T3 is maintained in the on state. In addition, when the period turns to the period Tb1, a potential Vm_TFT is provided to the data signal line S(j) through the operational amplifier 331. By the above, during the period Tb1, charging is performed such that the potential of the data signal line S(j) becomes Vm_TFT. Note that, as will be described later, during the period Tc1 included in the OLED characteristic detection period Tc, charging is performed such that the potential of the data signal line S(j) becomes Vm_oled.

When the period turns to the period Tb2 (monitoring period), the control clock signal CLK1 changes from the high level to a low level. By this, the switch 333 goes into an off state. Here, when a threshold voltage of the transistor T2 which is obtained based on an offset value stored in the TFT offset memory 51*a* is Vth(T2), the value of the potential Vmg, the value of the potential Vm_TFT, and the value of the potential Vm_oled are set such that the following expressions (1) and (2) hold true.

$$Vm_TFT+Vth(T2)<Vmg \quad (1)$$

$$Vmg<Vm_oled+Vth(T2) \quad (2)$$

In addition, when a light emission threshold voltage of the organic EL element OLED which is obtained based on an offset value stored in the OLED offset memory 51*b* is Vth(oled), the value of the potential Vm_TFT is set such that the following expression (3) holds true.

$$Vm_TFT<ELVSS+Vth(oled) \quad (3)$$

Furthermore, when a breakdown voltage of the organic EL element OLED is Vbr(oled), the value of the potential Vm_TFT is set such that the following expression (4) holds true.

$$Vm_TFT>ELVSS-Vbr(oled) \quad (4)$$

As described above, after performing writing based on the potential Vmg that satisfies the above expressions (1) and (2) during the detection preparation period Ta, the potential Vm_TFT that satisfies the above expressions (1), (3), and (4) is provided to the data signal line S(j) during the periods Tb1 to Tb2. By the above expression (1), during the period Tb2, the transistor T2 goes into an on state. In addition, by the above expressions (3) and (4), during the period Tb2, a current does not flow through the organic EL element OLED.

Figure 14:
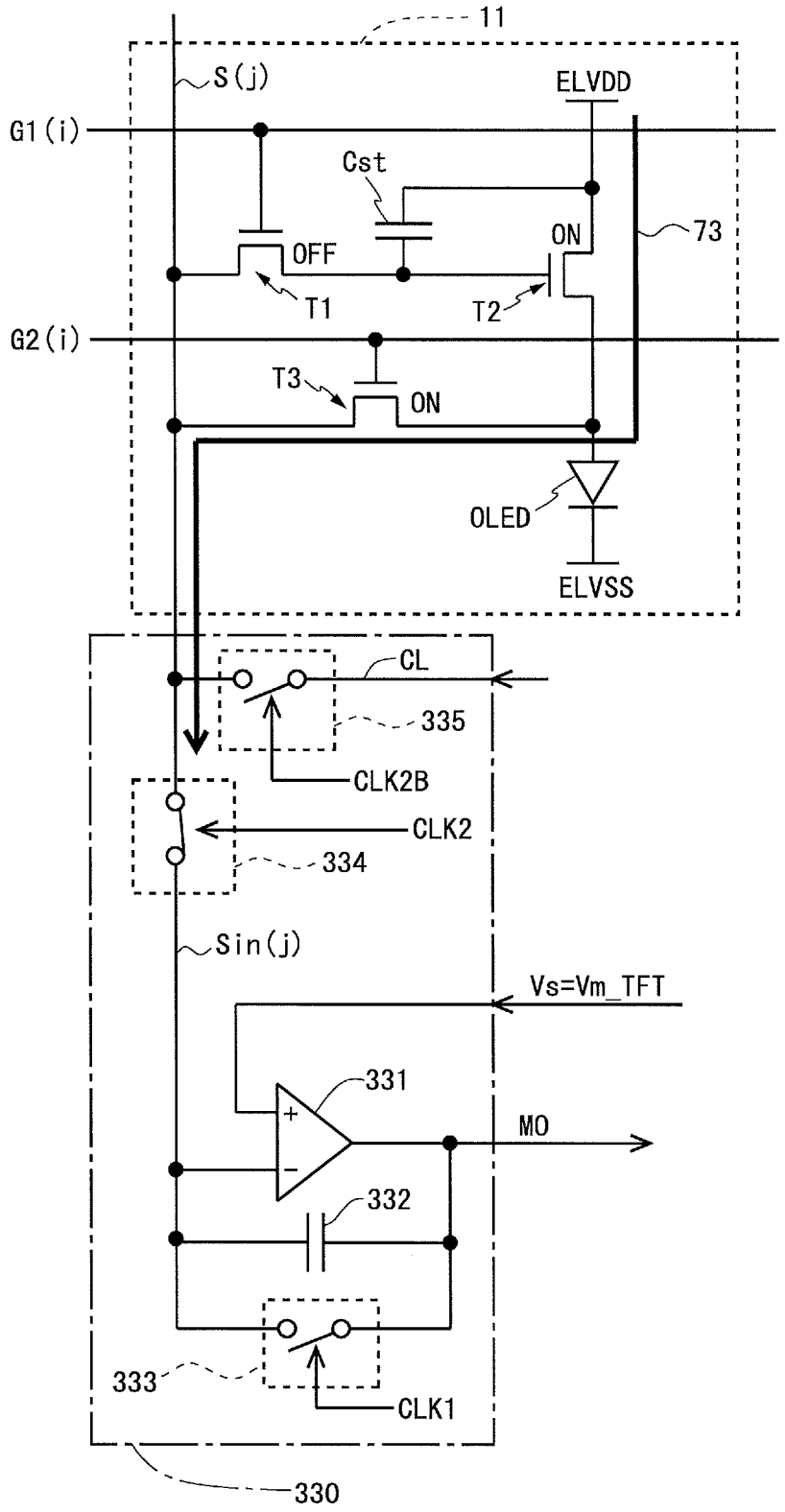
FIG. 14 is a diagram for describing the flow of a current during a period Tb2 included in a TFT characteristic detection period in the embodiment.

By the above, during the period Tb2, a current flowing through the transistor T2 is outputted to the data signal line S(j) through the transistor T3, as indicated by an arrow denoted by reference character 73 in FIG. 14. In addition, during the period Tb2, the switch 334 is in an on state. By this, charge is accumulated in the capacitor 332 according to the magnitude (time-integrated value) of the current (sink current) outputted to the data signal line S(j) during the period Tb2, and the potential of the output terminal of the operational amplifier 331 changes.

Figure 15:
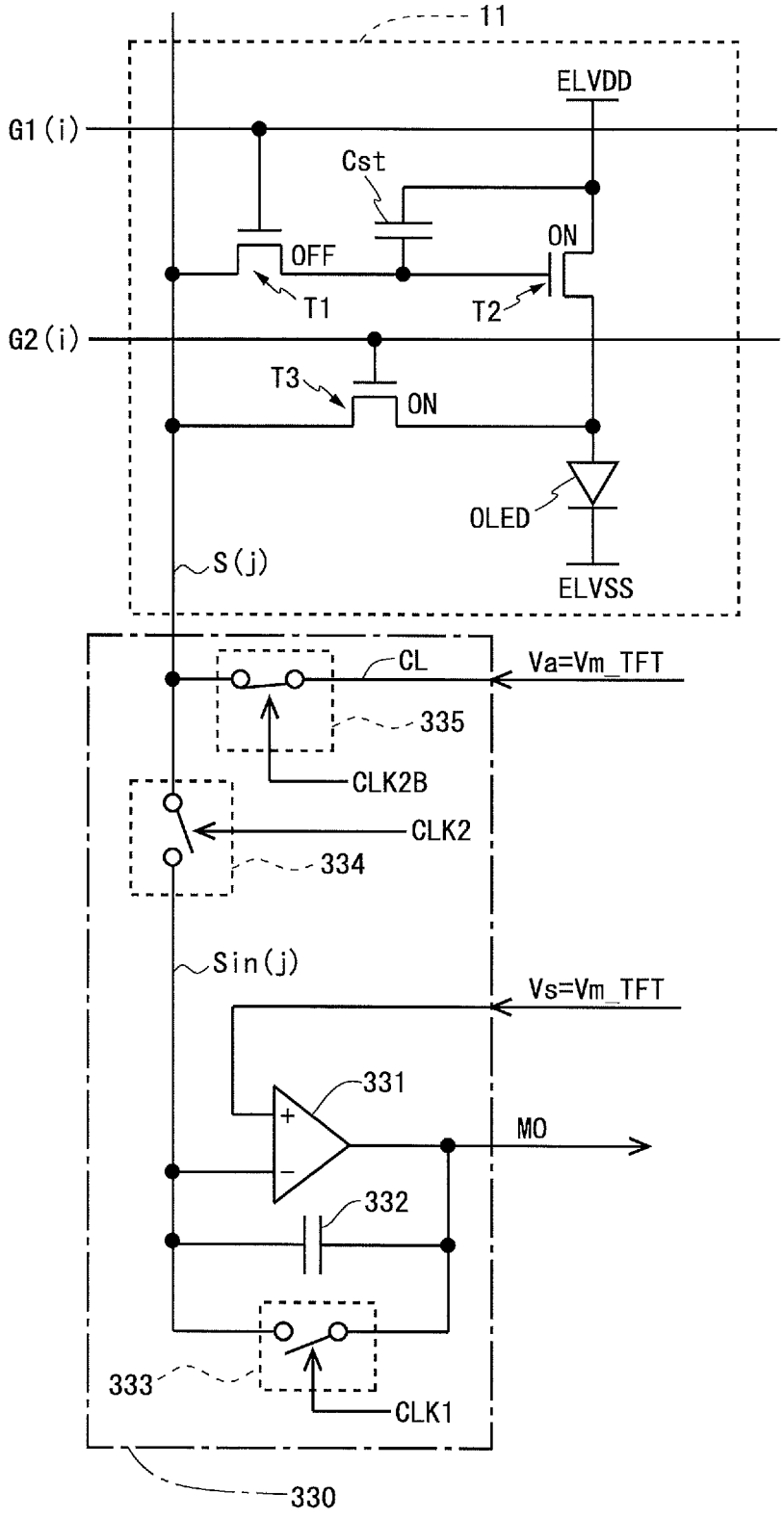
FIG. 15 is a diagram for describing a state of a circuit during a period Tb3 included in the TFT characteristic detection period in the embodiment.

When the period turns to the period Tb3 (AD conversion period), the control clock signal CLK2 changes from the high level to the low level. By this, as shown in FIG. 15, the switch 334 goes into an off state, and the data signal line S(j) and the internal data line Sin(j) go into an electrically disconnected state. As a result, analog data representing the magnitude of the current on the data signal line S(j) at an end time point of the period Tb2 is held in the output and current-monitoring circuit 330. In such a state, the selector 322 sequentially outputs analog data (monitored data MO) of a plurality of columns, by which each A/D converter 324 sequentially performs AD conversion on the analog data of a plurality of columns.

In addition, during the period Tb3, the control clock signal CLK2B changes from the low level to the high level. By this, as shown in FIG. 15, the switch 335 goes into an on state and the data signal line S(j) and the control line CL go into an electrically connected state. As a result, during the period Tb3, charging is performed such that the potential of the data signal line S(j) becomes Vm_TFT. In this manner, charging of the data signal line S(j) is performed through the control line CL during a period during which AD conversion is performed.

When the period turns to the period Tb4 (data signal line charging period), the control clock signal CLK1 changes from the low level to the high level, the control clock signal CLK2 changes from the low level to the high level, and the control clock signal CLK2B changes from the high level to the low level. By this, the switches 333, 334, and 335 go into an on state, an on state, and an off state, respectively. In this manner, the switch 333 and the switch 334 go into an on state, and the potential Vm_TFT is provided to the data signal line S(j) through the operational amplifier 331. By the above, during the period Tb4, recharging is performed such that the potential of the data signal line S(j) becomes Vm_TFT. Meanwhile, as described above, during the period Tb3, charging of the data signal line S(j) is performed through the control line CL. Hence, the period Tb4 may be a period of very short length.

During the period Tb5 (monitoring period), the same operation as that for the period Tb2 is performed. During the period Tb6 (AD conversion period), the same operation as that for the period Tb3 is performed. In the above-described manner, with the voltage between the gate and source of the transistor T2 set to a predetermined magnitude (Vmg−Vm_TFT), the magnitude of a current flowing between the drain and source of the transistor T2 is repeatedly measured, by which a TFT characteristic is detected.

When the period turns to the period Tc1 (data signal line charging period), the control clock signal CLK1 changes from the low level to the high level, the control clock signal CLK2 changes from the low level to the high level, and the control clock signal CLK2B changes from the high level to the low level. By this, the switches 333, 334, and 335 go into an on state, an on state, and an off state, respectively. In addition, in the present embodiment, as with the TFT characteristic detection period Tb, throughout the OLED characteristic detection period Tc, the transistor T1 is maintained in the off state and the transistor T3 is maintained in the on state. In addition, when the period turns to the period Tc1, a potential Vm_oled is provided to the data signal line S(j) through the operational amplifier 331. By the above, during the period Tc1, charging is performed such that the potential of the data signal line S(j) becomes Vm_oled.

When the period turns to the period Tc2 (monitoring period), the control clock signal CLK1 changes from the high level to the low level. By this, the switch 333 goes into an off state. Here, the value of the potential Vm_oled is set such that the above expression (2) and the following expression (5) hold true.

$$ELVSS+Vth(oled)<Vm_oled \quad (5)$$

In addition, when a breakdown voltage of the transistor T2 is Vbr(T2), the value of the potential Vm_oled is set such that the following expression (6) holds true.

$$Vm_oled<Vmg+Vbr(T2) \quad (6)$$

As described above, during the periods Tc1 to Tc2, the potential Vm_oled that satisfies the above expressions (2), (5), and (6) is provided to the data signal line S(j). By the above expressions (2) and (6), during the period Tc2, the transistor T2 goes into an off state. In addition, by the above expression (5), during the period Tc2, a current flows through the organic EL element OLED.

Figure 16:
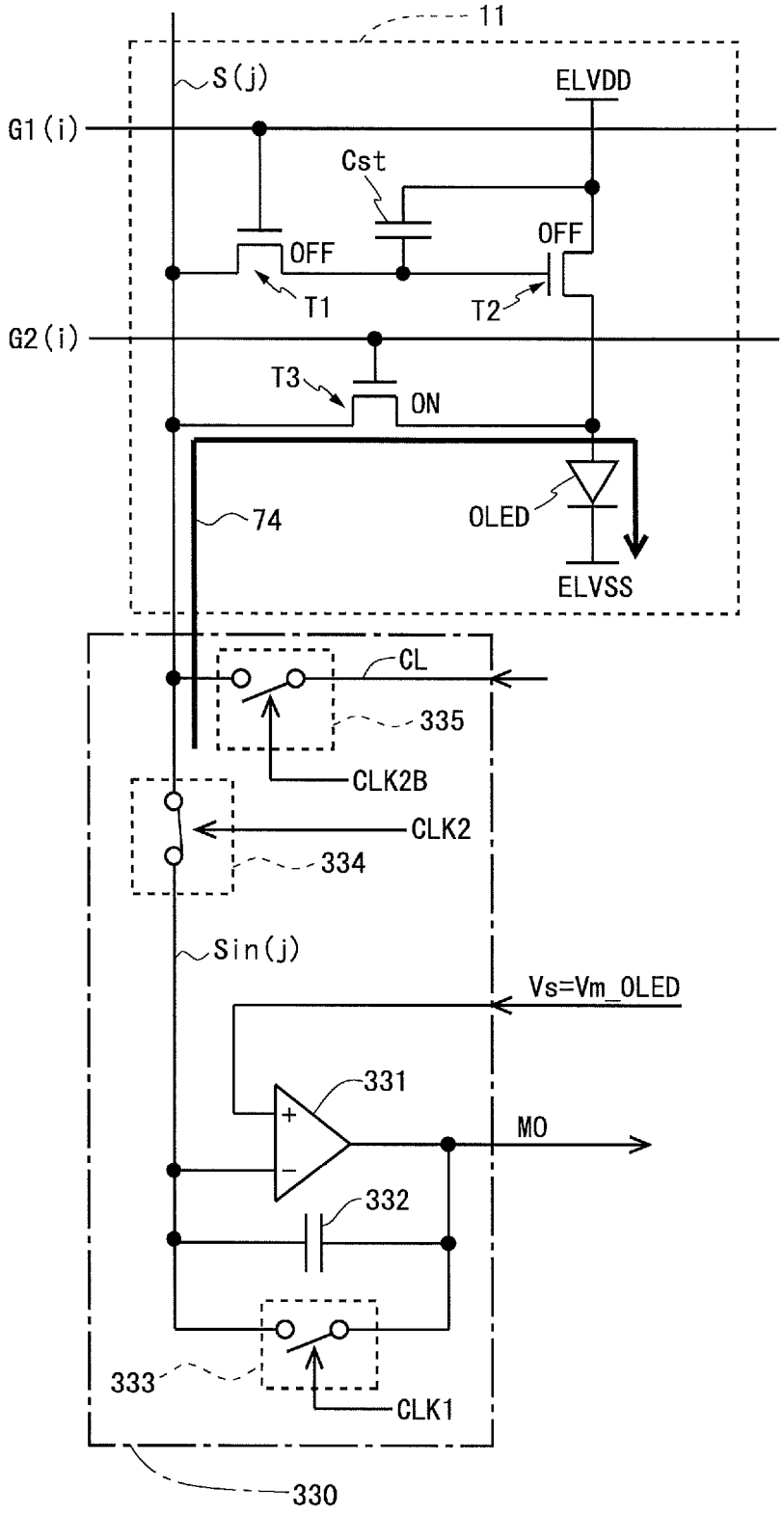
FIG. 16 is a diagram for describing the flow of a current during a period Tc2 included in an OLED characteristic detection period in the embodiment.

By the above, during the period Tc2, a current flows through the organic EL element OLED through the transistor T3 from the data signal line S(j), as indicated by an arrow denoted by reference character 74 in FIG. 16, and the organic EL element OLED emits light. Charge is accumulated in the capacitor 332 according to the magnitude (time-integrated value) of the current obtained at this time, and the potential of the output terminal of the operational amplifier 331 changes.

When the period turns to the period Tc3, the control clock signal CLK2 changes from the high level to the low level. By this, as with the period Tb3, the switch 334 goes into an off state, and the data signal line S(j) and the internal data line Sin(j) go into an electrically disconnected state. As a result, analog data representing the magnitude of the current on the data signal line S(j) at an end time point of the period Tc2 is held in the output and current-monitoring circuit 330. In such a state, the selector 322 sequentially outputs analog data (monitored data MO) of a plurality of columns, by which each A/D converter 324 sequentially performs AD conversion on the analog data of a plurality of columns.

In addition, during the period Tc3 (AD conversion period), the control clock signal CLK2B changes from the low level to the high level. By this, as with the period Tb3, the switch 335 goes into an on state and the data signal line S(j) and the control line CL go into an electrically connected state. As a result, during the period Tc3, charging is performed such that the potential of the data signal line S(j) becomes Vm_oled. In this manner, charging of the data signal line S(j) is performed through the control line CL during a period during which AD conversion is performed.

When the period turns to the period Tc4 (data signal line charging period), the control clock signal CLK1 changes from the low level to the high level, the control clock signal CLK2 changes from the low level to the high level, and the control clock signal CLK2B changes from the high level to the low level. By this, the switches 333, 334, and 335 go into an on state, an on state, and an off state, respectively. In this manner, the switch 333 and the switch 334 go into an on state, and the potential Vm_oled is provided to the data signal line S(j) through the operational amplifier 331. By the above, during the period Tc4, recharging is performed such that the potential of the data signal line S(j) becomes Vm_oled. Meanwhile, as described above, during the period Tc3, charging of the data signal line S(j) is performed through the control line CL. Hence, the period Tc4 may be a period of very short length.

During the period Tc5 (monitoring period), the same operation as that for the period Tc2 is performed. During the period Tc6 (AD conversion period), the same operation as that for the period Tc3 is performed. In the above-described manner, the magnitude of a current flowing through the organic EL element OLED is repeatedly measured with the voltage between the anode and cathode of the organic EL element OLED set to a predetermined magnitude (Vm_oled−ELVSS), by which an OLED characteristic is detected.

Note that the value of the potential Vmg, the value of the potential Vm_TFT, and the value of the potential Vm_oled are determined taking also into account a current measurable range of the adopted output and current-monitoring circuit 330, etc., in addition to the above expressions (1) to (6).

Figure 17:
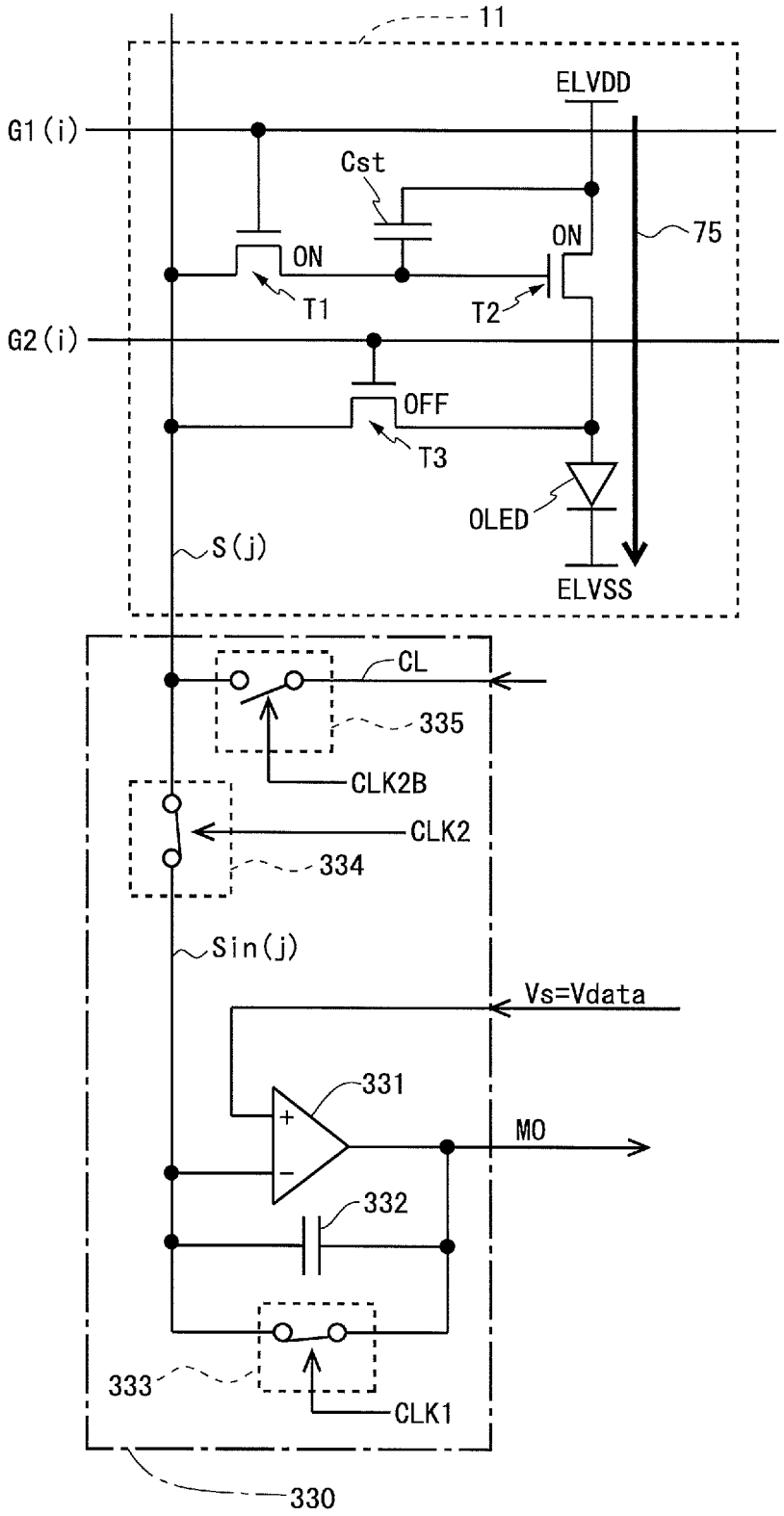
FIG. 17 is a diagram for describing the flow of a current during a light emission preparation period in the embodiment.

When the period turns to the light emission preparation period Td, the scanning line G1(*i*) is brought into an active state and the monitoring control line G2(*i*) is brought into a non-active state. By this, the transistor T1 goes into an on state and the transistor T3 goes into an off state. In addition, during the light emission preparation period Td, the control clock signal CLK1 changes from the low level to the high level, the control clock signal CLK2 changes from the low level to the high level, and the control clock signal CLK2B changes from the high level to the low level. By this, the switches 333, 334, and 335 go into an on state, an on state, and an off state, respectively. In addition, during the light emission preparation period Td, a data potential D(i,j) according to a target luminance is provided to the data signal line S(j) through the operational amplifier 331. By performing writing based on the data potential D(i,j), the capacitor Cst is charged and the transistor T2 goes into an on state. By the above, during the light emission preparation period Td, a drive current is supplied to the organic EL element OLED through the transistor T2, as indicated by an arrow denoted by reference character 75 in FIG. 17. By this, the organic EL element OLED emits light at a luminance according to the drive current.

Figure 18:
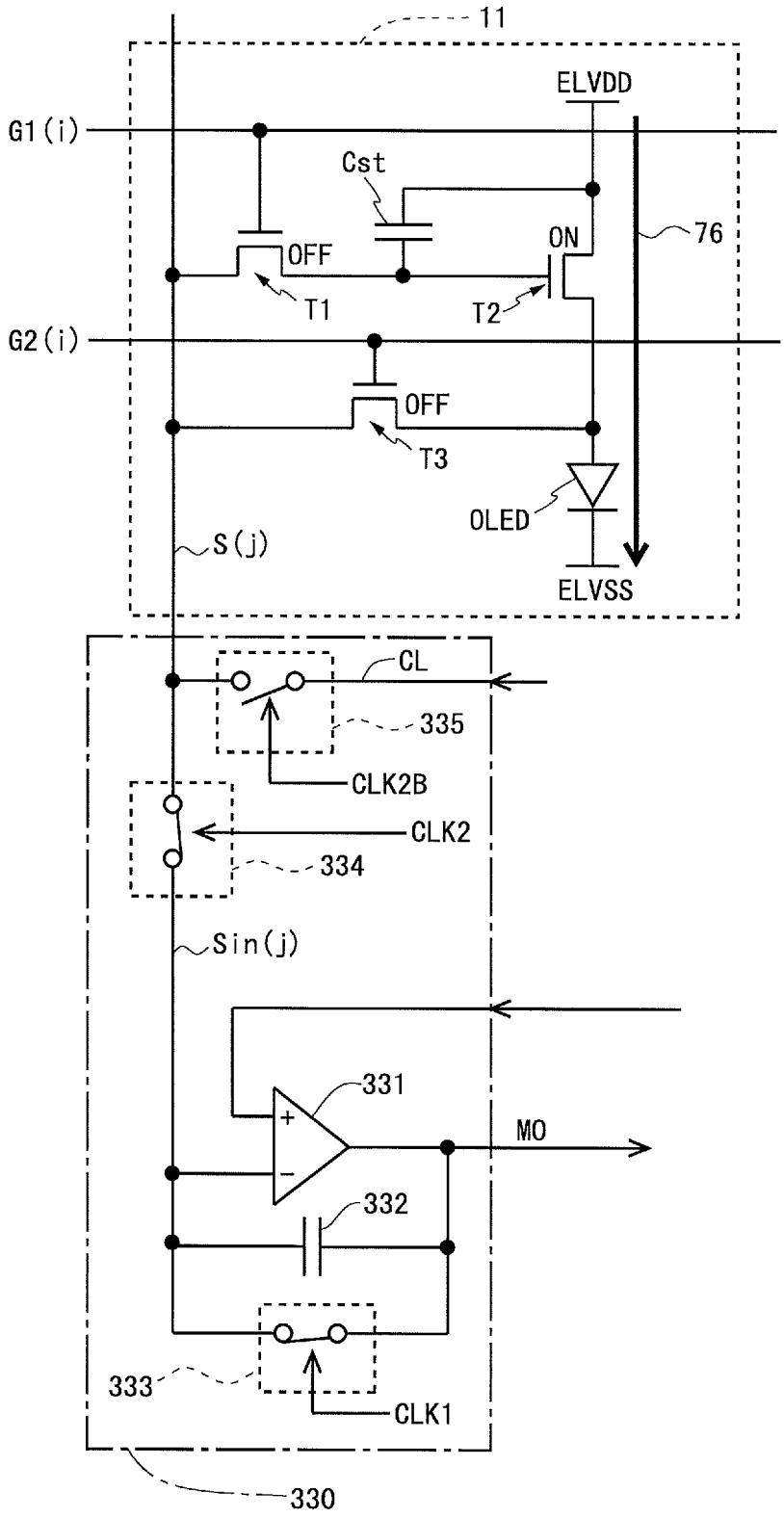
FIG. 18 is a diagram for describing the flow of a current during a light emission period in the embodiment.

During the light emission period TL (see FIG. 10), the scanning line G1(*i*) is brought into a non-active state and the monitoring control line G2(*i*) is maintained in the non-active state. By this, the transistor T1 goes into an off state and the transistor T3 is maintained in the off state. Although the transistor T1 goes into an off state, since the capacitor Cst is charged during the light emission preparation period Td by the writing based on the data potential D(i,j) according to the target luminance, the transistor T2 is maintained in the on state. Therefore, during the light emission period TL, a drive current is supplied to the organic EL element OLED through the transistor T2, as indicated by an arrow denoted by reference character 76 in FIG. 18. By this, the organic EL element OLED emits light at a luminance according to the drive current. That is, during the light emission period TL, the organic EL element OLED emits light according to the target luminance. Meanwhile, when the transistor T1 goes into an off state, ideally, the gate potential of the transistor T2 is held. However, in practice, due to second-order effects such as charge injection of the transistor T1, feedthrough of the scanning line G1(*i*), and charge distribution with a parasitic capacitance, the gate potential of the transistor T2 changes from the written potential. On the other hand, immediately before the TFT characteristic detection period Tb which precedes the light emission period TL, too, the transistor T1 goes into an off state and the gate of the transistor T2 goes into a hold state, and thus, the influences of the second-order effects during the TFT characteristic detection period Tb and during the light emission period TL become substantially equal to each other. Accordingly, even when the magnitude of the influence of the second-order effects varies between pixels (due to variations in parasitic capacitance value, etc.), detection of a TFT characteristic is performed taking into account the second-order effects and correction is performed. Thus, variations in second-order effects between pixels can be canceled out each other.

Figure 19:
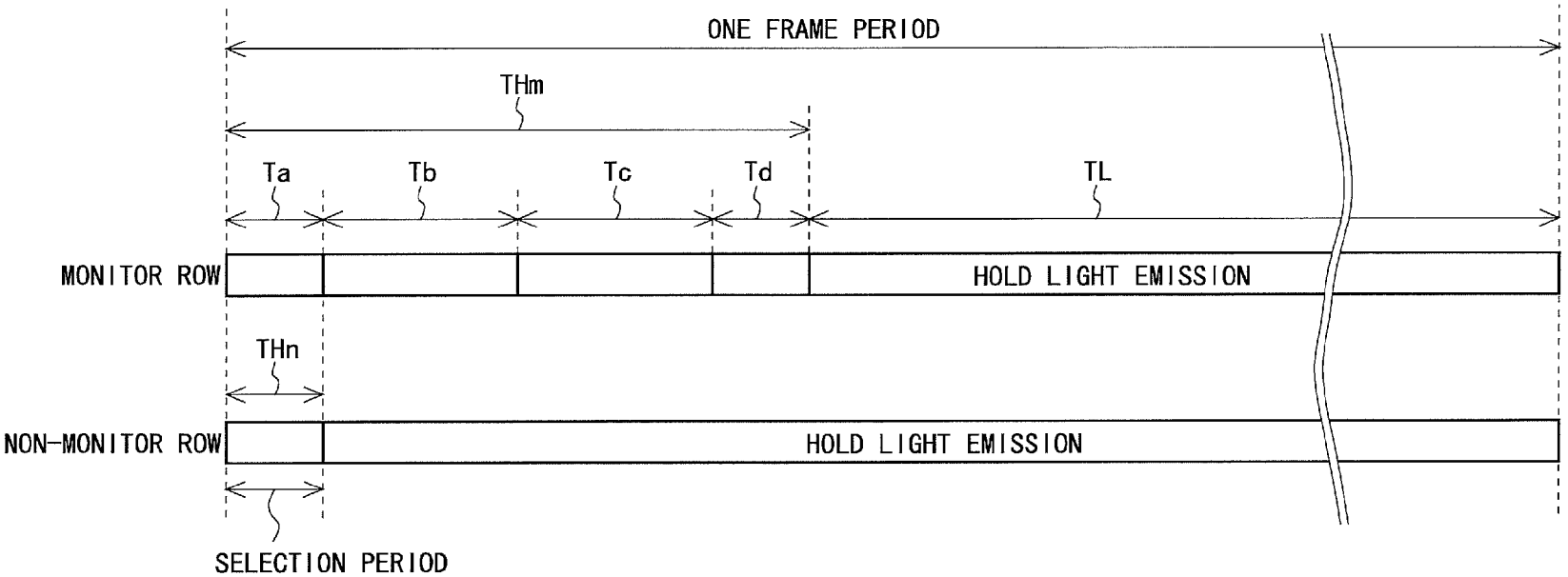
FIG. 19 is a diagram comparing one frame period for a monitored row with one frame period for a non-monitored row in the embodiment.

As described above, in a non-monitored row, a process of allowing an organic EL element OLED to emit light is performed as with a common organic EL display device. On the other hand, in a monitored row, a process for detecting a TFT characteristic and an OLED characteristic is performed and then a process of allowing an organic EL element OLED to emit light is performed. Therefore, as can be grasped from FIG. 19, the length of a light emission period for the monitored row is shorter than that of a light emission period for the non-monitored row. Hence, the magnitude of the data potential D(i,j) to be applied to the data signal line S(j) during the light emission preparation period Td is adjusted such that an integrated luminance during a frame period is equal to a luminance appearing in the non-monitored row. Specifically, a data potential corresponding to a grayscale voltage slightly larger than a grayscale voltage for the non-monitored row is provided to the data signal line S(j) during the light emission preparation period Td. In other words, with any organic EL element OLED defined as a focused organic EL element, when the focused organic EL element is included in the monitored row, during the light emission preparation period Td, a data potential corresponding to a larger grayscale voltage than a grayscale voltage provided when the focused organic EL element is included in the non-monitored row is provided by the source driver 30 to the data signal line S(j). By this, a degradation in display quality is suppressed.

Note that although in the present embodiment, current measurement for detecting a TFT characteristic is performed twice during a TFT characteristic detection period Tb, and current measurement for detecting an OLED characteristic is performed twice during an OLED characteristic detection period Tc, the present invention is not limited thereto. Each of current measurement for detecting a TFT characteristic and current measurement for detecting an OLED characteristic may be performed once or may be performed three times or more during a TFT characteristic detection period Tb and an OLED characteristic detection period Tc. In addition, the number of times current measurement for detecting a TFT characteristic is performed may be different from the number of times current measurement for detecting an OLED characteristic is performed. In addition, there may be a frame having only a TFT characteristic detection period Tb or there may be a frame having only an OLED characteristic detection period Tc. That is, only either one of detection of a TFT characteristic and detection of an OLED characteristic may be performed per frame period. In this case, during a frame period during which detection of a TFT characteristic is performed, a potential Vm_TFT is provided to the data signal line S(j) throughout periods represented by Tb to Tc in FIG. 10, and during a frame period during which detection of an OLED characteristic is performed, a potential Vm_oled is provided to the data signal line S(j) throughout the periods represented by Tb to Tc in FIG. 10. By doing so, sufficient time for transferring monitored data MO obtained by AD conversion to the control circuit 20 is ensured after the AD conversion.

In addition, although in the present embodiment, as shown in FIG. 9, every time a frame is changed, a monitored row is also changed, the present invention is not limited thereto. The same row may be set as a monitored row over a plurality of frames. For example, it is also possible to set the same row as a monitored row over a total of four frames including two frames where characteristic detection of the transistor T2 (drive transistor) is performed using two types of Vm_TFT, and two frames where characteristic detection of an organic EL element OLED (electrooptical element) is performed using two types of Vm_oled. Furthermore, the same row may be set as a monitored row over a plurality of frames using the same monitoring voltages (Vm_TFT and Vm_oled). By thus repeatedly performing a characteristic detection process on one row, an effect of an improvement in S/N ratio can be obtained. Furthermore, although in the present embodiment only one row is set as a monitored row in each frame, the present invention is not limited thereto. Within a range where display quality is not degraded, a plurality of rows may be set as monitored rows in each frame, or characteristic detection for all rows may be continuously performed immediately after the power to a panel is turned on or during a power-off period or at any timing during a non-display period.

<3.3 Update to Correction Data in the Correction Data Storage Unit>

Figure 20:
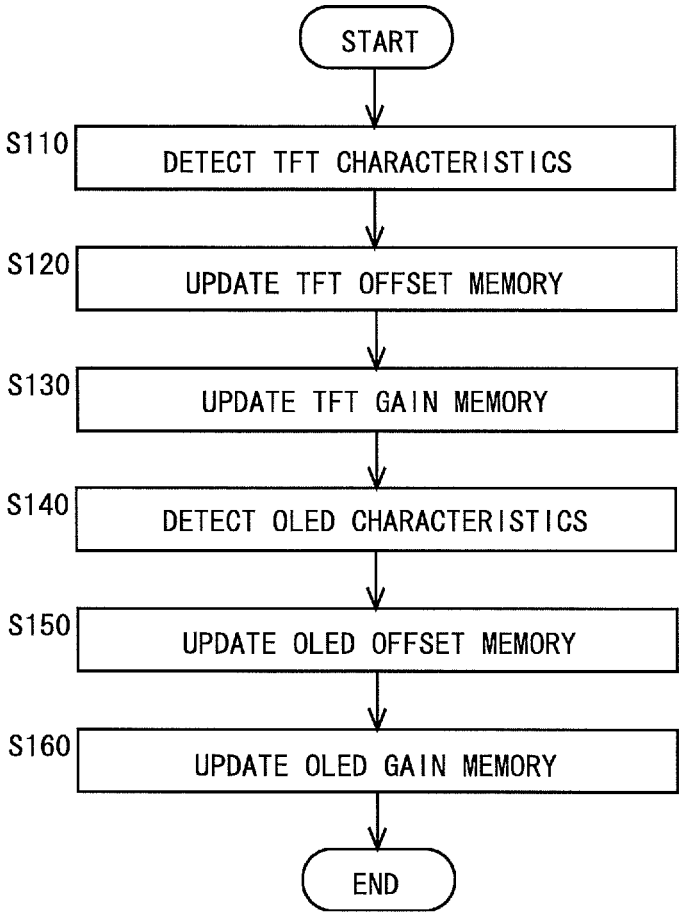
FIG. 20 is a flowchart for describing a procedure for updating correction data in a correction data storage unit in the embodiment.

Next, a description will be made of how correction data (offset values stored in the TFT offset memory 51*a*, offset values stored in the OLED offset memory 51*b*, gain values stored in the TFT gain memory 52*a*, and degradation correction factors stored in the OLED gain memory 52*b*) stored in the correction data storage unit 50 is updated. FIG. 20 is a flowchart for describing a procedure for updating correction data in the correction data storage unit 50. Note that here correction data corresponding to one pixel is focused.

First, detection of a TFT characteristic is performed during a TFT characteristic detection period Tb (step S110). By this step S110, an offset value and a gain value for correcting a video signal are obtained. Then, the offset value obtained at step S110 is stored in the TFT offset memory 51*a*, as a new offset value (step S120). In addition, the gain value obtained at step S110 is stored in the TFT gain memory 52*a*, as a new gain value (step S130). Thereafter, detection of an OLED characteristic is performed during an OLED characteristic detection period Tc (step S140). By this step S140, an offset value and a degradation correction factor for correcting the video signal are obtained. Then, the offset value obtained at step S140 is stored in the OLED offset memory 51*b*, as a new offset value (step S150). In addition, the degradation correction factor obtained at step S140 is stored in the OLED gain memory 52*b*, as a new degradation correction factor (step S160). In the above-described manner, an update to correction data corresponding to one pixel is performed. In the present embodiment, detection of a TFT characteristic and an OLED characteristic for one row is performed in each frame, and thus, m offset values in the TFT offset memory 51*a*, m gain values in the TFT gain memory 52*a*, m offset values in the OLED offset memory 51*b*, and m degradation correction factors in the OLED gain memory 52*b* are updated per frame period.

Note that, in the present embodiment, characteristic data is implemented by data (offset values, a gain value, and a degradation correction factor) which is obtained based on results of detection at step S110 and step S140.

Meanwhile, as described above, during the OLED characteristic detection period Tc, measurement of the magnitude of a current flowing through the organic EL element OLED is performed based on a certain voltage (Vm_oled–ELVSS). The smaller the detected current which is a result of the measurement, the larger the degree of degradation of the organic EL element OLED. Therefore, an update to data in the OLED offset memory 51*b* and the OLED gain memory 52*b* is performed such that the smaller the detected current, the larger the offset value and the larger the degradation correction factor.

<3.4 Correction of a Video Signal>

In the present embodiment, in order to compensate for degradation of a drive transistor and degradation of an organic EL element OLED, correction of a video signal transmitted from an external source is performed using correction data stored in the correction data storage unit 50. The correction of the video signal will be described below with reference to FIG. 21.

Figure 21:
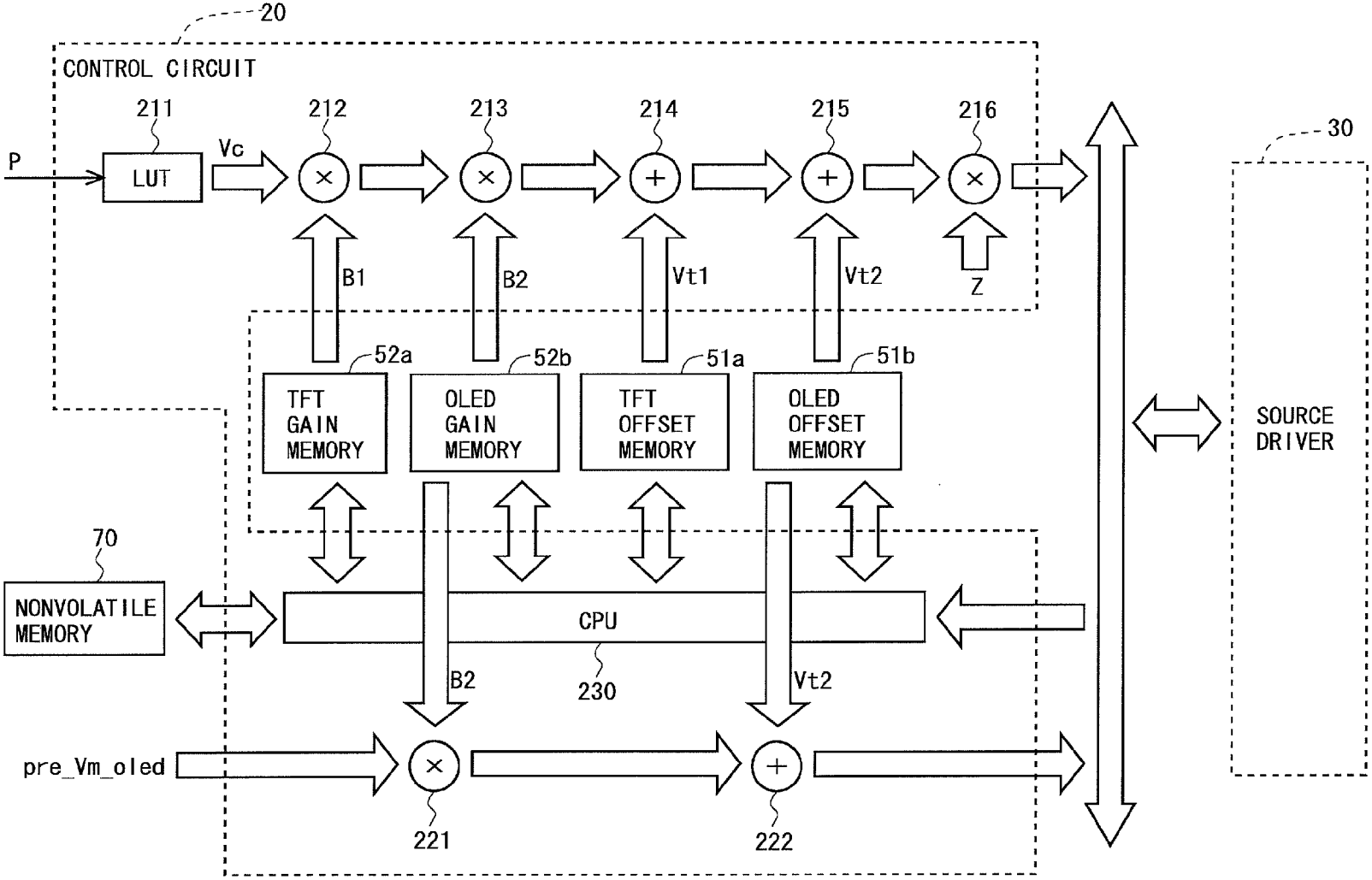
FIG. 21 is a diagram for describing correction of a video signal in the embodiment.

As shown in FIG. 21, the control circuit 20 is provided with a LUT 211, a multiplying unit 212, a multiplying unit 213, an adding unit 214, an adding unit 215, and a multiplying unit 216, as components for correcting the video signal. In addition, the control circuit 20 is provided with a multiplying unit 221 and an adding unit 222, as components for correcting a potential Vm_oled which is provided to the data signal line S during the OLED characteristic detection period Tc. A CPU 230 in the control circuit 20 performs, for example, control of the operation of the above-described components, update and reading of data in each memory (the TFT offset memory 51*a*, the TFT gain memory 52*a*, the OLED offset memory 51*b*, and the OLED gain memory 52*b*) in the correction data storage unit 50, update and reading of data in a nonvolatile memory 70, and giving and receiving of data to/from the source driver 30.

In a configuration such as that described above, a video signal transmitted from an external source is corrected as follows. First, gamma correction is performed on the video signal transmitted from an external source, using the LUT 211. Specifically, a grayscale P represented by the video signal is converted into a control voltage Vc by gamma correction. The multiplying unit 212 receives the control voltage Vc and a gain value B1 read from the TFT gain memory 52*a*, and outputs the value "Vc·B1" which is obtained by multiplying the control voltage Vc and the gain value B1 together. The multiplying unit 213 receives the value "Vc·B1" outputted from the multiplying unit 212 and a degradation correction factor B2 read from the OLED gain memory 52*b*, and outputs the value "Vc·B1·B2" which is obtained by multiplying the value "Vc·B1" and the degradation correction factor B2 together. The adding unit 214 receives the value "Vc·B1·B2" outputted from the multiplying unit 213 and an offset value Vt1 read from the TFT offset memory 51*a*, and outputs the value "Vc·B1·B2+Vt1" which is obtained by adding the value "Vc·B1·B2" and the offset value Vt1 together. The adding unit 215 receives the value "Vc·B1·B2+Vt1" outputted from the adding unit 214 and an offset value Vt2 read from the OLED offset memory 51*b*, and outputs the value "Vc·B1·B2+Vt1+Vt2" which is obtained by adding the value "Vc·B1·B2+Vt1" and the offset value Vt2 together. The multiplying unit 216 receives the value "Vc·B1·B2+Vt1+Vt2" outputted from the adding unit 215 and a coefficient Z for compensating for attenuation of a data potential caused by a parasitic capacitance in the pixel circuit 11, and outputs the value "Z (Vc·B1·B2+Vt1+Vt2)" which is obtained by multiplying the value "Vc·B1·B2+Vt1+Vt2" and the coefficient Z together. The value "Z (Vc·B1·B2+Vt1+Vt2)" obtained in the above-described manner is transmitted as a data signal DA to the source driver 30 from the control circuit 20. A potential Vmg which is provided to the data signal line S during the detection preparation period Ta is also corrected by the same process as that for the video signal. Note that the multiplying unit 216 that performs a process of multiplying a value outputted from the adding unit 215 by the coefficient Z for compensating for attenuation of a data potential does not necessarily need to be provided.

In addition, a potential Vm_oled which is provided to the data signal line S during the OLED characteristic detection period Tc is corrected as follows. The multiplying unit 221 receives pre_Vm_oled (Vm_oled before correction) and a degradation correction factor B2 read from the OLED gain memory 52*b*, and outputs the value "pre_Vm_oled·B2" which is obtained by multiplying pre_Vm_oled and the degradation correction factor B2 together. The adding unit 222 receives the value "pre_Vm_oled·B2" outputted from the multiplying unit 221 and an offset value Vt2 read from the OLED offset memory 51*b*, and outputs the value "pre_Vm_oled·B2+Vt2" which is obtained by adding the value "pre_Vm_oled·B2" and the offset value Vt2 together. The value "pre_Vm_oled·B2+Vt2" obtained in the above-described manner is transmitted to the source driver 30 from the control circuit 20, as data indicating the potential Vm_oled of the data signal line S provided during the OLED characteristic detection period Tc.

<3.5 Summary of the Drive Method>

Figure 22:
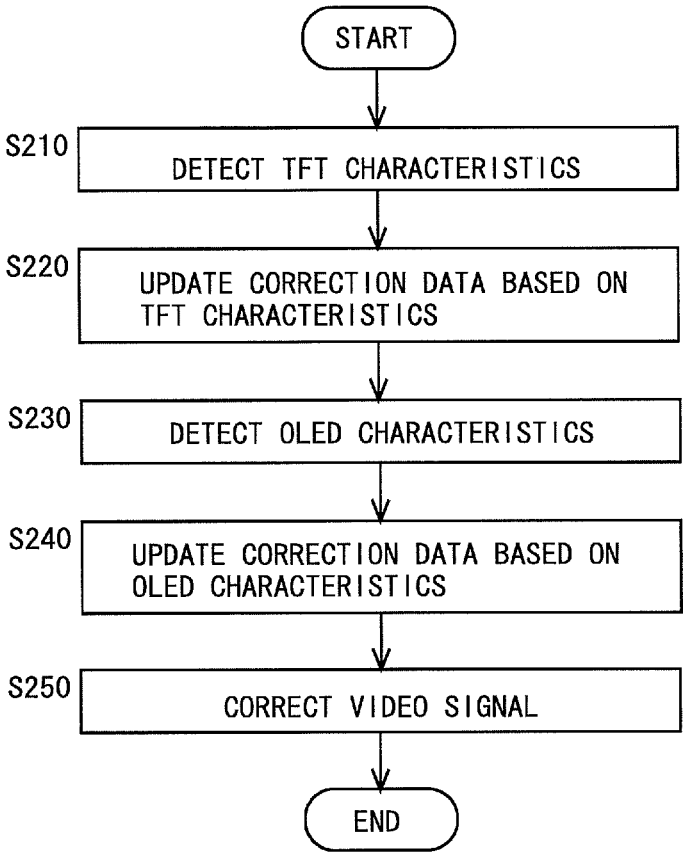
FIG. 22 is a flowchart for describing an outline of operation related to detection of a TFT characteristic and an OLED characteristic in the embodiment.

FIG. 22 is a flowchart for describing an outline of operation related to detection of a TFT characteristic and an OLED characteristic. First, detection of a TFT characteristic is performed during the TFT characteristic detection period Tb (step S210). Then, using a result of the detection at step S210, an update to the TFT offset memory 51*a* and the TFT gain memory 52*a* is performed (step S220). Subsequently, detection of an OLED characteristic is performed during the OLED characteristic detection period Tc (step S230). Then, using a result of the detection at step S230, an update to the OLED offset memory 51*b* and the OLED gain memory 52*b* is performed (step S240). Thereafter, correction of a video signal transmitted from an external sources is performed using the correction data stored in the TFT offset memory 51*a*, the TFT gain memory 52*a*, the OLED offset memory 51*b*, and the OLED gain memory 52*b* (step S250).

Note that in the present embodiment a characteristic detecting step is implemented by step S210 and step S230, a correction data storing step is implemented by step S220 and step S240, and a video signal correcting step is implemented by step S250.

<4. Effects>

Figure 23:
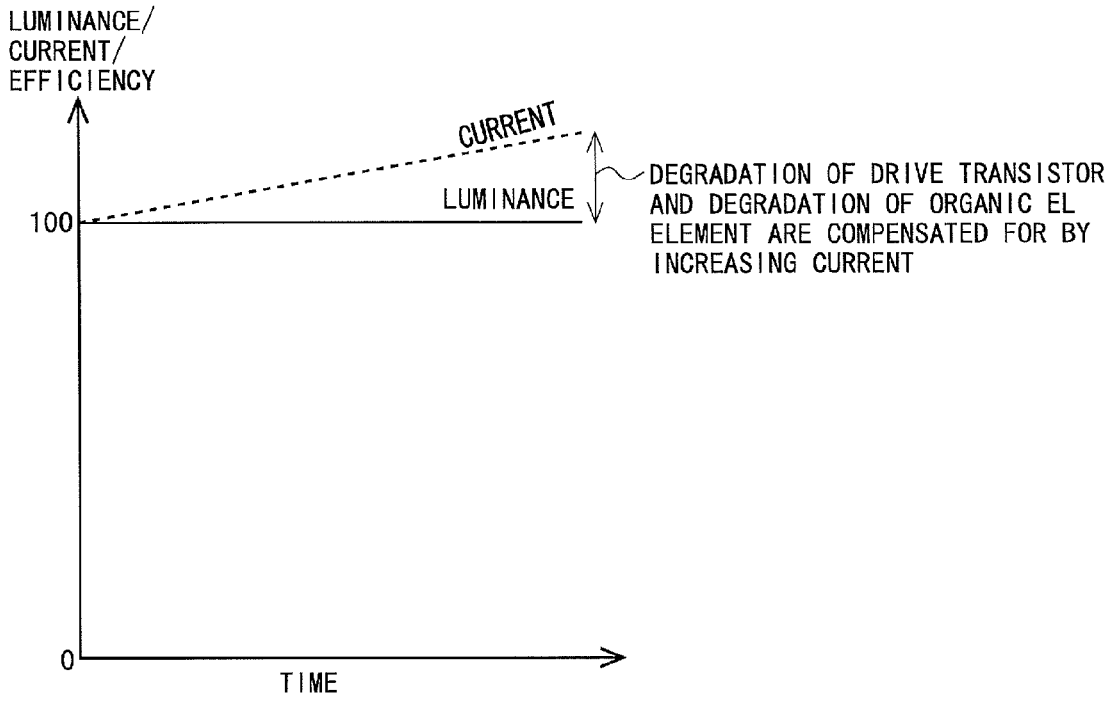
FIG. 23 is a diagram for describing an effect of the embodiment.
Figure 24:
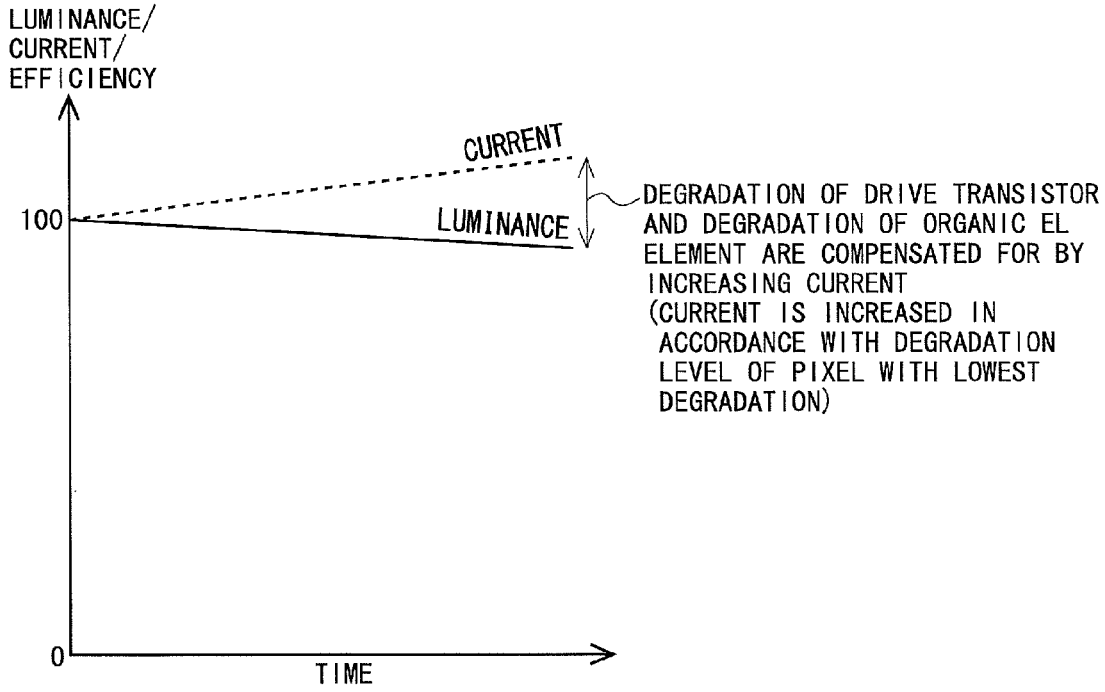
FIG. 24 is a diagram for describing an effect of the embodiment.

According to the present embodiment, detection of a TFT characteristic and an OLED characteristic for one row is performed in each frame. One horizontal scanning period THm for a monitored row is longer than one horizontal scanning period THn for a non-monitored row, and in the monitored row, detection of a TFT characteristic and detection of an OLED characteristic are performed during the one horizontal scanning period THm. Then, a video signal transmitted from an external source is corrected using correction data which is obtained by taking into account both of a result of the detection of a TFT characteristic and a result of the detection of an OLED characteristic. Since a data potential based on the thus corrected video signal is applied to a data signal line S, when an organic EL element OLED in each pixel circuit 11 is allowed to emit light, a drive current of a magnitude that compensates for degradation of the drive transistor (transistor T2) and degradation of the organic EL element OLED is supplied to the organic EL element OLED (see FIG. 23). In addition, by increasing a current in accordance with a degradation level of a pixel with the lowest degradation as shown in FIG. 24, it becomes possible to compensate for burn-in. Here, the data signal line S in the present embodiment is not only used as a signal line that transfers a luminance signal for allowing an organic EL element OLED in each pixel circuit 11 to emit light at a desired luminance, but also used as a signal line for characteristic detection (a signal line that provides control potentials (Vmg, Vm_TFT, and Vm_oled) for characteristic detection to the pixel circuit 11, and a signal line serving as a path for currents that represent characteristics and that are measurable by the output and current-monitoring circuit 330). That is, new signal lines do not need to be provided in the display unit 10 to detect a TFT characteristic and an OLED characteristic. Accordingly, it becomes possible to simultaneously compensate for both of degradation of the drive transistors (transistors T2) and degradation of the organic EL elements OLED while an increase in circuit size is suppressed.

In addition, in the present embodiment, the output and current-monitoring circuits 330 provided for the respective columns have the function of holding analog data representing a TFT characteristic and an OLED characteristic (sample and hold function). Using the sample and hold function, an A/D converter 324 for converting the above-described analog data into digital data is shared between a plurality of columns. This effectively suppresses an increase in circuit size associated with implementation of a configuration capable of detecting characteristics of the circuit elements. In addition, each output and current-monitoring circuit 330 is provided with a switch 334 for controlling a connection state between a data signal line S and an internal data line Sin, and a switch 335 for controlling a connection state between the data signal line S and a predetermined control line CL. Then, during a period during which AD conversion by the A/D converter 324 is performed, the data signal line S and the internal data line Sin are electrically disconnected from each other, and a predetermined potential (Vm_TFT or Vm_oled) is provided to the data signal line S from the control line CL. By this, the potential of the data signal line S is prevented from being changed during AD conversion due to sharing of the A/D converter 324. Due to this fact, since recharging of the data signal line S is performed in a very short period of time, it becomes possible to repeatedly perform current measurement for characteristic detection. By this, an effect that a sufficient S/N ratio can be ensured is obtained.

Furthermore, in the present embodiment, oxide TFTs (specifically, TFTs having an In—Ga—Zn—O-based semiconductor layer) are adopted as the transistors T1 to T3 in the pixel circuit 11. In terms of this, too, an effect that a sufficient S/N ratio can be ensured is obtained. This will be described below. Note that here a TFT having an In—Ga—Zn—O-based semiconductor layer is referred to as "In—Ga—Zn—O-TFT". Comparing the In—Ga—Zn—O-TFT with an LTPS (Low Temperature Poly silicon)-TFT, the off-current is extremely smaller in the In—Ga—Zn—O-TFT than in the LTPS-TFT. For example, when the LTPS-TFT is adopted as the transistor T3 in the pixel circuit 11, the off-current is about 1 pA at the maximum. On the other hand, when the In—Ga—Zn—O-TFT is adopted as the transistor T3 in the pixel circuit 11, the off-current is about 10 fA at the maximum. Therefore, for example, the off-current for 1000 rows is about 1 nA at the maximum for a case of adopting the LTPS-TFTs, and is about 10 pA at the maximum for a case of adopting the In—Ga—Zn—O-TFTs. A detected current is about 10 to 100 nA for both cases. Meanwhile, each data signal line S is connected to transistors T3 in pixel circuits 11 of all rows of a corresponding column. Therefore, the S/N ratio of the data signal line S for when characteristic detection is performed depends on a total of leakage currents of transistors T3 in non-monitored rows. Specifically, the S/N ratio of the data signal line S for when characteristic detection is performed is expressed by "detected current/(leakage current×the number of non-monitored rows)". From the above fact, for example, in an organic EL display device having a display unit 10 with "Landscape FHD", the S/N ratio is about 10 for a case of adopting the LTPS-TFTs, and is about 1000 for a case of adopting the In—Ga—Zn—O-TFTs. As such, in the present embodiment, a sufficient S/N ratio can be ensured when current detection is performed.

<5. Variants>

Variants of the above-described embodiment will be described below. Note that in the following only different points from the above-described embodiment will be described in detail, and a description of the same points as in the above-described embodiment is omitted.

<5.1 First Variant>

In the above-described embodiment, a potential that is provided to the data signal line S during the OLED characteristic detection period Tc is corrected based on an offset value Vt2 stored in the OLED offset memory 51*b* and a degradation correction factor B2 stored in the OLED gain memory 52*b* (see FIG. 21). That is, the magnitude of a potential Vm_oled can vary between pixels. In this regard, since the switch 334 goes into an off state during AD conversion as described above, there is a need to provide a different D/A converter than the D/A converter 321 shown in FIG. 1 in order to supposedly supply a potential Vm_oled whose magnitude varies between pixels to the data signal line S from the control line CL.

However, if recharging of the data signal line S after AD conversion is performed in a short period of time, then the potential Vm_oled which is set for each pixel does not necessarily need to be supplied to the data signal line S from the control line CL. Hence, in the present variant, during the OLED characteristic detection period Tc, a certain potential close to the potential Vm_oled is provided to the control line CL from the power supply circuit. By this, during the OLED characteristic detection period Tc, the certain potential is provided to the data signal line S from the control line CL.

As described above, as long as the magnitude of a potential provided to the control line CL during the OLED characteristic detection period Tc is substantially equal to that of a potential Vm_oled which is set for each pixel, the magnitude may be exactly the same as the potential Vm_oled or may be a potential close to the potential Vm_oled.

<5.2 Second Variant>

In the above-described embodiment, the configuration is such that during periods (a period Tc3 and a period Tc6) during which AD conversion is performed within the OLED characteristic detection period Tc, a potential Vm_oled is provided to the data signal line S from a control line CL. However, the present invention is not limited thereto. A configuration (a configuration of the present variant) can also be adopted in which during the periods during which AD conversion is performed within the OLED characteristic detection period Tc, the data signal line S is brought into a high-impedance state. A drive method in the present variant will be described below, mainly for different points from the above-described embodiment.

Figure 25:
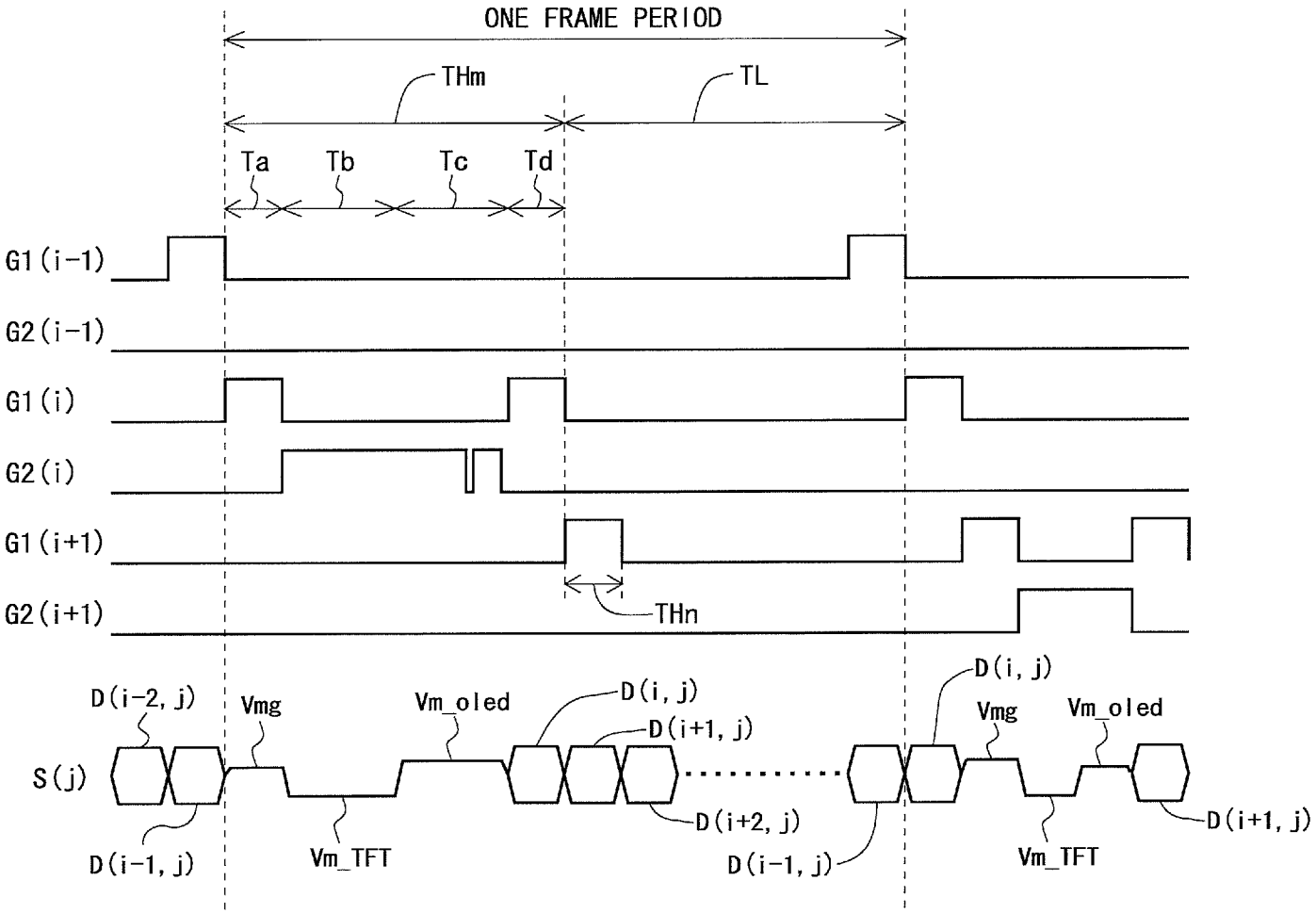
FIG. 25 is a timing chart for describing the operation of a pixel circuit (a pixel circuit at an ith row and a jth column) included in a monitored row in a second variant of the embodiment.

FIG. 25 is a timing chart for describing the operation of a pixel circuit 11 (assumed to be a pixel circuit 11 at an ith row and a jth column) included in a monitored row in the present variant. As can be grasped from FIGS. 10 and 25, the waveform of the monitoring control line G2(*i*) during the OLED characteristic detection period Tc is different between the above-described embodiment and the present variant.

Figure 26:
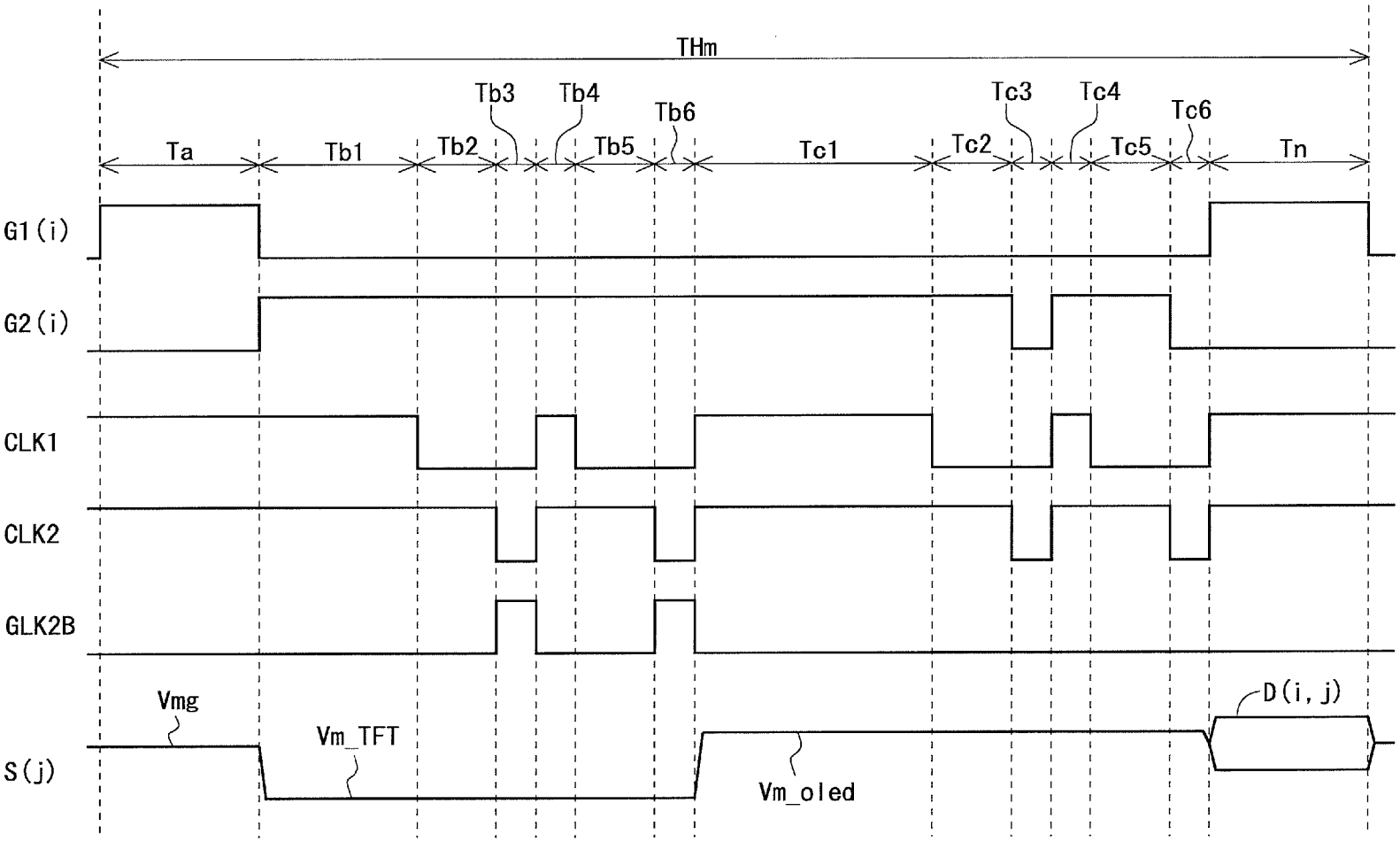
FIG. 26 is a timing chart for describing details of one horizontal scanning period for a monitored row in the second variant of the embodiment.

FIG. 26 is a timing chart for describing details of one horizontal scanning period THm for a monitored row. With reference to this FIG. 26, characteristic detection operation in the present variant will be described. During the detection preparation period Ta, the TFT characteristic detection period Tb, and the light emission preparation period Td, the same operation as that in the above-described embodiment is performed, and thus, a description thereof is omitted.

As with the above-described embodiment, the OLED characteristic detection period Tc is composed of periods Tc1 to Tc6. During the period Tc1 (data signal line charging period) and the period Tc2 (monitoring period), the same operation as that in the above-described embodiment is performed. When the period turns to the period Tc3 (AD conversion period), the control clock signal CLK2 changes from the high level to the low level. By this, the switch 334 goes into an off state, and the data signal line S(j) and the internal data line Sin(j) go into an electrically disconnected state. Then, in the same manner as in the above-described embodiment, each A/D converter 324 sequentially performs AD conversion on analog data of a plurality of columns. In addition, during the period Tc3, unlike the above-described embodiment, the control clock signal CLK2B is maintained at a low level and the monitoring control line G2(*i*) is brought into a non-active state. By this, the switch 335 is maintained in an off state and the transistor T3 also goes into an off state. By the above, during the period Tc3, the data signal line S(j) goes into a high-impedance state. In this manner, during the period Tc3, a leak of charge from the data signal line S(j) is prevented and the potential of the data signal line S(j) is maintained at a potential close to Vm_oled.

During the period Tc4 (data signal line charging period), in the same manner as in the above-described embodiment, recharging of the data signal line S(j) is performed. As described above, during the period Tc3, the data signal line S(j) goes into a high-impedance state and the potential of the data signal line S(j) is maintained at a potential close to Vm_oled. Thus, during the period Tc4, recharging is performed in a very short period of time such that the potential of the data signal line S(j) becomes Vm_oled. During the period Tc5 (monitoring period), the same operation as that for the period Tc2 is performed. During the period Tc6 (AD conversion period), the same operation as that for the period Tc3 is performed.

As described above, according to the present variant, during periods during which AD conversion by the A/D converter 324 is performed in the OLED characteristic detection period Tc, the data signal line S is brought into a high-impedance state. In addition, during periods during which AD conversion by the A/D converter 324 is performed in the TFT characteristic detection period Tb, as with the above-described embodiment, a predetermined potential (Vm_TFT) is provided to the data signal line S from the control line CL. By this, in the present variant, too, recharging of the data signal line S is performed in a very short period of time. Accordingly, it becomes possible to repeatedly perform current measurement for characteristic detection, enabling to ensure a sufficient S/N ratio.

Figure 27:
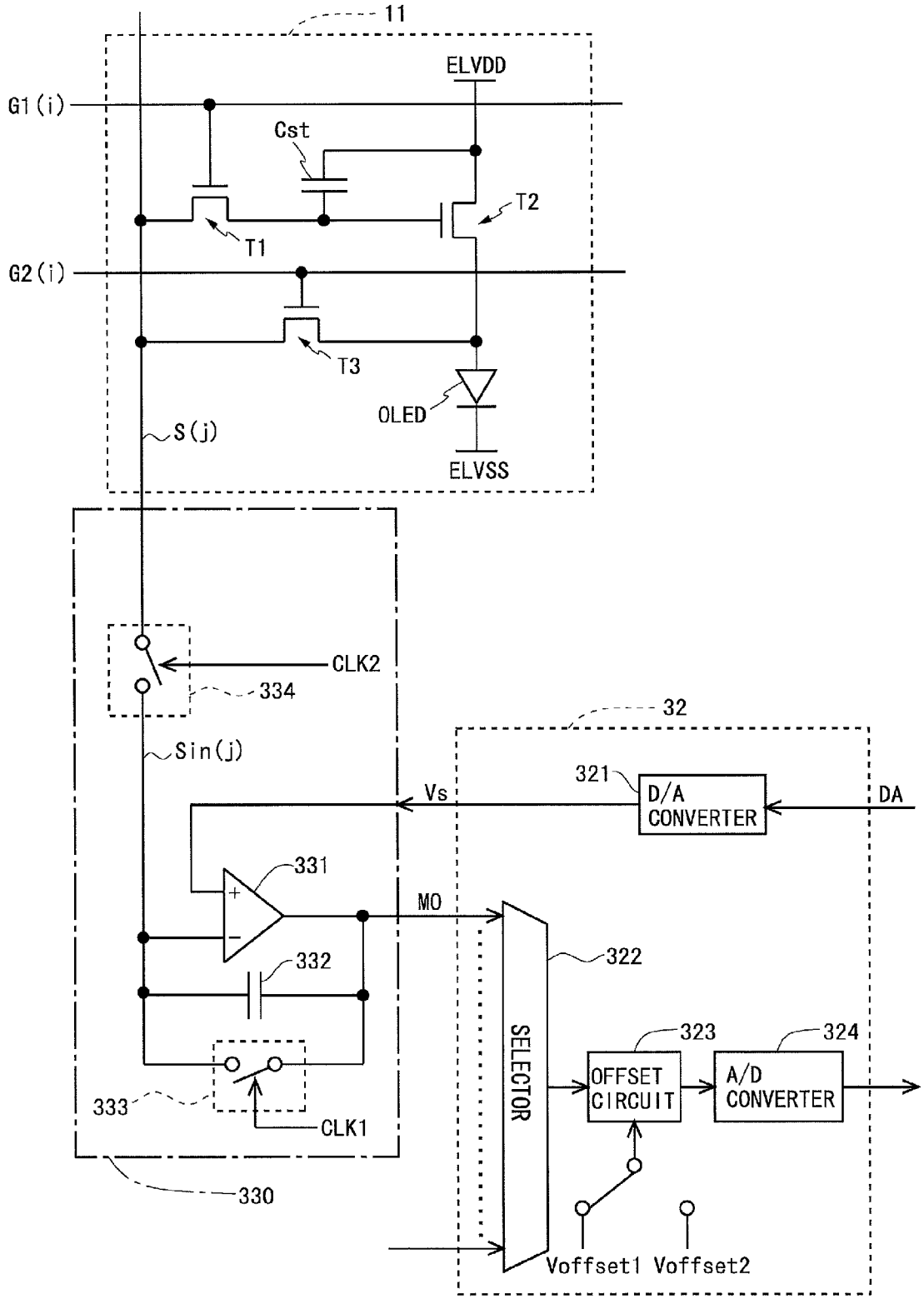
FIG. 27 is a circuit diagram showing a configuration in which a control line CL and a switch 335 are removed from the configuration shown in FIG. 1, in the second variant of the embodiment.

Note that the data signal line S(j) can be brought into a high-impedance state by bringing the transistor T3 into an off state also during periods (the period Tb3 and the period Tb6) during which AD conversion is performed within the TFT characteristic detection period Tb. A circuit configuration for this case is one in which the control line CL and the switch 335 are removed from the configuration shown in FIG. 1 (see FIG. 27). Note, however, that in this case since the transistor T2 is in an on state, a current is supplied to the organic EL element OLED and thus the organic EL element OLED emits light. In addition, since the source potential of the transistor T2 significantly changes, a recharging period after AD conversion needs to be increased. Therefore, it is preferred that during the periods during which AD conversion is performed within the TFT characteristic detection period Tb, as with the above-described embodiment, a potential Vm_TFT be provided to the data signal line S(j) from the control line CL while the transistor T3 is maintained in an on state. However, also in the case of adopting the configuration shown in FIG. 27, there are obtained an effect that an A/D converter 324 can be shared between a plurality of columns, an effect that a recharging period for when an OLED characteristic is detected can be reduced, and an effect that the circuit size can be reduced compared to the case of adopting the configuration shown in FIG. 1.

<5.3 Third Variant>

Figure 28:
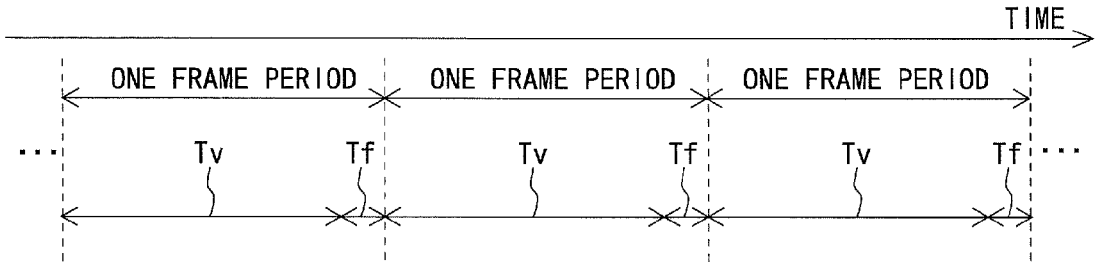
FIG. 28 is a diagram for describing a configuration of one frame period.

In general, in an organic EL display device, one frame period includes a vertical scanning period which is a period during which writing of video signals to pixels is sequentially performed in order from the first row to the last row; and a vertical retrace period (vertical synchronization period) which is a period provided to bring writing of video signals back to the first row from the last row. Then, during the operation of the organic EL display device, a vertical scanning period Tv and a vertical retrace period Tf are repeated alternately as shown in FIG. 28. Meanwhile, in the above-described embodiment, detection of a TFT characteristic and detection of an OLED characteristic are performed during the vertical scanning period Tv. However, the present invention is not limited thereto. A configuration (a configuration of the present variant) can also be adopted in which detection of a TFT characteristic and detection of an OLED characteristic are performed during the vertical retrace period Tf.

In the present variant, for example, assuming that detection of a TFT characteristic and an OLED characteristic for the first row is performed during a vertical retrace period Tf in a (k+1)th frame, detection of a TFT characteristic and an OLED characteristic for the second row is performed during a vertical retrace period Tf in a (k+2)th frame, detection of a TFT characteristic and an OLED characteristic for the third row is performed during a vertical retrace period Tf in a (k+3)th frame, and detection of a TFT characteristic and an OLED characteristic for an nth row is performed during a vertical retrace period Tf in a (k+n)th frame. That is, every time a frame is changed, a monitored row is also changed. Note that during the vertical scanning period Tv, the same operation as that of a common organic EL display device is performed.

Figure 29:
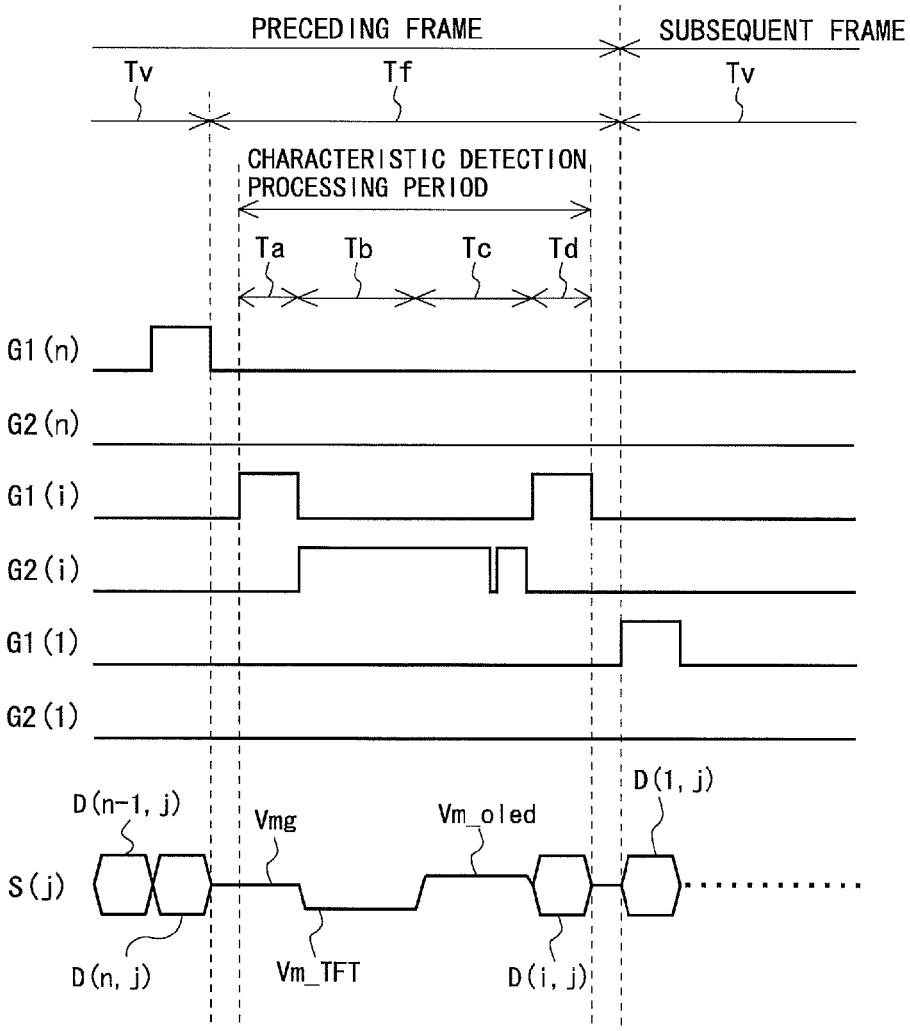
FIG. 29 is a timing chart for describing the operation, during a vertical retrace period, of a pixel circuit (assumed to be a pixel circuit at an ith row and a jth column) included in a monitored row in a third variant of the embodiment.

FIG. 29 is a timing chart for describing the operation, during a vertical retrace period Tf, of a pixel circuit 11 (assumed to be a pixel circuit 11 at an ith row and a jth column) included in a monitored row in the present variant. As shown in FIG. 29, in the present variant, apart of the vertical retrace period Tf serves as a characteristic detection processing period including a detection preparation period Ta, a TFT characteristic detection period Tb, an OLED characteristic detection period Tc, and a light emission preparation period Td.

Figure 30:
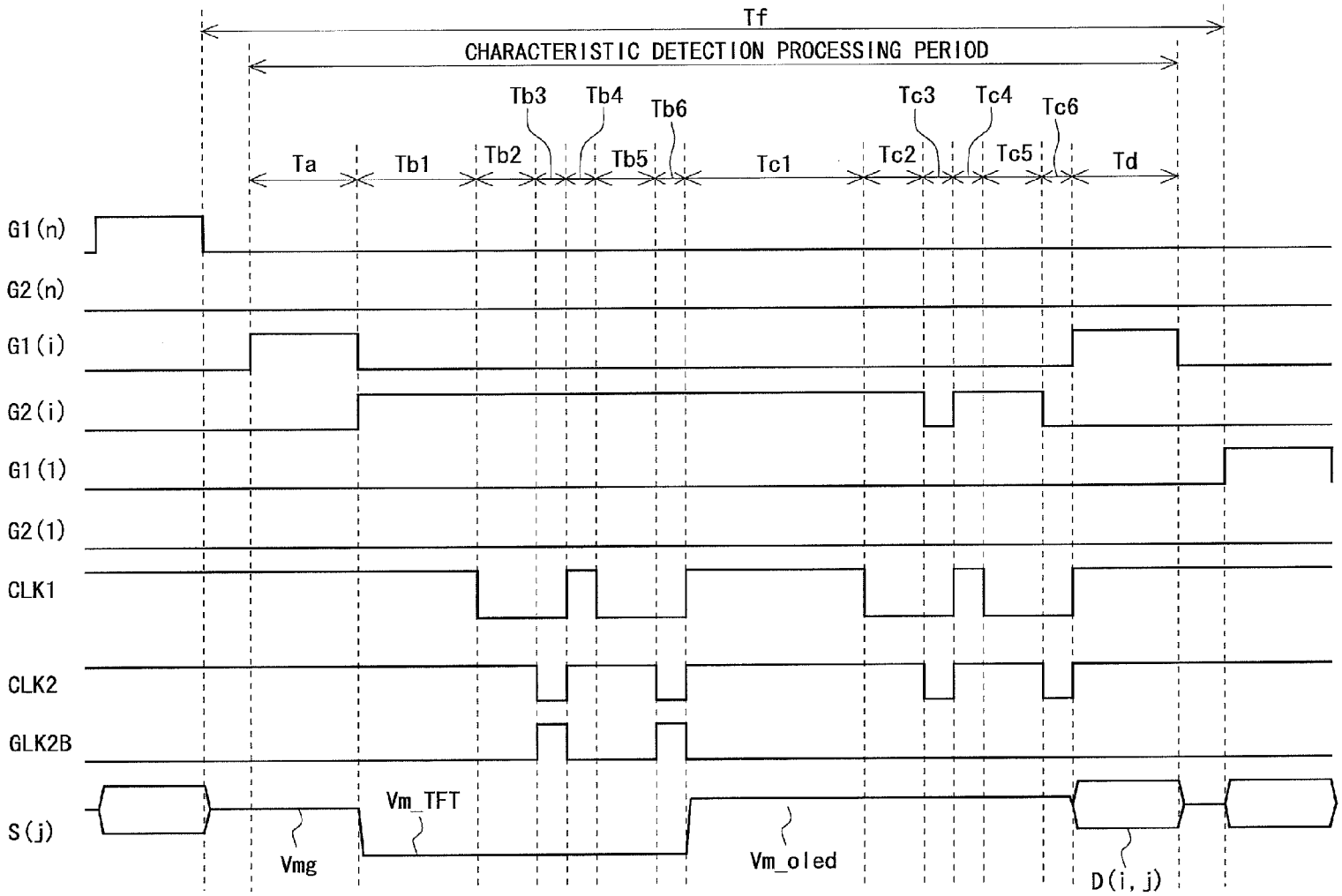
FIG. 30 is a timing chart for describing details of the vertical retrace period in the third variant of the embodiment.

FIG. 30 is a timing chart for describing details of a vertical retrace period Tf in the present variant. As can be grasped from FIG. 30, during a detection preparation period Ta, a TFT characteristic detection period Tb (Tb1 to Tb6), and a light emission preparation period Td included in the vertical retrace period Tf in the present variant, the same operation as that for the detection preparation period Ta, the TFT characteristic detection period Tb (Tb1 to Tb6), and the light emission preparation period Td in the above-described embodiment is performed (the above-described second variant is also the same). During an OLED characteristic detection period Tc (Tc1 to Tc6) included in the vertical retrace period Tf in the present variant, the same operation as that for the OLED characteristic detection period Tc (Tc1 to Tc6) in the above-described second variant is performed. In this manner, it is also possible to perform detection of a TFT characteristic and an OLED characteristic during the vertical retrace period Tf instead of the vertical scanning period Tv. Note that the configuration may be such that the same operation as that for the OLED characteristic detection period Tc in the above-described embodiment is performed during the OLED characteristic detection period Tc in the present variant.

Meanwhile, in the non-monitored row, writing according to a target luminance is performed during a selection period included in the vertical scanning period Tv, and light emission of the organic EL element OLED based on the writing continues for substantially one frame period. On the other hand, in the monitored row, writing is performed during a selection period included in the vertical scanning period Tv, but when the period turns to the vertical retrace period Tf, light emission of the organic EL element OLED is temporarily suspended. Hence, in order for the organic EL element OLED to emit light in the monitored row after the vertical retrace period Tf ends, writing based on a data potential D (i,j) is performed during a light emission preparation period Td included in the vertical retrace period Tf.

Figure 31:
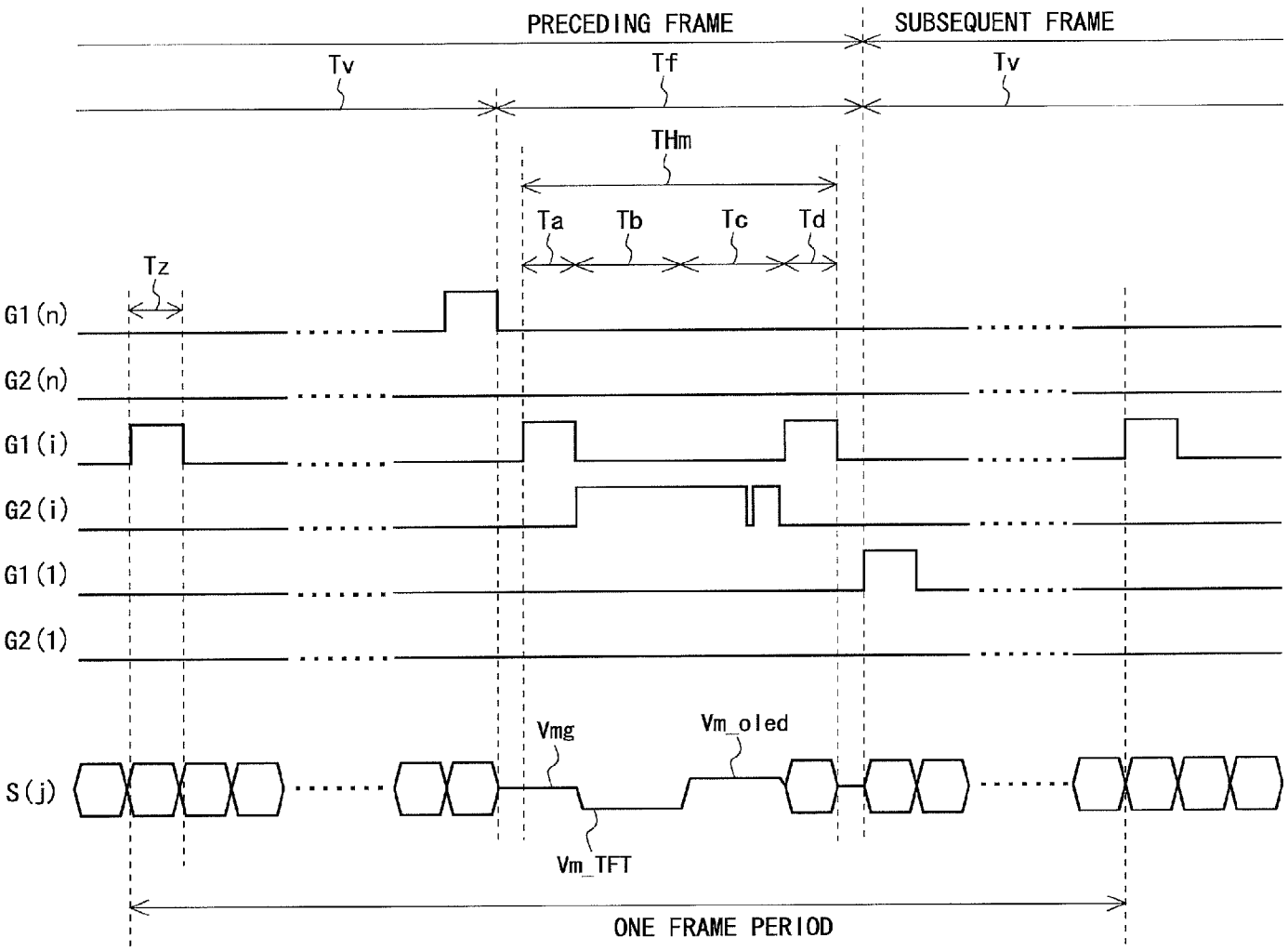
FIG. 31 is a timing chart for describing the operation, during one frame period, of a pixel circuit (assumed to be a pixel circuit at an ith row and a jth column) included in a monitored row in the third variant of the embodiment.

Specifically, in the monitored row, as shown in FIG. 31, first, the organic EL element OLED emits light based on writing performed during the selection period included in the vertical scanning period Tv in a preceding frame. Thereafter, the organic EL element OLED is temporarily turned off during the vertical retrace period Tf. Thereafter, the organic EL element OLED emits light based on writing performed during the light emission preparation period Td included in the vertical retrace period Tf. In this regard, in order to enable writing based on a data potential D(i,j) during the light emission preparation period Td, corresponding data needs to be held after the writing performed during the selection period included in the vertical scanning period Tv. Regarding this point, since the data to be held is merely data for one line, an increase in memory capacity is a little. On the other hand, in the above-described embodiment, since the length of one horizontal scanning period is different between a monitored row and a non-monitored row, a line memory for several tens of lines may be required depending on the timing of data transfer from the control circuit 20. By the above, according to the present variant, required memory capacity is reduced compared to the above-described embodiment.

Note that taking into account the fact that light emission of the organic EL element OLED in the monitored row is temporarily suspended during the vertical retrace period Tf, a data potential corresponding to a larger grayscale voltage than an original grayscale voltage may be provided in advance to the data signal line S during a selection period (a period denoted by reference character Tz in FIG. 31) included in the vertical scanning period Tv. In other words, with any organic EL element OLED defined as a focused organic EL element, when the focused organic EL element is included in the monitored row, during the selection period included in the vertical scanning period Tv, a data potential corresponding to a larger grayscale voltage than a grayscale voltage provided when the focused organic EL element is included in the non-monitored row may be provided by the source driver 30 to the data signal line S(j). By this, a degradation in display quality is suppressed.

<6. Others>

The present invention is not limited to the above-described embodiment and variants and may be implemented by making various modifications thereto without departing from the true scope and spirit of the present invention. For example, an organic EL display device to which the present invention can be applied is not limited to one including the pixel circuits 11 which are exemplified in the above-described embodiment. A pixel circuit may have other configurations than that exemplified in the above-described embodiment, as long as the pixel circuit includes at least an electrooptical element (organic EL element OLED) that is controlled by a current, transistors T1 to T3, and a capacitor Cst.

DESCRIPTION OF REFERENCE CHARACTERS

1: ORGANIC EL DISPLAY DEVICE
10: DISPLAY UNIT
11: PIXEL CIRCUIT
20: CONTROL CIRCUIT
30: SOURCE DRIVER
31: DRIVE SIGNAL GENERATING CIRCUIT
32: SIGNAL CONVERSION CIRCUIT
33: OUTPUT UNIT
40: GATE DRIVER
50: CORRECTION DATA STORAGE UNIT
51*a*: TFT OFFSET MEMORY
51*b*: OLED OFFSET MEMORY
52*a*: TFT GAIN MEMORY
52*b*: OLED GAIN MEMORY
321: D/A CONVERTER
322: SELECTOR
323: OFFSET CIRCUIT
324: A/D CONVERTER
330: OUTPUT AND CURRENT-MONITORING CIRCUIT
333 to 335: SWITCH
T1 to T3: TRANSISTOR
Cst: CAPACITOR
G1 and G1(1) to G1(*n*): SCANNING LINE
G2 and G2(1) to G2(*n*): MONITORING CONTROL LINE
S, S(j), and S(1) to S(m): DATA SIGNAL LINE
Sin, Sin(j), and Sin(1) to Sin(m): INTERNAL DATA LINE
ELVDD: HIGH-LEVEL POWER SUPPLY VOLTAGE, HIGH-LEVEL POWER SUPPLY LINE
ELVSS: LOW-LEVEL POWER SUPPLY VOLTAGE, LOW-LEVEL POWER SUPPLY LINE
Ta: DETECTION PREPARATION PERIOD
Tb: TFT CHARACTERISTIC DETECTION PERIOD
Tc: OLED CHARACTERISTIC DETECTION PERIOD
Tb1, Tb4, Tc1, and Tc4: DATA SIGNAL LINE CHARGING PERIOD
Tb2, Tb5, Tc2, and Tc5: MONITORING PERIOD
Tb3, Tb6, Tc3, and Tc6: AD CONVERSION PERIOD
Td: LIGHT EMISSION PREPARATION PERIOD
TL: LIGHT EMISSION PERIOD

The invention claimed is:

1. An active matrix-type display device comprising:

a display unit having: a pixel matrix of n rows×m columns including n×m pixel circuits (n and m are integers greater than or equal to 2), each pixel circuit including an electrooptical element whose luminance is controlled by a current and a drive transistor for controlling a current to be supplied to the electrooptical element; scanning lines provided for the respective rows of the pixel matrix; monitoring control lines provided for the respective rows of the pixel matrix; and data signal lines provided for the respective columns of the pixel matrix;

a pixel circuit driving unit configured to drive the scanning lines, the monitoring control lines, and the data signal lines such that a characteristic detection process is performed during a frame period and that each electrooptical element emits light according to a target luminance, the characteristic detection process detecting a characteristic of a characteristic detection target circuit element including at least one of the electrooptical element and the drive transistor;

a correction data storage unit configured to store characteristic data obtained based on results of the characteristic detection process, as correction data for correcting video signals; and a video signal correcting unit configured to generate data signals to be supplied to the n×m pixel circuits by correcting the video signals based on the correction data stored in the correction data storage unit, wherein each of the pixel circuits includes:

the electrooptical element;

an input transistor having a control terminal connected to the scanning line, a first conduction terminal connected to a control terminal of the drive transistor, and a second conduction terminal connected to the data signal line;

the drive transistor having a first conduction terminal to which a drive power supply potential is provided;

a monitoring control transistor having a control terminal connected to the monitoring control line, a first conduction terminal connected to a second conduction terminal of the drive transistor and an anode of the electrooptical element, and a second conduction terminal connected to the data signal line; and a first capacitor having one end connected to the control terminal of the drive transistor to hold a potential of the control terminal of the drive transistor, the pixel circuit driving unit includes:

an output and current-monitoring circuit having a function of applying the data signal to the data signal line and a function of obtaining, as monitored data, data according to a magnitude of a current flowing through the data signal line, the monitored data being base data for the characteristic data; and an AD conversion circuit configured to convert the monitored data from an analog value to a digital value, the output and current-monitoring circuit includes:

an internal data line connected to the data signal line;

an operational amplifier having a non-inverting input terminal to which the data signal is provided, and an inverting input terminal connected to the internal data line;

a second capacitor having one end connected to the internal data line, and an other end connected to an output terminal of the operational amplifier;

a first control switch having one end connected to the internal data line, and an other end connected to the output terminal of the operational amplifier; and a second control switch having one end connected to the data signal line, and an other end connected to the internal data line, the AD conversion circuit is provided per plurality of the output and current-monitoring circuits, when a row for which the characteristic detection process is performed during a frame period is defined as a monitored row, and a row other than the monitored row is defined as a non-monitored row, the frame period includes a characteristic detection processing period including: a detection preparation period during which preparation for detecting a characteristic of the characteristic detection target circuit element is performed in the monitored row; a current measurement period during which a characteristic of the characteristic detection target circuit element is detected by measuring a current flowing through the data signal line; and a light emission preparation period during which preparation for allowing the electrooptical element to emit light is performed in the monitored row, the current measurement period includes: a data signal line charging period during which the data signal line is charged such that a current of a magnitude according to the characteristic of the characteristic detection target circuit element flows through the data signal line; a monitoring period during which the monitored data is obtained by accumulating a time-integrated value of the current flowing through the data signal line in the second capacitor; and an AD conversion period during which the AD conversion circuit converts the monitored data from the analog value to the digital value, and during the AD conversion period, the data signal line and the internal data line are electrically disconnected from each other by bringing the second control switch into an off state, and the AD conversion circuit sequentially converts the plurality of pieces of monitored data from analog values to digital values, the plurality of pieces of monitored data being obtained by a plurality of corresponding output and current-monitoring circuits.

2. An active matrix-type display device comprising:

a display unit having: a pixel matrix of n rows×m columns including n×m pixel circuits (n and m are integers greater than or equal to 2), each pixel circuit including an electrooptical element whose luminance is controlled by a current and a drive transistor for controlling a current to be supplied to the electrooptical element; scanning lines provided for the respective rows of the pixel matrix; monitoring control lines provided for the respective rows of the pixel matrix; and data signal lines provided for the respective columns of the pixel matrix;

a pixel circuit driving unit configured to drive the scanning lines, the monitoring control lines, and the data signal lines such that a characteristic detection process is performed during a frame period and that each electrooptical element emits light according to a target luminance, the characteristic detection process detecting a characteristic of a characteristic detection target circuit element including at least one of the electrooptical element and the drive transistor;

a correction data storage unit configured to store characteristic data obtained based on results of the characteristic detection process, as correction data for correcting video signals; and a video signal correcting unit configured to generate data signals to be supplied to the n×m pixel circuits by correcting the video signals based on the correction data stored in the correction data storage unit, wherein each of the pixel circuits includes:

the electrooptical element;

an input transistor having a control terminal connected to the scanning line, a first conduction terminal connected to a control terminal of the drive transistor, and a second conduction terminal connected to the data signal line;

the drive transistor having a first conduction terminal to which a drive power supply potential is provided;

a monitoring control transistor having a control terminal connected to the monitoring control line, a first conduction terminal connected to a second conduction terminal of the drive transistor and an anode of the electrooptical element, and a second conduction terminal connected to the data signal line; and a first capacitor having one end connected to the control terminal of the drive transistor to hold a potential of the control terminal of the drive transistor, the pixel circuit driving unit includes:

an output and signal-monitoring circuit having a function of applying the data signal to the data signal line and a function of obtaining, as monitored data, data according to a magnitude of a signal flowing through the data signal line, the monitored data being base data for the characteristic data; and an AD conversion circuit configured to convert the monitored data from an analog value to a digital value, the output and signal-monitoring circuit includes:

an internal data line connected to the data signal line;

an operational amplifier having a non-inverting input terminal to which the data signal is provided, and an inverting input terminal connected to the internal data line;

a second capacitor having one end connected to the internal data line, and an other end connected to an output terminal of the operational amplifier;

a first control switch having one end connected to the internal data line, and an other end connected to the output terminal of the operational amplifier; and a second control switch having one end connected to the data signal line, and an other end connected to the internal data line, the AD conversion circuit is provided per plurality of the output and current-monitoring circuits, when a row for which the characteristic detection process is performed during a frame period is defined as a monitored row, and a row other than the monitored row is defined as a non-monitored row, the frame period includes a characteristic detection processing period including a signal measurement period during which a characteristic of the characteristic detection target circuit element is detected by measuring a signal flowing through the data signal line, the signal measurement period includes an AD conversion period during which the AD conversion circuit converts the monitored data from the analog value to the digital value, and during the AD conversion period, the data signal line and the internal data line are electrically disconnected from each other by bringing the second control switch into an off state, and the AD conversion circuit sequentially converts the monitored data from analog values to digital values, the monitored data being obtained by corresponding output and signal-monitoring circuits.

3. The display device according to claim 2, wherein the signal measurement period includes: a drive transistor characteristic detection period during which signal measurement for detecting a characteristic of the drive transistor is performed; and an electrooptical element characteristic detection period during which signal measurement for detecting a characteristic of the electrooptical element is performed.

4. The display device according to claim 3, wherein the signal measurement period further includes a data signal line charging period during which the data signal line is charged such that a signal of a magnitude according to the characteristic of the characteristic detection target circuit element flows through the data signal line, the output and signal-monitoring circuit further includes a third control switch having one end connected to the data signal line, and an other end connected to a predetermined control line, and in the drive transistor characteristic detection period included in the signal measurement period, during the AD conversion period, the data signal line and the control line are electrically connected to each other by bringing the third control switch into an on state, and a potential of a magnitude is provided to the control line, the magnitude being equal to a magnitude of a potential provided to the data signal line during the data signal line charging period.

5. The display device according to claim 4, wherein in the electrooptical element characteristic detection period included in the signal measurement period, during the AD conversion period, the third control switch is brought into an off state and the monitoring control transistor is brought into an off state, so that the data signal line goes into a high-impedance state.

6. The display device according to claim 4, wherein in the electrooptical element characteristic detection period included in the signal measurement period, during the AD conversion period, the data signal line and the control line are electrically connected to each other by bringing the third control switch into an on state, and a potential of a magnitude is provided to the control line, the magnitude being substantially equal to a magnitude of a potential provided to the data signal line during the data signal line charging period.

7. The display device according to claim 4, wherein in the electrooptical element characteristic detection period included in the signal measurement period, during the AD conversion period, the data signal line and the control line are electrically connected to each other by bringing the third control switch into an on state, and a potential of certain magnitude is provided to the control line, the potential of certain magnitude being close to a potential to be provided to the data signal line during the data signal line charging period.

8. The display device according to claim 3, wherein the characteristic detection processing period further includes a detection preparation period during which preparation for detecting a characteristic of the characteristic detection target circuit element is performed in the monitored row, when a potential provided to the data signal line during the detection preparation period is Vmg, a potential provided to the data signal line during the drive transistor characteristic detection period is Vm_TFT, and a potential provided to the data signal line during the electrooptical element characteristic detection period is Vm_oled, values of Vmg, Vm_TFT, and Vm_oled are set so as to satisfy following relationships:

$$Vm_TFT<Vmg-Vth(T2)$$

$$Vm_TFT<ELVSS+Vth(oled)$$

$$Vm_oled>Vmg-Vth(T2)$$

$$Vm_oled>ELVSS+Vth(oled)$$

where Vth(T2) is a threshold voltage of the drive transistor, Vth(oled) is a light emission threshold voltage of the electrooptical element, and ELVSS is a cathode potential of the electrooptical element.

9. The display device according to claim 2, wherein the characteristic detection processing period is provided in a vertical retrace period.

10. The display device according to claim 9, wherein with any electrooptical element defined as a focused electrooptical element, when the focused electrooptical element is included in the monitored row, the pixel circuit driving unit provides to the data signal line a potential of a data signal corresponding to a larger grayscale voltage than a grayscale voltage provided when the focused electrooptical element is included in the non-monitored row, upon performing writing of the data signal to a pixel circuit included in the monitored row during a vertical scanning period.

11. The display device according to claim 2, wherein the characteristic detection processing period is provided in a vertical scanning period.

12. The display device according to claim 2, wherein the characteristic detection process for only either one of the electrooptical element and the drive transistor is performed per frame period.

13. The display device according to claim 2, wherein the output and signal-monitoring circuit has a function of obtaining, as the monitored data, data according to a magnitude of a current flowing through the data signal line.

14. The display device according to claim 2, wherein the AD conversion circuit is provided per plurality of the output and signal-monitoring circuits.

15. The display device according to claim 2, wherein the characteristic detection processing period further includes: a detection preparation period during which preparation for detecting a characteristic of the characteristic detection target circuit element is performed in the monitored row; and a light emission preparation period during which preparation for allowing the electrooptical element to emit light is performed in the monitored row.

16. The display device according to claim 2, wherein the signal measurement period further includes: a data signal line charging period during which the data signal line is charged such that a signal of a magnitude according to the characteristic of the characteristic detection target circuit element flows through the data signal line; and a monitoring period during which the monitored data is obtained by accumulating a time-integrated value of the signal flowing through the data signal line in the second capacitor.

17. The display device according to claim 16, wherein a cycle is repeated a plurality of times during a signal measurement period for detecting a characteristic of one characteristic detection target circuit element, the cycle including the data signal line charging period, the monitoring period, and the AD conversion period.

18. The display device according to claim 2, wherein the characteristic detection processing period is provided immediately after the power is turned on or during a power-off period.

19. A method for driving a display device including: a pixel matrix of n rows×m columns including n×m pixel circuits (n and m are integers greater than or equal to 2), each pixel circuit including an electrooptical element whose luminance is controlled by a current and a drive transistor for controlling a current to be supplied to the electrooptical element; scanning lines provided for the respective rows of the pixel matrix; monitoring control lines provided for the respective rows of the pixel matrix; data signal lines provided for the respective columns of the pixel matrix; and a pixel circuit driving unit configured to drive the scanning lines, the monitoring control lines, and the data signal lines, the method comprising:

a characteristic detecting step of detecting, during a frame period, a characteristic of a characteristic detection target circuit element including at least one of the electrooptical element and the drive transistor;

a correction data storing step of allowing a correction data storage unit to store characteristic data obtained based on results of the detection in the characteristic detecting step, as correction data for correcting video signals, the correction data storage unit being prepared in advance; and a video signal correcting step of generating data signals to be supplied to the n×m pixel circuits by correcting the video signals based on the correction data stored in the correction data storage unit, wherein each of the pixel circuits includes:

the electrooptical element;

an input transistor having a control terminal connected to the scanning line, a first conduction terminal connected to a control terminal of the drive transistor, and a second conduction terminal connected to the data signal line;

the drive transistor having a first conduction terminal to which a drive power supply potential is provided;

a monitoring control transistor having a control terminal connected to the monitoring control line, a first conduction terminal connected to a second conduction terminal of the drive transistor and an anode of the electrooptical element, and a second conduction terminal connected to the data signal line; and a first capacitor having one end connected to the control terminal of the drive transistor to hold a potential of the control terminal of the drive transistor, the pixel circuit driving unit includes:

an output and signal-monitoring circuit having a function of applying the data signal to the data signal line and a function of obtaining, as monitored data, data according to a magnitude of a signal flowing through the data signal line, the monitored data being base data for the characteristic data; and an AD conversion circuit configured to convert the monitored data from an analog value to a digital value, the output and current-monitoring circuit includes:

an internal data line connected to the data signal line;

an operational amplifier having a non-inverting input terminal to which the data signal is provided, and an inverting input terminal connected to the internal data line;

a second capacitor having one end connected to the internal data line, and an other end connected to an output terminal of the operational amplifier;

a first control switch having one end connected to the internal data line, and an other end connected to the output terminal of the operational amplifier; and a second control switch having one end connected to the data signal line, and an other end connected to the internal data line, the AD conversion circuit is provided per plurality of the output and signal-monitoring circuits, when a row for which the characteristic detection process is performed during a frame period is defined as a monitored row, and a row other than the monitored row is defined as a non-monitored row, the characteristic detecting step includes:

a detection preparing step of preparing for detecting a characteristic of the characteristic detection target circuit element in the monitored row;

a signal measuring step of detecting a characteristic of the characteristic detection target circuit element by measuring a signal flowing through the data signal line; and a light emission preparing step of preparing for allowing the electrooptical element to emit light in the monitored row, the signal measuring step includes:

a data signal line charging step of charging the data signal line such that a signal of a magnitude according to the characteristic of the characteristic detection target circuit element flows through the data signal line;

a monitoring step of obtaining monitored data by accumulating a time-integrated value of the signal flowing through the data signal line in the second capacitor; and an AD converting step of converting, by the AD conversion circuit, the monitored data from the analog value to the digital value, and in the AD converting step, the data signal line and the internal data line are electrically disconnected from each other by bringing the second control switch into an off state, and the AD conversion circuit sequentially converts the plurality of pieces of monitored data from analog values to digital values, the plurality of pieces of monitored data being obtained by a plurality of corresponding output and signal-monitoring circuits.

20. The method according to claim 19, wherein the output and signal-monitoring circuit has a function of obtaining, as the monitored data, data according to a magnitude of a current flowing through the data signal line.

* * * * *